US010244918B2

(12) United States Patent
Ryu et al.

(10) Patent No.: US 10,244,918 B2
(45) Date of Patent: Apr. 2, 2019

(54) DISH WASHER AND METHOD FOR CONTROLLING SAME

(71) Applicant: SAMSUNG ELECTRONICS CO., LTD., Suwon-si, Gyeonggi-do (KR)

(72) Inventors: Jung Chan Ryu, Yongin-si (KR); Woo Jin Shin, Suwon-si (KR); Soo Hyung Yoo, Incheon (KR); So Jeong Kim, Suwon-si (KR); Jun Ho Lee, Daegu (KR); Jae Man Joo, Yongin-si (KR); Sang Soo Choi, Taebaek-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/976,996

(22) Filed: May 11, 2018

(65) Prior Publication Data

US 2018/0256002 A1 Sep. 13, 2018

Related U.S. Application Data

(63) Continuation of application No. 15/108,695, filed as application No. PCT/KR2014/012706 on Dec. 23, 2014, now Pat. No. 9,986,884.

(30) Foreign Application Priority Data

Dec. 31, 2013 (KR) ..... 10-2013-0169140
Nov. 3, 2014 (KR) ..... 10-2014-0151608

(51) Int. Cl.
*A47L 15/42* (2006.01)
*A47L 15/16* (2006.01)
*A47L 15/00* (2006.01)

(52) U.S. Cl.
CPC ..... *A47L 15/4208* (2013.01); *A47L 15/0047* (2013.01); *A47L 15/16* (2013.01);
(Continued)

(58) Field of Classification Search
CPC .. A47L 15/16; A47L 15/0047; A47L 15/4282; A47L 15/4289; A47L 15/4244;
(Continued)

(56) References Cited

U.S. PATENT DOCUMENTS 3,067,759 A 12/1962 Guth
3,854,998 A 12/1974 Jacobs
(Continued)

FOREIGN PATENT DOCUMENTS

CN 1466931 1/2004
CN 101103891 1/2008
(Continued)

OTHER PUBLICATIONS

Chinese Office Action dated Jun. 4, 2018 in Chinese Patent Application No. 201480076652.1.
(Continued)

*Primary Examiner* — Michael E Barr
*Assistant Examiner* — Benjamin L Osterhout
(74) *Attorney, Agent, or Firm* — Staas & Halsey LLP

(57) ABSTRACT

Provided are a dish washing machine capable of effectively removing garbage which remains at the bottom of a washing tub and a filter and a method of controlling the same. When washing water is sprayed from a nozzle while a vane is positioned at a reference position during a drainage operation, since a deflection angle of the vane is bent back and the washing water is strongly sprayed toward a rear wall of a washing tub, the washing water may form a fast and strong water current over a bottom plate of the washing tub, and the fast and strong water current may remove garbage which remains at a filter while flowing over the bottom of the washing tub. Also, even when an excessive amount of garbage is accumulated at a filter at a top end of a sump and blocks the filter during a washing operation such as prelimi-
(Continued)

nary washing, main washing, etc., the filter is automatically washed using a small amount of water, thereby eliminating inconvenience of a user to directly separate and wash the filter. Also, washing performance may be effectively improved by precisely determining whether degradation in washing performance caused by a poor circulation of washing water occurs due to a filter blockage or generation of bubbles.

9 Claims, 39 Drawing Sheets

(52) U.S. Cl.
CPC ..... *A47L 15/4221* (2013.01); *A47L 15/4225* (2013.01); *A47L 15/4244* (2013.01); *A47L 15/4282* (2013.01); *A47L 15/4289* (2013.01); *A47L 2401/06* (2013.01); *A47L 2401/08* (2013.01); *A47L 2401/14* (2013.01); *A47L 2401/20* (2013.01); *A47L 2401/24* (2013.01); *A47L 2401/34* (2013.01); *A47L 2501/03* (2013.01); *A47L 2501/05* (2013.01); *A47L 2501/20* (2013.01)

(58) Field of Classification Search
CPC ..... A47L 15/4225; A47L 15/4221; A47L 15/4208; A47L 2401/08; A47L 2401/34; A47L 2501/05; A47L 2501/20; A47L 2501/03; A47L 2401/24; A47L 2401/20; A47L 2401/14; A47L 2401/06
See application file for complete search history.

(56) References Cited

U.S. PATENT DOCUMENTS

| | | | | |
|---|---|---|---|---|
| 5,165,435 | A | 11/1992 | Thies et al. | |
| 5,320,120 | A * | 6/1994 | Hoffman | A47L 15/4225 134/104.1 |
| 5,601,660 | A * | 2/1997 | Jeon | A47L 15/4206 134/10 |
| 6,182,674 | B1 * | 2/2001 | Jozwiak | A47L 15/0049 134/104.1 |
| 6,418,943 | B1 * | 7/2002 | Miller | A47L 15/4202 134/104.1 |
| 2004/0103925 | A1 | 6/2004 | Marettek | |
| 2005/0051201 | A1 * | 3/2005 | Ashton | A47L 15/0084 134/104.1 |
| 2007/0181156 | A1 | 8/2007 | Uz et al. | |
| 2011/0186085 | A1 | 8/2011 | Chen | |
| 2013/0319487 | A1 | 12/2013 | Hong et al. | |

FOREIGN PATENT DOCUMENTS

| | | |
|---|---|---|
| CN | 101103894 | 1/2008 |
| CN | 100551322 | 10/2009 |
| CN | 100551323 | 10/2009 |
| CN | 101610706 | 12/2009 |
| CN | 101820808 | 9/2010 |
| CN | 101902948 | 12/2010 |
| CN | 101822521 | 12/2011 |
| CN | 202113035 | 1/2012 |
| CN | 103169438 | 6/2013 |
| CN | 103462574 | 12/2013 |
| DE | 69820625 | 1/2004 |
| EP | 0976359 | 2/2000 |
| EP | 2117408 | 11/2009 |
| EP | 2 671 494 | 12/2013 |
| JP | 10-117996 | 5/1998 |
| JP | 2008-36130 | 2/2008 |
| JP | 2008-167960 | 7/2008 |
| KR | 10-2011-0061830 | 6/2011 |

OTHER PUBLICATIONS

International Search Report dated Mar. 25, 2015 in corresponding International Patent Application No. PCT/KR2014/012706.
International Written Opinion of the International Searching Authority dated Mar. 25, 2015 in corresponding International Patent Application No. PCT/KR2014/012706.
Canadian Office Action dated May 5, 2017 in corresponding Canadian Patent Application No. 2,934,870.
Australian Notice of Acceptance for Patent Application dated May 23, 2017 in corresponding Australian Patent Application No. 2014374695.
Communication pursuant to Rule 164(1) dated Jul. 28, 2017 in corresponding European Patent Application No. 14876375.8, 2 pages.
Partial European Search Report dated Jul. 19, 2017 in corresponding European Patent Application No. 14 87 6375, 4 pages.
Written Opinion dated Jul. 28, 2017 in corresponding European Patent Application No. 14 876 375.8, 4 pages.
Extended European Search Report dated Nov. 28, 2017 in European Patent Application No. 14876375.8.
Canadian Office Action dated Jan. 2, 2018 in Canadian Patent Application No. 2,934,870.
U.S. Office Action dated Aug. 23, 2017 in U.S. Appl. No. 15/108,695.
U.S. Office Action dated Oct. 6, 2017 in U.S. Appl. No. 15/108,695.
Notice of Allowance dated Feb. 5, 2018 and Corrected Notice of Allowance dated Apr. 13, 2018 both in U.S. Appl. No. 15/108,695.
U.S. Appl. No. 15/108,695, filed Jun. 28, 2016, Jung Chan Ryu, et al., Samsung Electronics Co., Ltd.
European Communication under Rule 71(3) dated Oct. 29, 2018 in European Patent Application No. 14876375.8.
Canadian Notice of Allowance dated Nov. 29, 2018 in Canadian Patent Application No. 2,934,870.

* cited by examiner

DISH WASHER AND METHOD FOR CONTROLLING SAME

CROSS-REFERENCE TO RELATED APPLICATIONS

This application is a continuation of U.S. patent application Ser. No. 15/108,695, filed on Jun. 28, 2016, which is a U.S. National Stage Application that claims the benefit under 35 U.S.C. § 371 of PCT International Patent Application No. PCT/KR2014/012706, filed Dec. 23, 2014, which claims the foreign priority benefit under 35 U.S.C. § 119 of Korean Patent Application No. 10-2013-0169140, filed Dec. 31, 2013, and Korean Patent Application No. 10-2014-0151608, filed Nov. 3, 2014, the contents of which are incorporated herein by reference.

TECHNICAL FIELD

Embodiments of the present invention relate to a dish washing machine capable of removing garbage at the bottom and on a filter of a washing tub and a method of controlling the same.

BACKGROUND ART

A dish washing machine is a home appliance which includes a body provided with a washing tub, a basket for accommodating dishes, a sump for storing washing water, a nozzle for spraying the washing water, and a pump for supplying the washing water in the sump to the nozzle and washes dishes by spraying washing water to dishes at a high pressure.

In a dish washing machine, a filter is installed at the bottom of a washing tub in which washing water is collected to filter garbage such as food scraps in the washing water which circulates for washing.

However, after dish washing is finished, when garbage remains at the bottom of a washing tub and, particularly, on the filter, a user has a diminished confidence in the dish washing and is left with an unpleasant feeling when taking out the dishes.

DISCLOSURE

Technical Problem

It is an aspect of the present invention to provide a dish washing machine capable of effectively removing garbage which remains at the bottom of a washing tub and on a filter and a method of controlling the same.

Technical Solution

One aspect of the present invention provides a dish washing machine including a washing tub, a door, a nozzle which is installed in the washing tub and sprays washing water, a vane which moves between a first position adjacent to the door and a second position adjacent to the nozzle and changes a spray direction of the washing water sprayed from the nozzle, and a filter installed on a bottom surface of the washing tub and filters garbage in the washing water. Here, when the vane arrives at the second position, the vane rotates toward the nozzle to allow the washing water sprayed by the nozzle to face a rear wall of the washing tub and removes the garbage which remains at the filter by rotation of the vane.

The dish washing machine may further include a motor which moves the vane, a position detector which detects whether the vane which moves according to driving of the motor arrives at the second position, and a controller which stops a movement of the vane and controls the washing water to be sprayed from the nozzle when the vane arrives at the second position.

The dish washing machine may further include a rail which is installed to extend from a front of the washing tub to a rear thereof and guides the movement of the vane. Here, the nozzle is installed to extend in the left and right of the washing tub and to be fixedly installed in the rear of the rail.

When the vane moves toward the nozzle and is positioned at the rearmost of the rail, the position detector may detect that the vane is positioned at the second position.

The position detector may include a permanent magnet installed at the vane and a position sensor which is positioned at the second position and detects the permanent magnet.

The dish washing machine may further include a bottom plate cover installed on one side of a bottom plate of the washing tub and coupled with the rail. Here, the position detector may include a permanent magnet installed at the vane and a position sensor installed on the bottom plate cover and positioned at the second position to detect the permanent magnet.

The dish washing machine may further include a sump which is installed at a bottom of the washing tub and stores the washing water and a pump which pumps and supplies the washing water stored in the sump to the nozzle. Here, the controller controls a rotation speed of the pump to adjust an amount of the washing water sprayed by the nozzle.

The dish washing machine may further include a sump which is installed at a bottom of the washing tub and stores the washing water and a pump which pumps and supplies the washing water stored in the sump to the nozzle. Here, the controller controls a driving time of the pump to adjust an amount of the washing water sprayed by the nozzle.

The controller may determine whether an operation of the dish washing machine is a drainage operation. Also, when the operation is the drainage operation, the controller may control the washing water deflected by the rotation of the vane to strike a rear wall of the washing tub and then to face the filter by stopping a movement of the vane and spraying the washing water from the nozzle.

One aspect of the present invention provides a method of controlling a dish washing machine which includes a washing tub, a nozzle which sprays washing water into the washing tub, a pump which supplies the washing water to the nozzle, a vane which changes a spray direction of the washing water sprayed from the nozzle, a motor which moves the vane, and a filter which filters garbage in the washing water. The method includes determining whether an operation is a drainage operation, detecting, when the operation is the drainage operation, whether the vane approaches the nozzle and arrives at a second position, stopping, when the vane arrives at the second position, driving of the motor and stopping a movement of the vane, moving the washing water deflected by rotation of the vane to strike a rear wall of the washing tub and to face the filter by spraying the washing water from the nozzle according to the driving of the nozzle, and removing the garbage which remains at the filter according to the movement of the washing water.

The method may further include moving the vane to the second position by driving the motor when the vane does not arrive at the second position.

The driving of the pump may include adjusting an amount of the washing water sprayed from the nozzle by controlling a rotation speed of the pump.

The driving of the pump may include adjusting an amount of the washing water sprayed from the nozzle by controlling a driving time of the pump.

Another aspect of the present invention provides a dish washing machine including a washing tub, a nozzle which is installed in the washing tub and sprays washing water, a circulation pump which supplies the washing water to the nozzle, a filter which is installed on a bottom surface of the washing tub and filters garbage in the washing water, a blockage detector which detects a blockage of the filter, and a controller which performs a washing operation by supplying a first water supply amount of the washing water and driving the circulation pump when a washing command is input and stops the washing operation and performs an operation of washing the filter when the blockage of the filter is detected. Here, the controller supplies a second water supply amount of the washing water smaller than the first water supply amount to allow the washing water sprayed from the nozzle to be sprayed toward the filter and washes the filter by controlling the circulation pump at a rotation speed lower than a rotation speed of the circulation pump driven during the washing operation.

The blockage detector may detect a variation in power consumption of the circulation pump during driving of the circulation pump for the washing operation and may detect the blockage of the filter when the power consumption is reduced.

The dish washing machine may further include a sump which is installed at a bottom of the washing tub and stores the washing water and a water supply valve which supplies the washing water. Here, the second water supply amount may be a small amount of the washing water capable of filling the inside of the sump.

The dish washing machine may further include a door which opens and closes the washing tub and a vane which moves between a first position adjacent to the door and a second position adjacent to the nozzle and changes a spray direction of the washing water sprayed from the nozzle. Here, when the vane arrives at the first position, the controller may stop a movement of the vane and may control the washing water sprayed from the nozzle to face the filter.

The dish washing machine may further include a motor which moves the vane. Here, the controller may determine that the vane arrives at the first position when a time in which the vane which moves according to driving of the motor moves from the second position is counted and a certain time passes.

The dish washing machine may further include a drainage pump which discharges the washing water. Here, the controller may discharge the washing water by driving the drainage pump when a driving time of the circulation pump is counted and a certain time passes.

The nozzle may further include a plurality of spray holes, and the controller may control the plurality of spray holes to spray the washing water or a part of the plurality of spray holes to spray the washing water.

Advantageous Effects

According to a dish washing machine and a method of controlling the same disclosed herein, when washing water is sprayed from a nozzle while a vane is positioned at a reference position during a drainage operation, since a deflection angle of the vane is bent back to cause the washing water to be strongly sprayed toward a rear wall of a washing tub, the washing water may form a fast and strong water current along a bottom plate of the washing tub, and the fast and strong water current may remove garbage which remains on a filter while flowing over the bottom of the washing tub.

Also, an amount of washing water sprayed from a nozzle is adjusted by controlling rotation speed and driving time of a circulation pump which supplies the washing water to the nozzle, thereby effectively removing garbage such as food scraps which remains at the bottom of the washing tub and on a filter.

Also, even when an excessive amount of garbage is accumulated on a filter at the top end of a sump and blocks the filter during a washing operation such as preliminary washing, main washing, etc., the filter is automatically washed using a small amount of water, thereby eliminating inconvenience of a user of having to directly remove and wash the filter.

Also, washing performance may be effectively improved by precisely determining whether degradation in washing performance caused by a poor circulation of washing water occurs due to a filter blockage or generation of bubbles.

MODE FOR INVENTION

Hereinafter, one embodiment of the present invention will be described in detail with reference to the attached drawings.

An overall structure of the dish washing machine in accordance with one embodiment of the present invention will be schematically described with reference to FIGS. 1 and 2.

Figure 1:
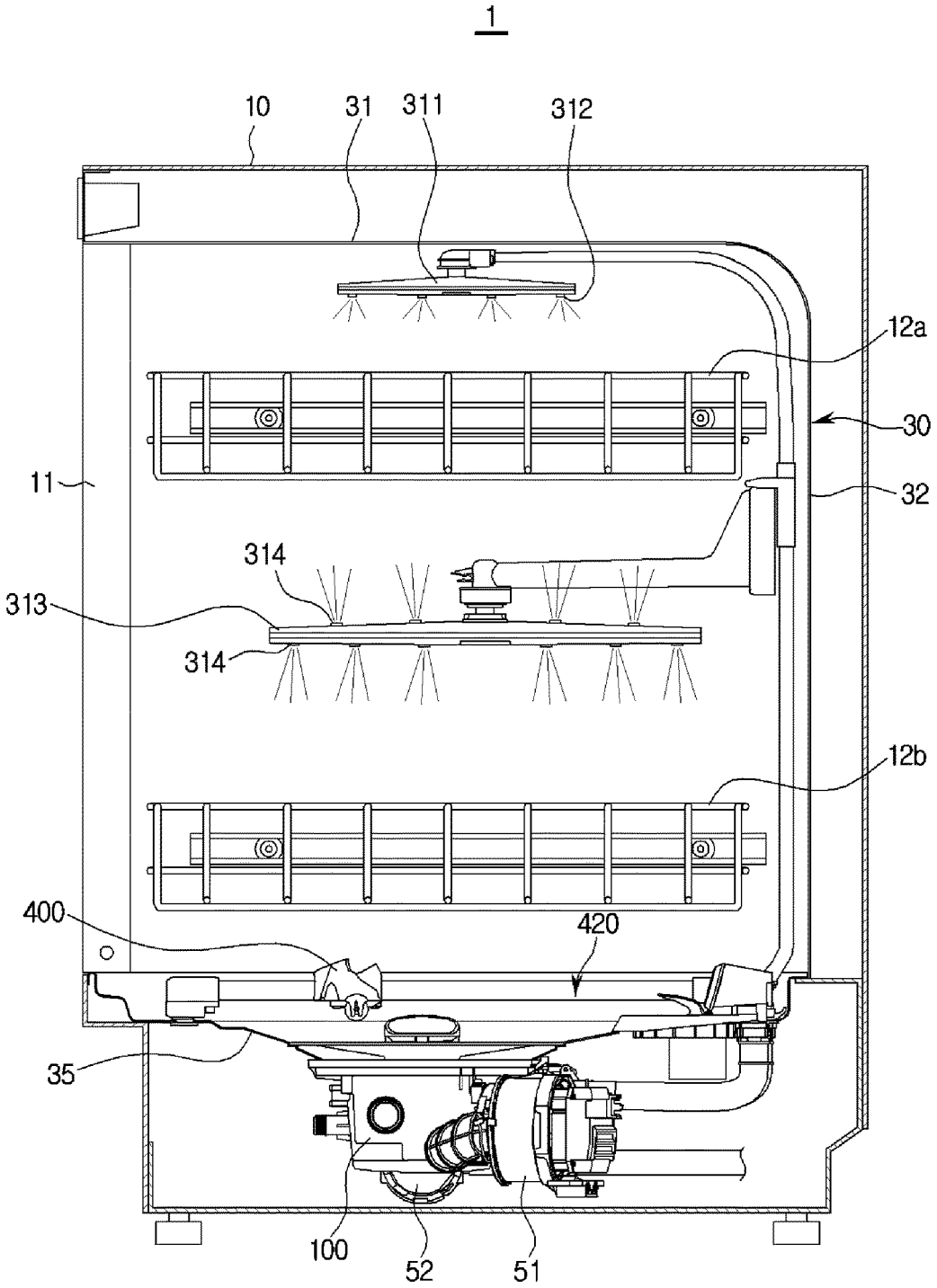
FIG. 1 is a schematic cross-sectional view of a dish washing machine in accordance with one embodiment of the present invention.
Figure 2:
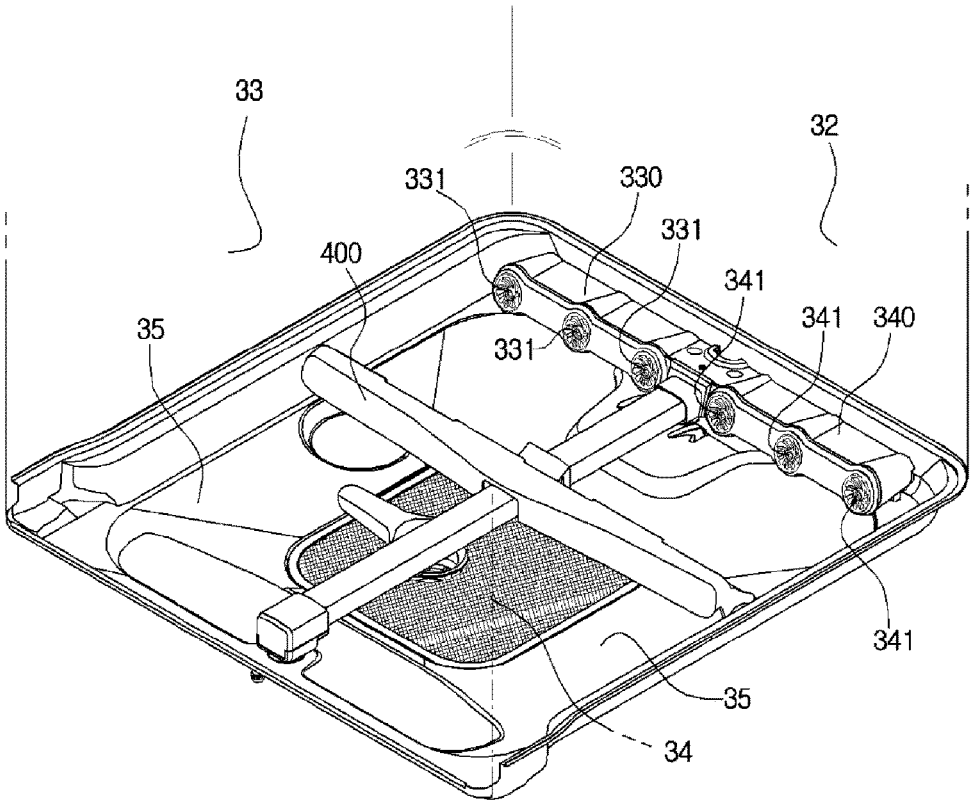
FIG. 2 is a bottom view of the dish washing machine in accordance with one embodiment of the present invention.

FIG. 1 is a schematic cross-sectional view of the dish washing machine in accordance with one embodiment of the present invention. FIG. 2 is a bottom view of the dish washing machine in accordance with one embodiment of the present invention.

A dish washing machine 1 includes a body 10 which forms an exterior, a washing tub 30 provided in the body 10, baskets 12*a* and 12*b* provided in the washing tub 30 to accommodate dishes, nozzles 311, 313, 330, and 340 which spray washing water, a sump 100 which stores the washing water, a circulation pump 51 which pumps and supplies the washing water to the nozzles 311, 313, 330, and 340, a drainage pump 52 which discharges the washing water with garbage from the body 10, a vane 400 which deflects the washing water toward the dishes while moving in the washing tub 30, and a driving device 420 which drives the vane 400.

The washing tub 30 has an approximate box shape with an open front to accommodate dishes and includes a top wall 31, a rear wall 32, a left wall 33, a right wall 34, and a bottom plate 35. The open front of the washing tub 30 is opened and closed by a door 11.

The baskets 12*a* and 12*b* may be wire racks formed of wires to allow the washing water to pass through without being collected. The baskets 12*a* and 12*b* may be detachably provided in the washing tub 30. The baskets 12*a* and 12*b* may include an upper basket 12*a* disposed at an upper portion of the washing tub 30 and a lower basket 12*b* disposed at a lower portion of the washing tub 30.

A universal motor including a field coil and an armature, a brushless direct motor (hereinafter, referred to as a BLDC motor) including a permanent magnet and an electric magnet, etc. may be used for the circulation pump 51.

In the present invention, the circulation pump 51 using a BLDC motor whose rotating speed can be controlled will be described as an example.

The nozzles 311, 313, 330, and 340 wash dishes by spraying the washing water at a high pressure. The nozzles 311, 313, 330, and 340 may include an upper rotating nozzle 311 provided on the upper portion of the washing tub 30, an intermediate rotating nozzle 313 provided in the middle of the washing tub 30, and fixed nozzles 330 and 340 provided at the lower portion of the washing tub 30.

The upper rotating nozzle 311 may be provided above the upper basket 12*a* and may spray washing water downward while rotating due to a water pressure. For this, a plurality of spray holes 312 may be provided at the bottom end of the upper rotating nozzle 311. The upper rotating nozzle 311 may directly spray washing water toward the dishes stored in the upper basket 12*a*.

The intermediate rotating nozzle 313 may be provided between the upper basket 12*a* and the lower basket 12*b* and may spray washing water up and down while rotating due to a water pressure. For this, a plurality of spray holes 314 may be provided at the top end and the bottom end of the intermediate rotating nozzle 313. The intermediate rotating nozzle 313 may directly spray washing water toward the dishes stored in the upper basket 12*a* and the lower basket 12*b*.

The fixed nozzles 330 and 340, unlike the rotating nozzles 311 and 313, are provided to be fixed to one side of the washing tub 30 rather than move. The fixed nozzles 330 and 340 may be disposed adjacently to the rear wall 32 of the washing tub 30 and may spray the washing water toward the front of the washing tub 30. Accordingly, the washing water sprayed by the fixed nozzles 330 and 340 may not directly face the dishes.

The washing water sprayed by the fixed nozzles 330 and 340 may be deflected toward the dishes by the vane 400. The fixed nozzles 330 and 340 are disposed below the lower basket 12*b*, and the vane 400 deflects the washing water sprayed by the fixed nozzles 330 and 340 upward. That is, the washing water sprayed by the fixed nozzles 330 and 340 is deflected toward the dishes stored in the lower basket 12*b* by the vane 400.

The fixed nozzles 330 and 340 include a plurality of spray holes 331 and 341 arranged on the left and right of the washing tub 30. The plurality of spray holes 331 and 341 spray the washing water forward.

The vane 400 is installed to laterally extend in the washing tub 30 to deflect all the washing water sprayed by the plurality of spray holes 331 and 341 provided at the fixed nozzles 330 and 340. That is, one end of the vane 400 in a longitudinal direction may be adjacent to the left wall 33 of the washing tub 30, and another end of the vane 400 in the longitudinal direction may be provided to be adjacent to the right wall 34 of the washing tub 30.

The vane 400 described above may linearly reciprocate in a spray direction of the washing water sprayed by the fixed nozzles 330 and 340. That is, the vane 400 changes the spray direction of the washing water sprayed by the fixed nozzles 330 and 340 while moving between a first position adjacent to the door 11 and a second position adjacent to the fixed nozzles 330 and 340 and linearly reciprocate forward and backward in the washing tub 30.

The second position is a reference position of the vane 400 on a moving path of the vane 400 at which a position sensor 701 detects a magnetic field of a permanent magnet 702 wherein the vane 400 approaches the fixed nozzles 330 and 340 so that gaps between the vane 400 and the fixed nozzles 330 and 340 are minimized.

The first position is a position of the vane 400 detected using time taken for the vane 400 to move from the second position, wherein the vane 400 approaches the door 11 to maximize the gaps between the vane 400 and the fixed nozzles 330 and 340.

Accordingly, a linear spraying structure including the fixed nozzles 330 and 340 and the vane 400 may wash the dishes by spraying the washing water to the whole area of the washing tub 30 without a blind spot. This is differentiated from a rotor type spraying structure capable of spraying washing water only within a rotating radius.

The fixed nozzles 330 and 340 may include a left fixed nozzle 330 disposed on the left of the washing tub 30 and a right fixed nozzle 340 disposed on the right of the washing tub 30.

The rotating nozzles 311 and 313 and the fixed nozzles 330 and 340 may independently spray the washing water. The left fixed nozzle 330 and the right fixed nozzle 340 also may independently spray the washing water.

The washing water sprayed by the left fixed nozzle 330 may be deflected by the vane 400 only toward an area on the left of the washing tub 30. The washing water sprayed by the right fixed nozzle 340 may be deflected by the vane 400 only toward an area on the right of the washing tub 30.

Accordingly, the dish washing machine 1 may independently and separately wash the left and right areas of the washing tub 30.

Meanwhile, although independently and separately washing the left and right of the washing tub 30 has been described as an example of one embodiment of the present invention, the present invention is not limited thereto, and separate washing may be performed while the washing tub 30 is further subdivided as necessary.

Hereinafter, significant components of the dish washing machine 1 in accordance with one embodiment of the present invention will be sequentially described with reference to the drawings.

First, an operation, a flow channel structure, a structure of a fixed nozzle assembly, and a washing water distribution structure of the dish washing machine 1 in accordance with one embodiment of the present invention will be described with reference to FIG. 3.

Figure 3:
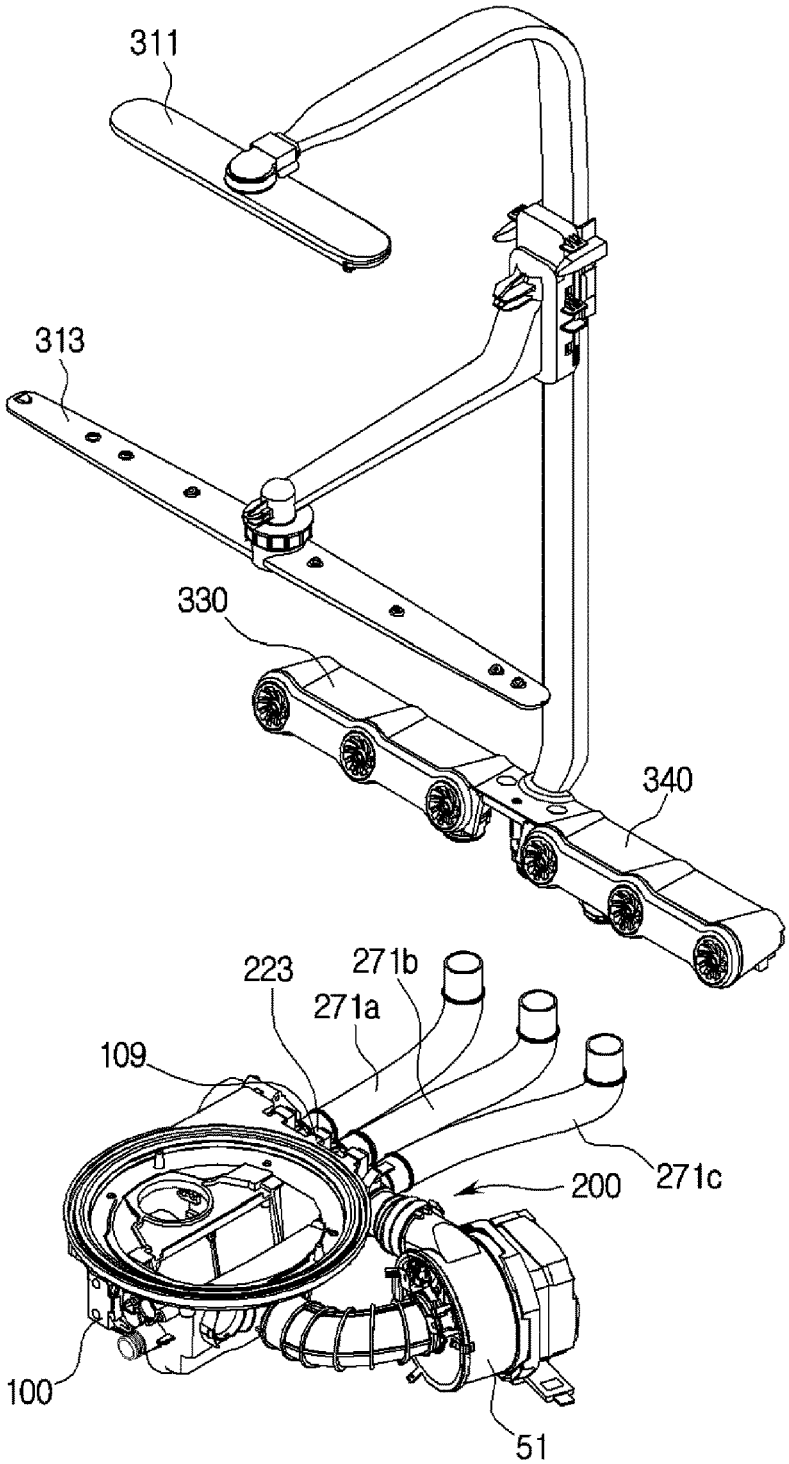
FIG. 3 is a view illustrating a flow channel structure of the dish washing machine in accordance with one embodiment of the present invention.

FIG. 3 is a bottom view illustrating a flow channel structure of the dish washing machine in accordance with one embodiment of the present invention.

In FIG. 3, the dish washing machine 1 in accordance with one embodiment of the present invention includes a water supplying operation, a washing operation, a drainage operation, and a drying operation.

In the water supplying operation, when washing water is supplied to the washing tub 30 through a water supply pipe (not shown), the washing water supplied to the washing tub 30 flows into and is collected at the sump 100 provided at the bottom of the washing tub 30 due to a gradient of the bottom plate 35 of the washing tub 30.

In the washing operation, the circulation pump 51 operates and pumps the washing water stored in the sump 100. The washing water pumped by the circulation pump 51 may be distributed to the rotating nozzles 311 and 313, the left fixed nozzle 330, and the right fixed nozzle 340 through a distribution device 200. Due to the pumping force of the circulation pump 51, the dishes may be washed by the washing water sprayed by the nozzles 311, 313, 330, and 340 at a high pressure.

Here, the upper rotating nozzle 311 and the intermediate rotating nozzle 313 may receive the washing water from the distribution device 200 through a second hose 271*b*. The left fixed nozzle 330 may receive the washing water from the distribution device 200 through a first hose 271*a*. The right fixed nozzle 340 may receive the washing water from the distribution device 200 through a third hose 271*c*.

According to one embodiment of the present invention, the distribution device 200 may be configured to have a total of four distribution modes.

In a first mode, the distribution device 200 supplies the washing water to the rotating nozzles 311 and 313 through the second hose 271*b*.

In a second mode, the distribution device 200 supplies the washing water to the right fixed nozzle 340 through the third hose 271*c*.

In a third mode, the distribution device 200 supplies the washing water to the left fixed nozzle 330 and the right fixed nozzle 340 through the first hose 271*a* and the third hose 271*c*.

In a fourth mode, the distribution device 200 supplies the washing water to the left fixed nozzle 330 through the first hose 271*a*.

Meanwhile, the distribution device 200, unlike the one embodiment of the present invention, may be configured to have more various distribution modes.

The washing water sprayed by the nozzles 311, 313, 330, and 340 may strike the dishes to remove food residue on the dishes, that is, garbage, and may drop with the garbage and be collected at the sump 100 again. The circulation pump 51 pumps again and circulates the washing water stored in the sump 100. During the washing operation, the circulation pump 51 may repeatedly operate and stop several times. In this process, the garbage which drops together with the washing water into the sump 100 is collected by a filter installed in the sump 100 and remains in the sump 100 without circulating through the nozzles 311, 313, 330, and 340.

During the drainage operation, the drainage pump 52 operates to discharge the washing water together with the garbage which remains in the sump 100 from the body 10.

During the drying operation, a heater (not shown) mounted in the washing tub 30 operates to dry the dishes.

Next, a bottom plate cover of the dish washing machine in accordance with one embodiment of the present invention will be described with reference to FIGS. 4 to 6.

Figure 4:
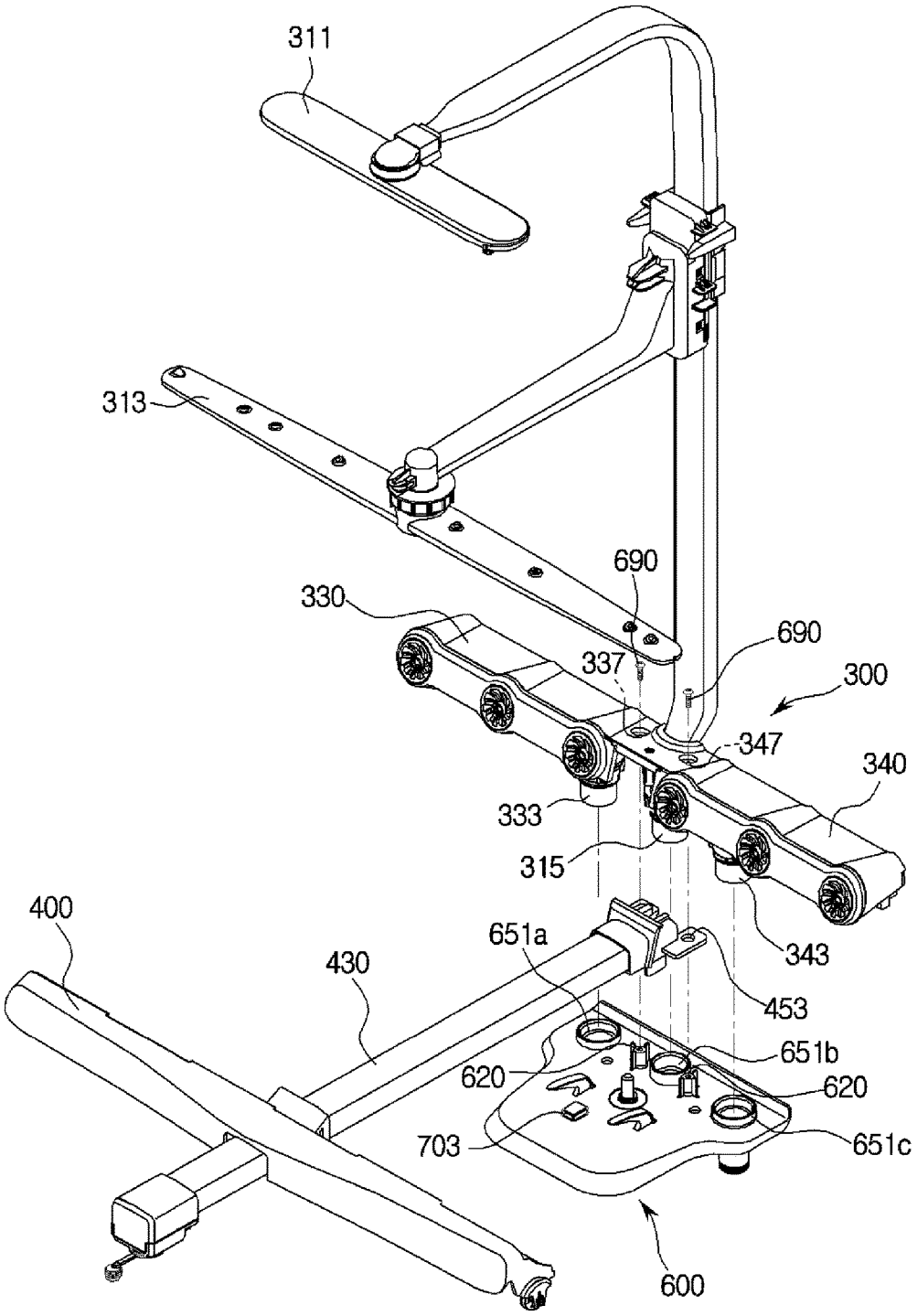
FIG. 4 is an exploded view illustrating a vane, a rail assembly, a spray nozzle assembly, and a bottom plate cover of the dish washing machine in accordance with one embodiment of the present invention.

FIG. 4 is an exploded view illustrating the vane, a rail assembly, a spray nozzle assembly, and a bottom plate cover of the dish washing machine in accordance with one embodiment of the present invention. FIG. 5 is an exploded view illustrating a washing tub bottom plate, the bottom plate cover, and a motor of the dish washing machine in accordance with one embodiment of the present invention. FIG. 6 is a cross-sectional view illustrating the washing tub bottom plate, the bottom plate cover, and the motor of the dish washing machine in accordance with one embodiment of the present invention.

Figure 5:
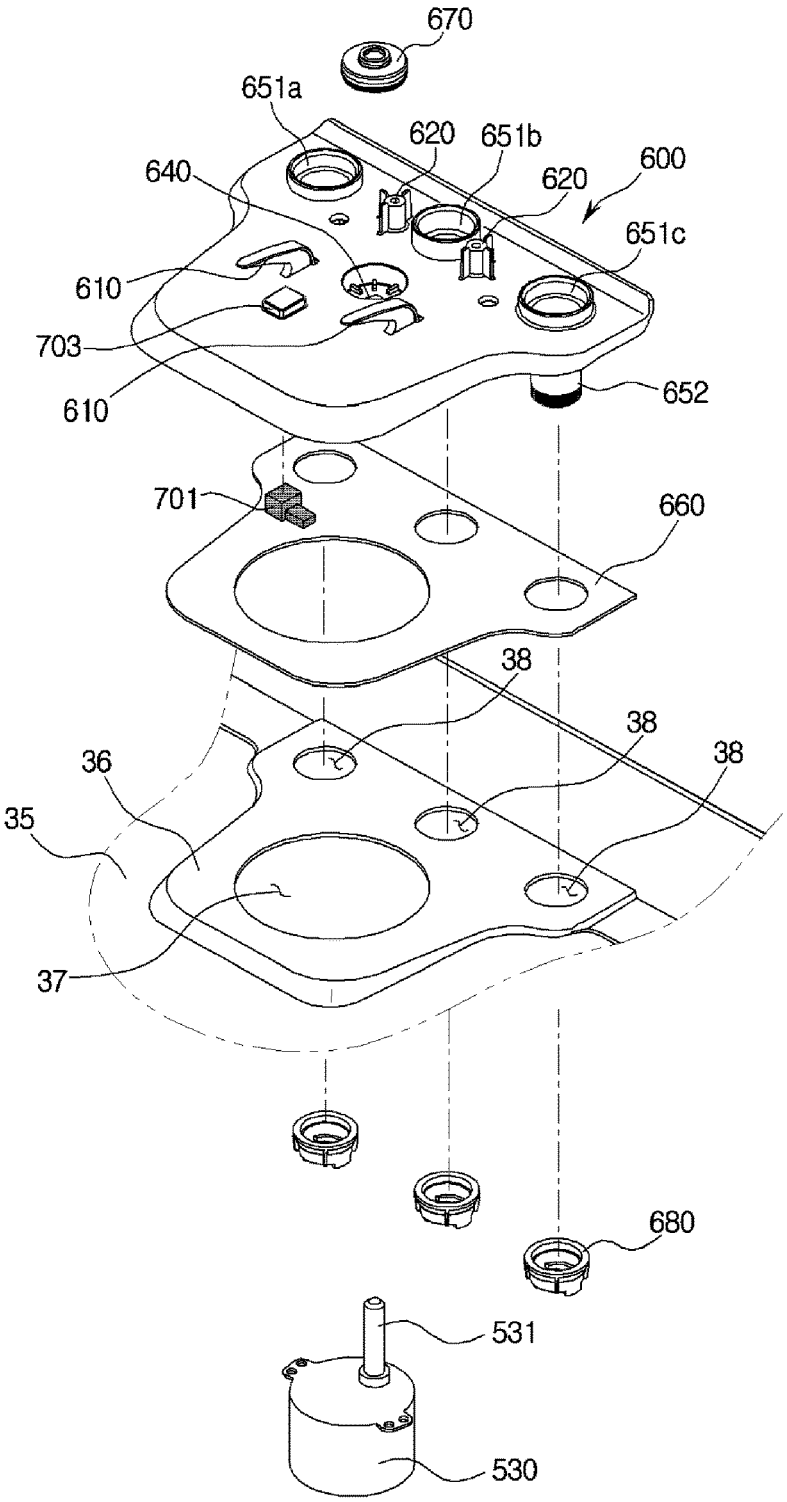
FIG. 5 is an exploded view illustrating a washing tub bottom plate, the bottom plate cover, and a motor of the dish washing machine in accordance with one embodiment of the present invention.
Figure 6:
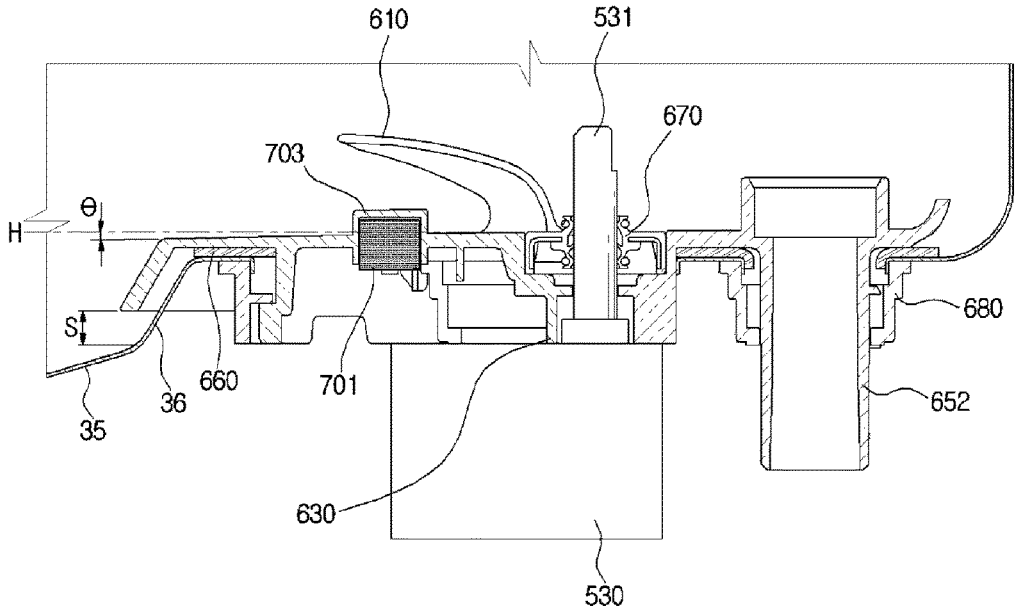
FIG. 6 is a cross-sectional view illustrating the washing tub bottom plate, the bottom plate cover, and the motor of the dish washing machine in accordance with one embodiment of the present invention.

Referring to FIGS. 4 to 6, the dish washing machine 1 in accordance with one embodiment of the present invention includes a bottom plate cover 600 coupled with one side in the rear of the bottom plate 35 of the washing tub 30.

The bottom plate cover 600 seals a motor through hole 37 and flow channel through holes formed in the bottom plate 35, supports a motor 530 which drives the vane 400, and fixes a rail assembly 430 and a nozzle assembly 300 of the dish washing machine 1.

Here, as described above, the nozzle assembly 300 includes the upper rotating nozzle 311, the intermediate rotating nozzle 313, the left fixed nozzle 330, and the right fixed nozzle 340.

The rail assembly 430 guides movement of the vane 400, and a detailed configuration thereof will be described below.

A bottom plate protruding portion 36 which protrudes to allow the bottom plate cover 600 to be coupled is formed in the rear of the bottom plate 35. A motor through hole 37 through which the motor 530 for driving the vane 400 passes and flow channel through holes 38 through which a flow channel which connects the nozzle assembly 300 with the distribution device 200 (refer to FIG. 3) passes are formed in the bottom plate protruding portion 36.

The motor 530 is mounted on a bottom surface of the bottom plate cover 600 and may be drawn out with the bottom plate cover 600 through the motor through hole 37 when the bottom plate cover 600 is separated from the bottom plate 35.

In detail, hose connecting portions 652 of the bottom plate cover 600 may pass through the flow channel through holes 38.

The bottom plate cover 600 includes a shaft through hole 640 through which a driving shaft 531 of the motor 530 passes, the hose connecting portions 652 which protrude downward to allow the hoses 271*a*, 271*b*, and 271*c* extending from the distribution device 200 to be coupled and are inserted into the flow channel through holes 38 of the bottom plate protruding portion 36, nozzle inlet connecting portions 651*a*, 651*b*, and 651*c* which protrude upward to allow inlets 315, 333, and 343 of the nozzle assembly 300 to be coupled, fastening holes 620 for fixing the nozzle assembly 300 and the rail assembly 430, and a rotation guide 610 which protrudes to guide rotation of the vane 400.

The bottom plate cover 600 is in contact and coupled with a top surface of the bottom plate protruding portion 36. Fixing caps 680 are coupled with the hose connecting portions 652 of the bottom plate cover 600 to fix the bottom plate cover 600 to the bottom plate protruding portion 36.

A first sealing member 660 may be provided between the bottom plate cover 600 and the bottom plate protruding portion 36 to prevent the washing water in the washing tub 30 from leaking through the motor through hole 37 and the flow channel through holes 38 of the bottom plate protruding portion 36. The first sealing member 660 may be formed of a rubber material.

A motor mounting portion 630 on which the motor 530 which drives the vane 400 is mounted may be provided at the bottom surface of the bottom plate cover 600. The driving shaft 531 of the motor 530 may pass through the shaft through hole 640 of the bottom plate cover 600 and may protrude into the washing tub 30. A driving pulley (not shown) which will be described below may be coupled with the driving shaft 531 of the motor 530 and may rotate with the driving shaft 531.

A second sealing member 670 may be provided in the shaft through hole 640 to prevent the washing water in the washing tub 30 from leaking through the shaft through hole 640. The second sealing member 670 may be a mechanical sealing apparatus which allows the driving shaft 531 to smoothly rotate with sealing.

Also, the position sensor 701 is installed on the bottom surface of the bottom plate cover 600 and a sensor mounting portion 703 on which the position sensor 701 is mounted is provided on a top surface of the bottom plate cover 600.

The position sensor 701 is for detecting a reference position for initiating or finishing the movement of the vane 400 while the dish washing machine 1 operates, and a Hall sensor may be used.

Also, the position sensor 701 is installed corresponding to a position of the permanent magnet 702 (refer to FIG. 7) installed in the vane 400.

Also, the position sensor 701 may be installed at any position which allows a magnetic field of the permanent magnet 702 to be detected while the vane 400 is moving. That is, the position sensor 701 may be at any position on the moving path of the vane 400 at which the reference position of the vane 400 can be detected.

The top surface of the bottom plate cover 600 may be provided at a certain angle θ (refer to FIG. 6) based on a reference horizontal plane H (refer to FIG. 6).

This is to prevent garbage from being accumulated on the bottom plate cover 600 or moving toward the fixed nozzles 330 and 340. In the dish washing machine 1 in accordance with one embodiment of the present invention, since the fixed nozzles 330 and 340 do not move unlike the rotating nozzles 311 and 313, the garbage may remain and be stagnant. However, such a problem may be prevented using the structure described above.

The angle θ between top surface of the bottom plate cover 600 and the reference horizontal plane H may be about 3°.

Also, an end portion of the bottom plate cover 600 may be provided to be separated from the bottom plate 35 by a certain distance S (refer to FIG. 6). This is because it is very difficult to allow the bottom plate cover 600 to be in complete contact with the bottom plate 35 due to manufacturing and assembling errors, and rather, this is to prevent garbage from being inserted between the end portion of the bottom plate cover 600 and the bottom plate 35. The distance S between the end portion of the bottom plate cover 600 and the bottom plate 35 may be about 5 mm.

The bottom plate cover 600 may be coupled with the rail assembly 430 and the nozzle assembly 300. The bottom plate cover 600, the rail assembly 430, and the nozzle assembly 300 may be strongly fixed by the fastening member 690. For this, fastening holes 620, 453, and 347 may be formed at positions corresponding to the bottom plate cover 600, the nozzle assembly 300, and the rail assembly 430.

By this structure, the rail assembly 430 and the nozzle assembly 300 may be mutually fixed and aligned.

In the dish washing machine 1 in accordance with one embodiment of the present invention, since the washing water sprayed by the fixed nozzles 330 and 340 of the nozzle assembly 300 does not directly move toward the dishes and instead is deflected by the vane 400 coupled with the rail assembly 430 to move toward the dishes, precisely aligning positions of the fixed nozzles 330 and 340 and the rail assembly 430 is necessary which may be satisfied through the coupling structure described above.

Meanwhile, reference numerals 337 and 347 which have not been described denote coupling holes formed in the left fixed nozzle 330 and the right fixed nozzle 340, respectively.

Next, the vane of the dish washing machine in accordance with one embodiment of the present invention will be described with reference to FIGS. 7 and 8.

Figure 7:
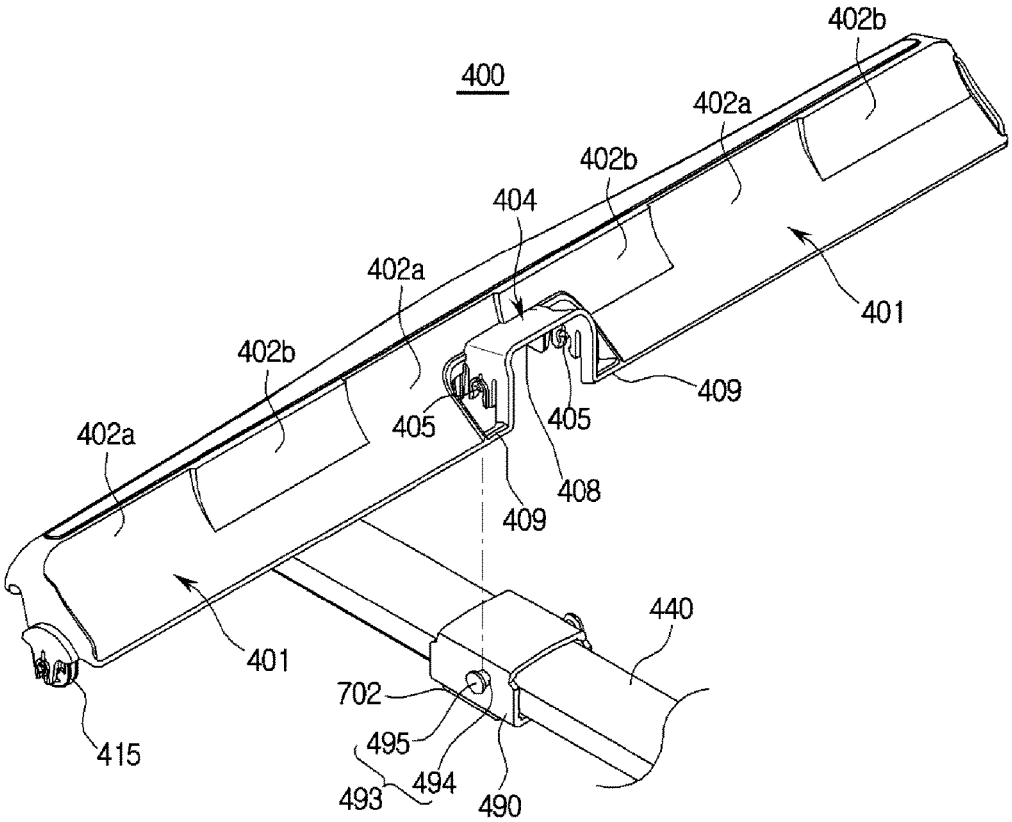
FIG. 7 is a view illustrating the vane and a vane holder of the dish washing machine in accordance with one embodiment of the present invention.

FIG. 7 is a view illustrating the vane and a vane holder of the dish washing machine in accordance with one embodiment of the present invention. FIG. 8 is a perspective view of the vane of the dish washing machine in accordance with one embodiment of the present invention.

Figure 8:
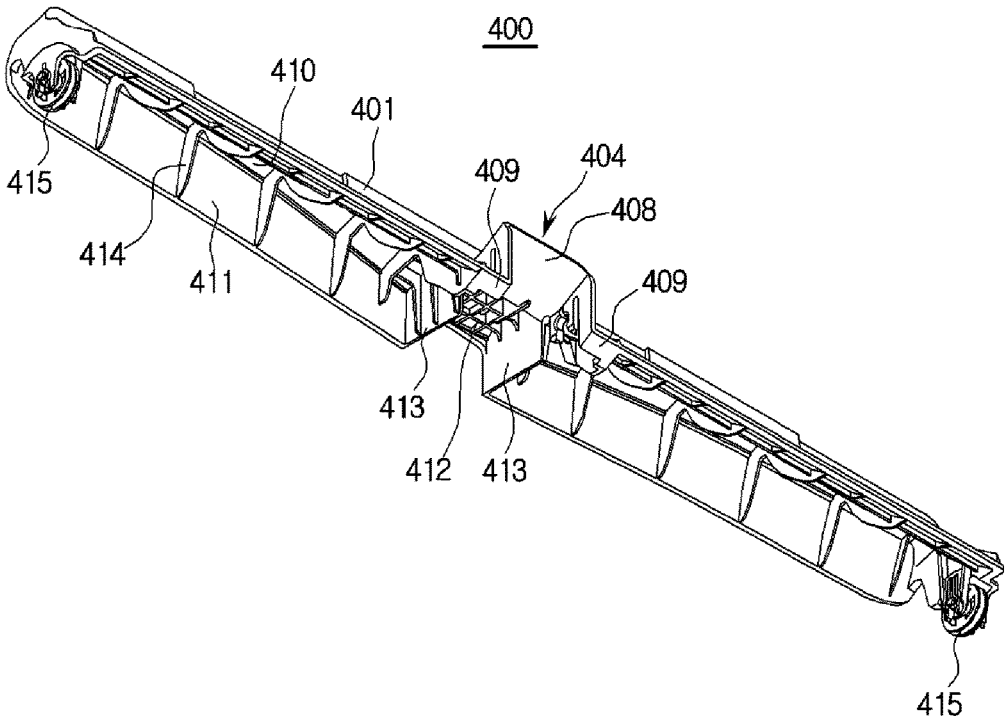
FIG. 8 is a perspective view of the vane of the dish washing machine in accordance with one embodiment of the present invention.

In FIGS. 7 and 8, the vane 400 is provided to extend perpendicularly to a rail 440.

The vane 400 includes a deflecting portion 401 which deflects washing water sprayed by the fixed nozzles 330 and 340, an upper supporting portion 410 bent from the deflecting portion 401, a rear supporting portion 411 bent from the upper supporting portion 410, a cap portion 404 provided in a central portion in a longitudinal direction of the deflecting portion 401, a rotation held portion 409 provided to be interrupted by a rotation guide 610 (refer to FIG. 12) of the bottom plate cover 600, a reinforcing rib 414 provided to reinforce strength of the deflecting portion 401, the upper supporting portion 410, and the rear supporting portion 411, a horizontal supporting portion 412 supported by a top surface of a vane holder 490, and a vertical supporting portion 413 supported by a side of the vane holder 490.

The deflecting portion 401 includes deflecting surfaces 402*a* and 402*b* provided to be inclined to deflect the washing water. The deflecting surfaces 402*a* and 402*b* may include the deflecting surfaces 402*a* and 402*b* with different inclines which are alternately arranged in a longitudinal direction to deflect the washing water at different angles.

The cap portion 404 may include a coupling groove 405 for being coupled with the vane holder 490 and a rotation stopper portion 408 which restricts a rotation range of the vane 400 when the vane 400 rotates due to the rotation guide 610 of the bottom plate cover 600.

A coupling protrusion portion 493 of the vane holder 490 may be coupled with the coupling groove 405 of the vane 400. In detail, a coupling shaft portion 494 of the coupling protrusion portion 493 may be inserted into the coupling groove 405 of the vane 400. The coupling shaft portion 494 may rotatably support the vane 400.

The permanent magnet 702 is installed on a bottom surface of the vane holder 490. The permanent magnet 702 is a position identification member which moves when the vane 400 moves with the vane 400 and generates a magnetic field.

The permanent magnet 702, unlike the position sensor 701 fixed to the bottom plate cover 600, may move with the vane 400 for allowing the position sensor 701 to detect the magnetic field.

Next, a movement section and a non-movement section and a rotating operation of the vane in accordance with one embodiment of the present invention will be described with reference to FIGS. 9 to 13.

Figure 9:
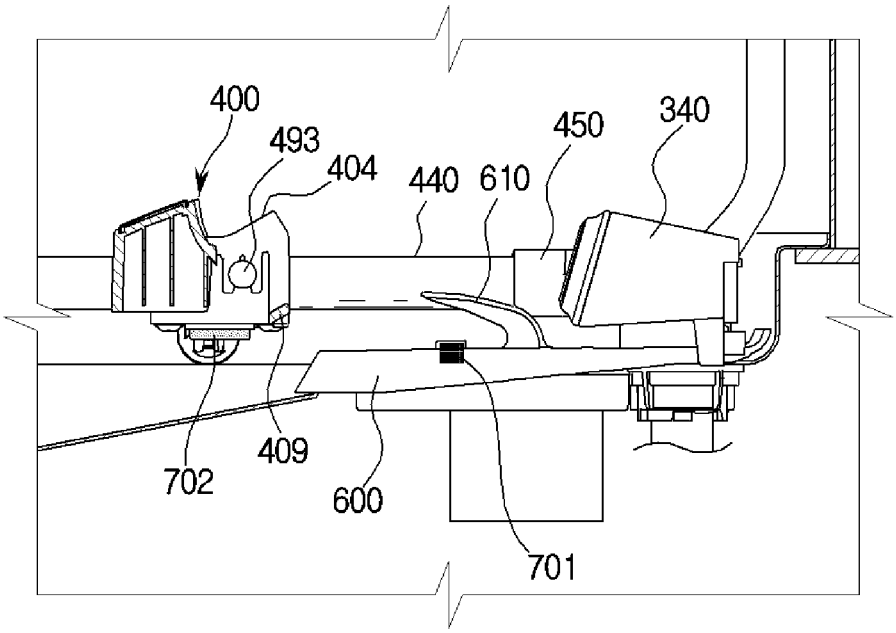
FIGS. 9 to 11 are views illustrating a rotating movement of the vane of the dish washing machine in accordance with one embodiment of the present invention.
Figure 10:
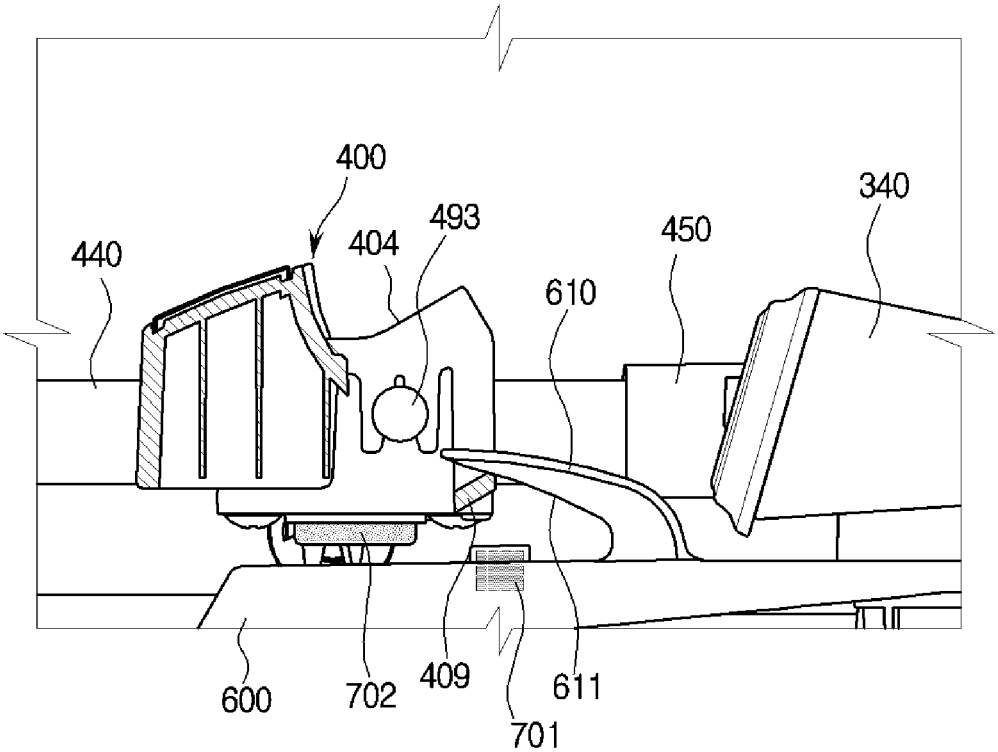
Figure 11:
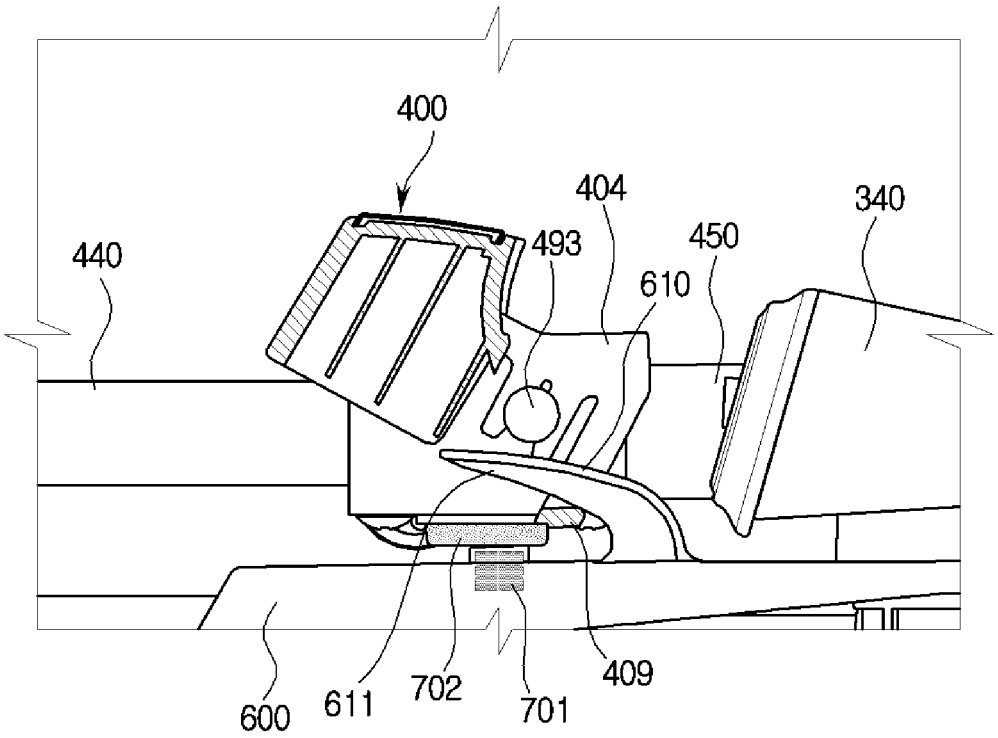
Figure 12:
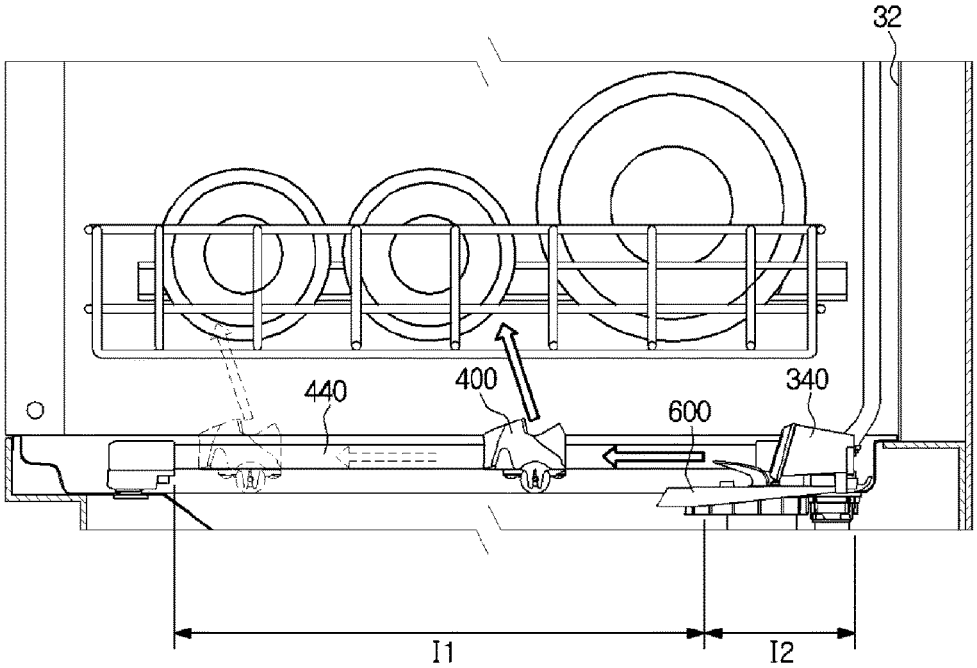
FIG. 12 is a view illustrating a washing water deflecting operation of the vane in a vane movement section of the dish washing machine in accordance with one embodiment of the present invention.
Figure 13:
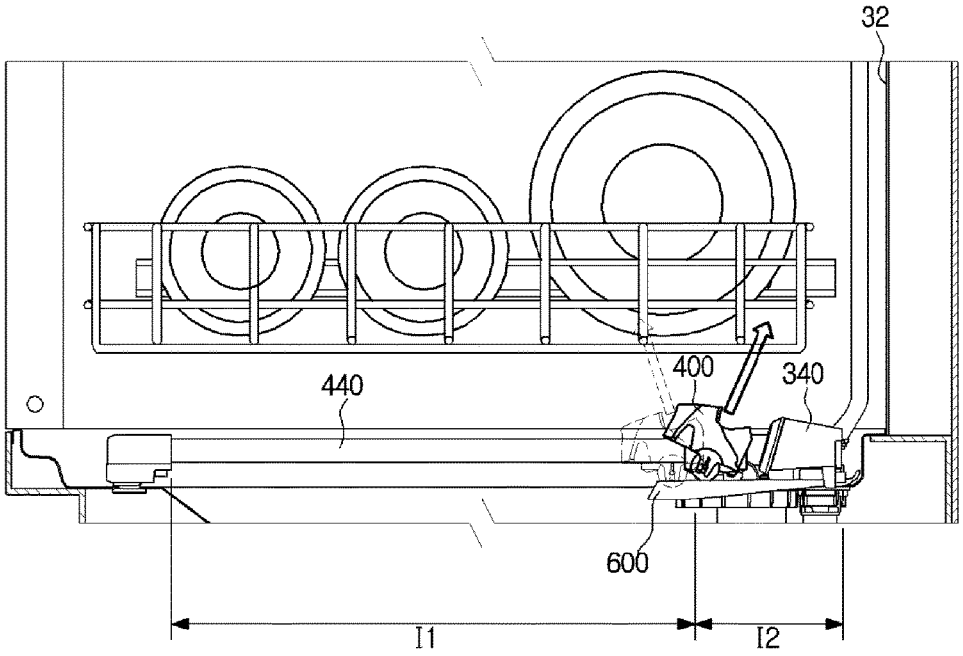
FIG. 13 is a view illustrating a washing water deflecting operation of the vane deflecting washing water in a vane non-movement section of the dish washing machine in accordance with one embodiment of the present invention.

FIGS. 9 to 11 are views illustrating a rotation operation of the vane of the dish washing machine in accordance with one embodiment of the present invention. FIG. 12 is a view illustrating an operation of the vane deflecting washing water in a vane movement section of the dish washing machine in accordance with one embodiment of the present invention. FIG. 13 is a view illustrating an operation of the vane deflecting washing water in a vane non-movement section of the dish washing machine in accordance with one embodiment of the present invention.

In FIGS. 9 to 13, in the dish washing machine 1 in accordance with one embodiment of the present invention, the vane 400 deflects washing water sprayed by the fixed nozzles 330 and 340 toward dishes. Since the fixed nozzles 330 and 340 spray the washing water in an approximate horizontal direction, the fixed nozzles 330 and 340 and the vane 400 are approximately positioned horizontally. Accordingly, the vane cannot move in an area in which the fixed nozzles 330 and 340 are disposed.

That is, the dish washing machine 1 has a vane movement section I1 in which the vane 400 can move and a vane non-movement section 12 in which the vane 400 cannot move.

The vane 400 of the dish washing machine 1 in accordance with one embodiment of the present invention may be pivotably provided to wash dishes accommodated in the vane non-movement section 12.

As described above, the rotation guide 610 which protrudes to guide the movement of the vane 400 is formed at the bottom plate cover 600, and the rotation held portion 409 is formed at the vane 400 to be interrupted by the rotation guide 610. The rotation held portion 409 forms a rotating shaft of the vane 400 and simultaneously is formed above the coupling protrusion portion 493 of the vane holder 490 which transfers driving force to the vane 400.

The rotation guide 610 includes a guide surface 611 formed curved to allow the rotation held portion 409 to be in contact and allow the vane 400 to smoothly rotate.

When the rotation held portion 409 of the vane 400 is interrupted by the guide surface 611 of the rotation guide 610 of the bottom plate cover 600 as the vane 400 arrives at the vane non-movement section 12 from the vane movement section I1, the vane 400 rotates around the coupling protrusion portion 493 of the vane holder 490. Accordingly, it is possible to deflect the washing water toward dishes in the non-movement section 12.

Figure 14:
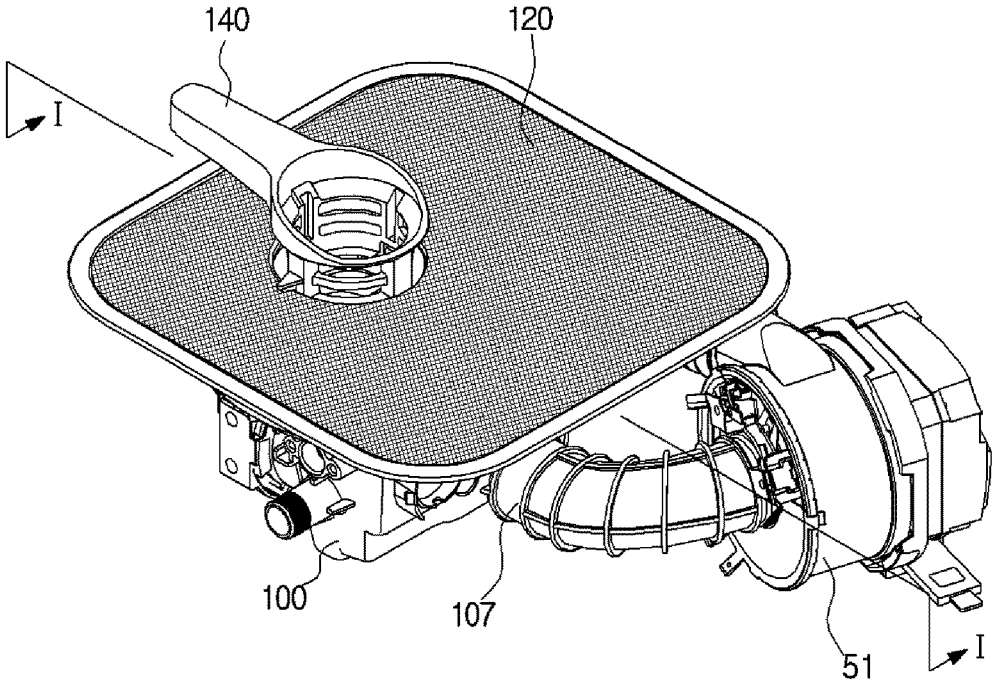
FIG. 14 is a view illustrating a sump, a coarse filter, and a fine filter of the dish washing machine in accordance with one embodiment of the present invention.
Figure 15:
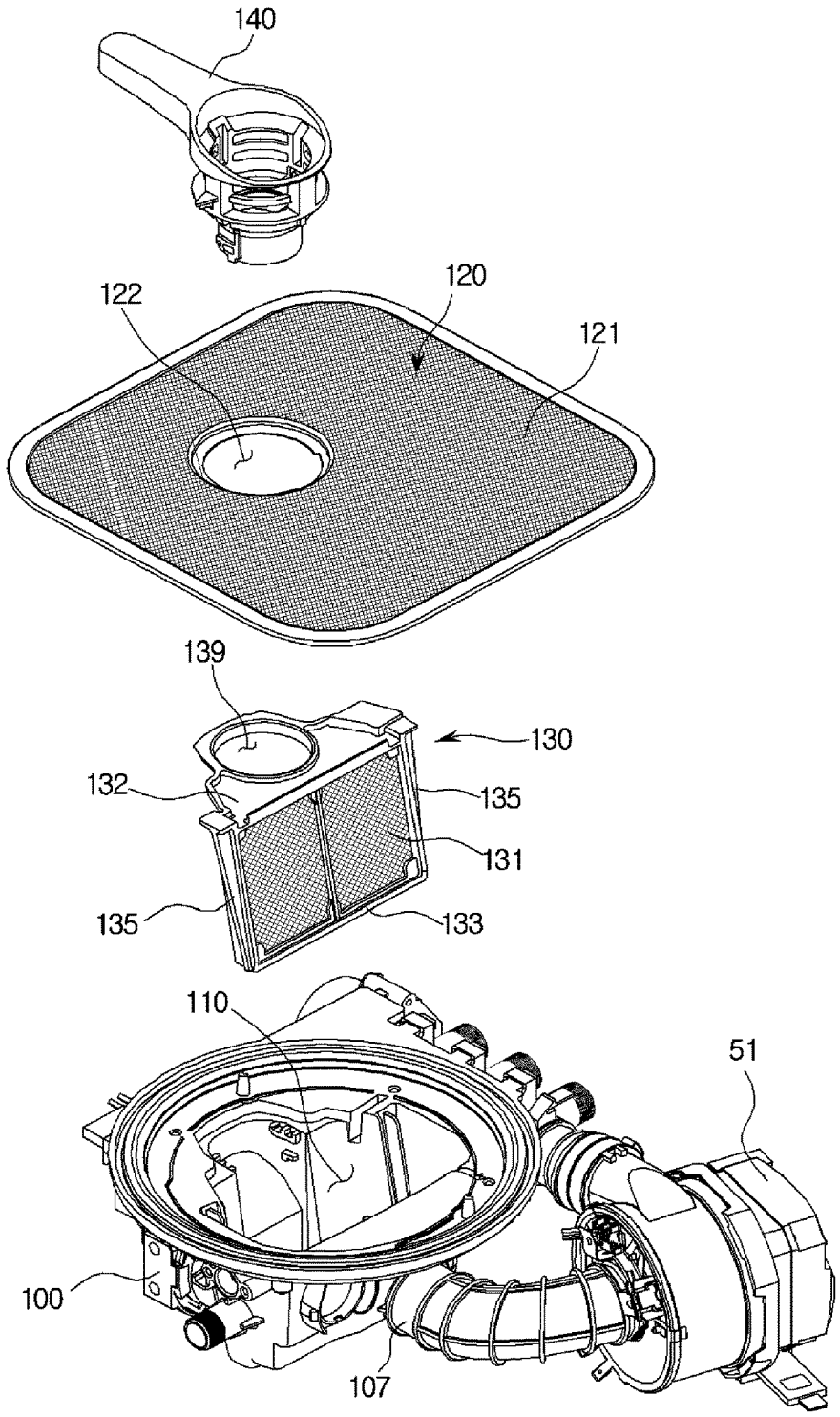
FIG. 15 is an exploded view illustrating the sump, the coarse filter, the fine filter, and a micro filter of the dish washing machine in accordance with one embodiment of the present invention.
Figure 16:
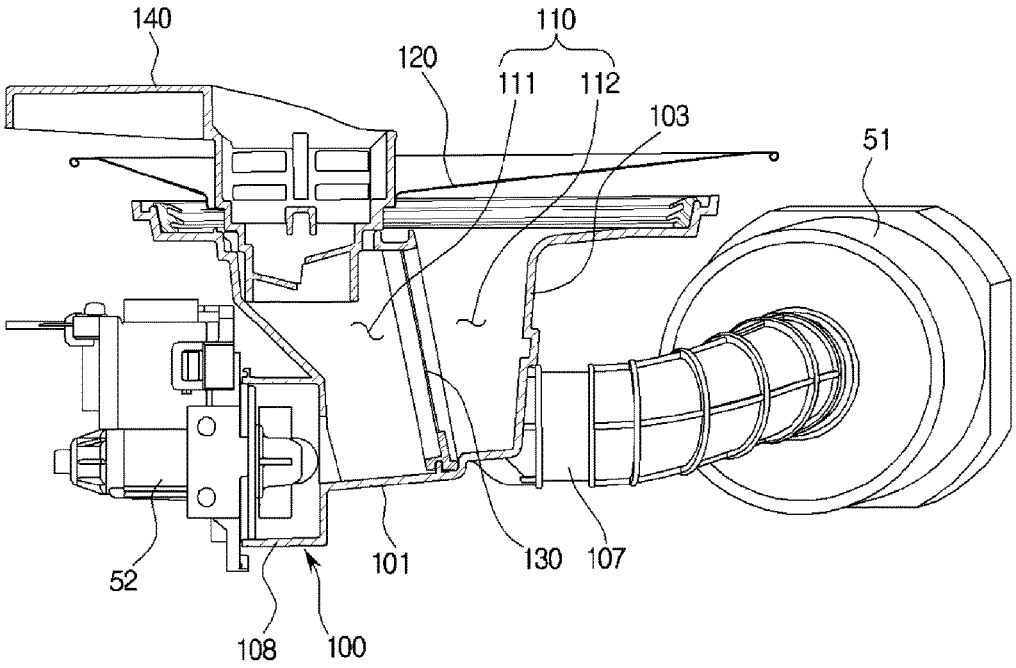
FIG. 16 is a cross-sectional view illustrating a section along line I-I of FIG. 14.
Figure 17:
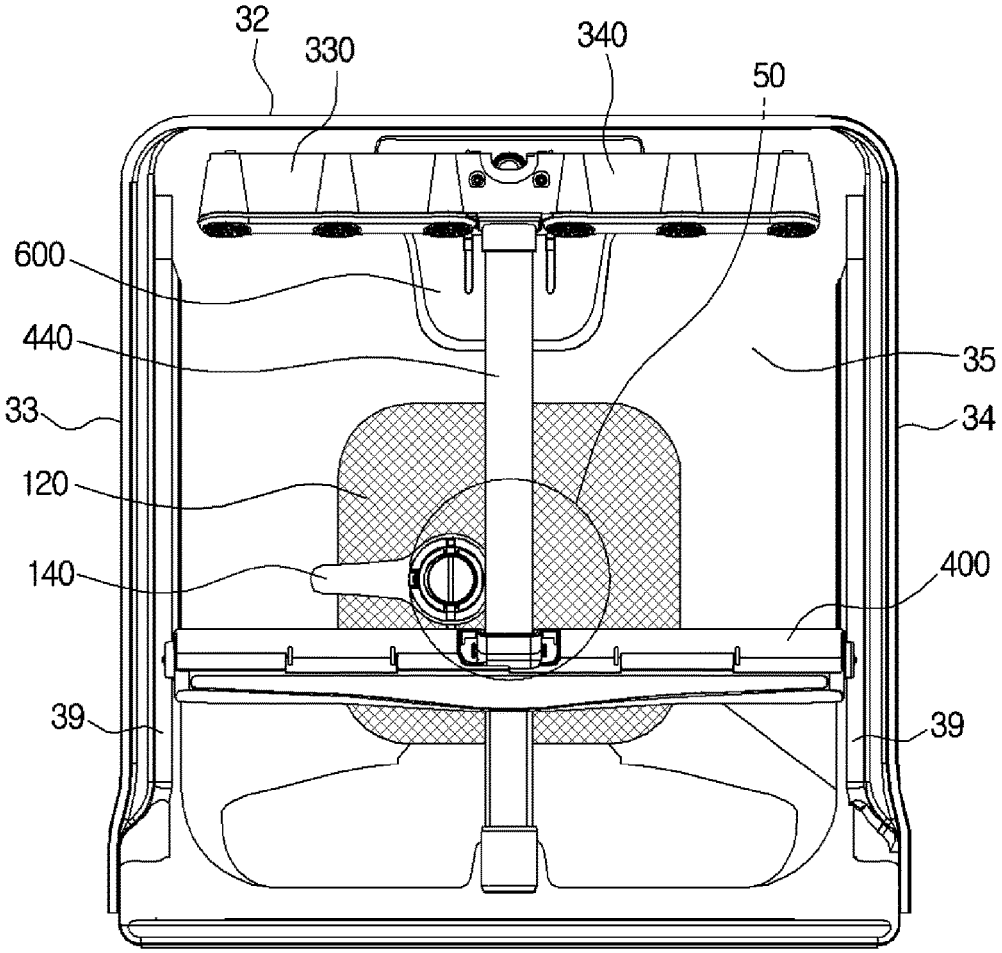
FIG. 17 is a plane view illustrating the bottom of the washing tub of the dish washing machine in accordance with one embodiment of the present invention.

FIG. 14 is a view illustrating the sump, a coarse filter, and a fine filter of the dish washing machine in accordance with one embodiment of the present invention. FIG. 15 is an exploded view illustrating the sump, the coarse filter, the fine filter, and a micro filter of the dish washing machine in accordance with one embodiment of the present invention. FIG. 16 is a cross-sectional view illustrating a section along line I-I of FIG. 14. FIG. 17 is a plane view illustrating the bottom of the washing tub of the dish washing machine in accordance with one embodiment of the present invention.

In FIGS. 14 to 16, the dish washing machine 1 in accordance with one embodiment of the present invention includes the sump 100 which stores washing water, the circulation pump 51 which circulates the washing water of the sump 100 throughout the spray nozzles 311, 313, 330, and 340, the drainage pump 52 which discharges the washing water in the sump 100 and garbage to outside of the body 10, and filters 120, 130, and 140 for filtering the garbage in the washing water.

A drainage hole 50 (refer to FIG. 17) for discharging the washing water into the sump 100 may be formed in the bottom plate 35 of the washing tub 30, and the bottom plate 35 of the washing tub 30 may have an incline toward the drainage hole 50 that allows the washing water to be guided toward the drainage hole 50 due to own weight thereof.

The sump 100 may have an approximately hemispherical shape with an open top side. The sump 100 may include a bottom portion 101, a sidewall portion 103, a water storage chamber 110 formed in the bottom portion 101 and the sidewall portion 103 to store the washing water, a circulation port 107 to which the circulation pump 51 is connected, and a drainage port 108 to which the drainage pump 52 is connected.

The filters 120, 130, and 140 may include a fine filter 120 mounted in the drainage hole 50, a coarse filter 140, and a micro filter 130 mounted in the sump 100.

The coarse filter 140 may have an approximately cylindrical shape.

Also, the coarse filter 140 may be mounted on an inner surface of the sidewall portion 103 of the sump 100 to filter relatively large sized pieces of garbage.

Also, the coarse filter 140 passes through the through hole 139 of the micro filter 130 and a through hole 122 of the fine filter 120 and is mounted in the sump 100. A top of the coarse filter 140 protrudes into the washing tub 30, and a bottom thereof protrudes into a garbage collection chamber 111 of the sump 100. The garbage collection chamber 111 will be described below.

The fine filter 120 may include a filter portion 121 which filters relatively mid-sized pieces of garbage and the through hole 122 through which the coarse filter 140 passes. The fine filter 120 may be approximately horizontally mounted above the drainage hole 50 of the bottom plate 35 of the washing tub 30. The fine filter 120 may have an incline that causes the washing water to be guided toward the through hole 122 due to the own weight thereof.

The washing water of the washing tub 30 may flow toward the coarse filter 140 along the incline of the fine filter 120. However, a part of the washing water and garbage may pass through the filter portion 121 of the fine filter 120 and may directly flow to the water storage chamber 110 of the sump 100.

The micro filter 130 may filter relatively small-sized pieces of garbage and may include a filter portion 131 having a flat shape, frames 132, 133, and 135 which support the filter portion 131, and the through hole 139 through which the coarse filter 140 passes.

The frames 132, 133, and 135 include a top frame 132, a bottom frame 133, and side frames 135. The micro filter 130 is mounted in the sump 100 to allow the bottom frame 133 to be in contact with the bottom portion 101 of the sump 100 and the side frames 135 to be in contact with the sidewall portion 103 of the sump 100.

The micro filter 130 may divide the water storage chamber 110 of the sump 100 into the garbage collection chamber 111 and a circulation chamber 112. The drainage pump 52 is connected to the garbage collection chamber 111, and the circulation pump 51 is connected to the circulation chamber 112.

As described above, since the coarse filter 140 is provided to allow the bottom thereof to protrude toward the garbage collection chamber 111, the washing water and the garbage included therein which pass through the coarse filter 140 flow into the garbage collection chamber 111.

The washing water which flows into the garbage collection chamber 111 may pass through the micro filter 130 and may flow into the circulation chamber 112. However, since the garbage included in the washing water which flows into the garbage collection chamber 111 cannot pass through the micro filter 130, the garbage included in the washing water cannot flow into the circulation chamber 112 and remains in the garbage collection chamber 111.

The garbage collected in the garbage collection chamber 111 may be discharged with the washing water from the body 10 when the drainage pump 52 is driven.

Meanwhile, it is necessary for the micro filter 130 to be in contact with the bottom portion 101 and the sidewall portion 103 of the sump 100 to prevent the garbage of the garbage collection chamber 111 from flowing into the circulation chamber 112 through a gap between the micro filter 130 and the sump 100.

For this, a bottom sealing groove 134 may be formed at the bottom frame 133 of the micro filter 130, and a side sealing protrusion 136 may be formed at the side frame 135. Corresponding thereto, a bottom sealing protrusion 102 inserted in the bottom sealing groove 134 may be formed at the bottom portion 101 of the sump 100, and a side sealing groove 104 in which the side sealing protrusion 136 is inserted may be formed at the sidewall portion 103 of the sump 100.

By the structure including the bottom and side protrusions and grooves described above, sealing between the micro filter 130 and the sump 100 may be strengthened.

Meanwhile, the coarse filter 140 may be perpendicularly inserted downward into the sump 100 and then rotated from a clearing position to a fastening position to be mounted in the sump 100.

In FIG. 17, the coarse filter 140 may be disposed inclined toward one sidewall of the both sidewalls 33 and 34 of the washing tub 30. That is, the coarse filter 140 may be disposed adjacent to the left wall 33 rather than the right wall 34. By the disposition of the coarse filter 140 described above, the coarse filter 140 may be easily separated without being interrupted by the rail 440.

Next, a control method for removing garbage which remains at the bottom of the washing tub 30 and more particularly, at the fine filter 120, in the dish washing machine 1 in accordance with one embodiment of the present invention will be described with reference to FIG. 20.

Figure 18:
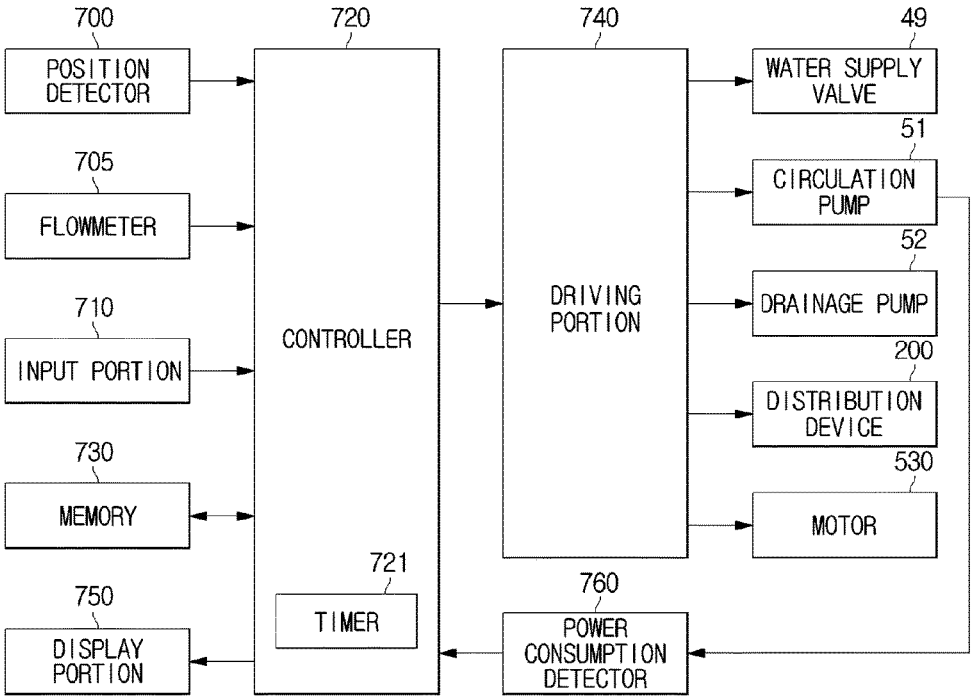
FIG. 18 is a control configuration diagram of the dish washing machine in accordance with one embodiment of the present invention.

FIG. 18 is a control configuration diagram of the dish washing machine in accordance with one embodiment of the present invention.

In FIG. 18, the dish washing machine 1 in accordance with one embodiment of the present invention further includes a position detector 700, a flowmeter 705, an input portion 710, a controller 720, a memory 730, a driving portion 740, a display portion 750, and a power consumption detector 760.

The position detector 700 includes the permanent magnet 702 installed on the vane holder 490 and the position sensor 701 which detects the permanent magnet 702.

The flowmeter 705 senses a flow amount of washing water supplied to the washing tub 30 and sends the flow amount to the controller 720.

The permanent magnet 702 may be installed at the bottom surface or a top surface of the vane holder 490. That is, the permanent magnet 702 may be positioned anywhere on the vane holder 490 as long as capable of being moved together with the vane 400.

The position sensor 701 is installed corresponding to a position of the permanent magnet 702. However, unlike the permanent magnet 702, the position sensor 701 is installed at a position which does not move with the vane 400, that is, at the bottom plate cover 600.

As described above, the position sensor 701 may be installed at any position which allows a magnetic field of the permanent magnet 702 to be detected while the vane 400 is moving. In other words, the position sensor 701 may be positioned at any place on a movement path of the vane 400.

Also, a position of the vane 400 on the movement path of the vane 400 where the position sensor 701 detects the magnetic field of the permanent magnet 702 becomes a reference position.

Meanwhile, in one embodiment of the present invention, the position detector 700 has been described as including the permanent magnet 702 and the position sensor 701, but the present invention is not limited thereto.

For example, in addition to the permanent magnet 702 and the position sensor 701, the position detector 700 may include a protruding portion, a micro switch, a permanent magnet, a reed switch, an infrared sensor module, a capacitive proximity sensor, an ultrasonic sensor module, etc.

First, when the position detector 700 includes the protruding portion and the micro switch, the protruding portion may be installed on the bottom surface of the vane holder 490, and the micro switch may be installed on the bottom surface of the bottom plate cover 600. Also, when the protruding portion and the micro switch are positioned at the reference position of the vane 400 (where the vane 400 approaches the fixed nozzle to minimize a gap between the vane and the nozzle), the protruding portion pressurizes the micro switch to allow the position detector 700 to detect that the vane 400 may be positioned at the reference position.

As another example, when the position detector 700 includes the infrared sensor module, the infrared sensor module may be installed at the bottom plate cover 600. When the vane 400 is positioned at the reference position, an infrared light emitted by the infrared sensor module may be reflected by the vane 400 and the infrared sensor module may receive the reflected light. When the infrared sensor module receives the reflected light as described above, the position detector 700 may detect that the vane 400 is positioned at the reference position.

In addition, the position detector 700 may include the capacitive proximity sensor which senses a change in capacitance caused by the vane 400, the ultrasonic sensor module which emits ultrasonic waves and detects reflected waves reflected by the vane 400, etc.

As described above, in the dish washing machine 1 in accordance with one embodiment of the present invention, the permanent magnet 702 and the position sensor 701 are installed to define the reference position for movement stability for the vane 400. In detail, it is for allowing the dish washing machine 1 to detect a position of the vane 400 to move the vane 400 based on the detected position of the vane 400.

When the permanent magnet 702 and the position sensor 701 are not installed, since the dish washing machine 1 cannot detect a position of the vane 400, a command for moving the vane 400 cannot be transmitted to the motor 530. Also, when a reference point for moving the vane 400 is not defined, it is impossible to move the vane 400 to an accurate position.

As described above, since the reference position is defined using the permanent magnet 702 and the position sensor 701, the dish washing machine 1 may detect the position of the vane 400, the vane 400 may be allowed to move on a predetermined movement path, and the vane 400 may be positioned at a predetermined position.

In other words, the reference position may be the reference point of the movement of the vane 400. In detail, the dish washing machine 1 may calculate the position of the vane 400 by moving the vane 400 based on the reference position. For example, to position the vane 400 at a particular position, the dish washing machine 1 may move the vane 400 to a desired position by moving the vane 400 based on the reference position.

Due to the above description, when a washing operation or a drainage operation of the dish washing machine 1 starts or finishes, the dish washing machine 1 positions the vane 400 at the reference position. That is, the reference position may be a position where the vane 400 starts movement and a position where the vane 400 finishes movement.

Meanwhile, in one embodiment of the present invention, the vane 400 has been described as having the position detector 700 installed for detecting a reference position of the vane 400 as an example, but the present invention is not limited thereto. The vane 400 may be moved to the rearmost portion of the rail assembly 430 by driving the motor 530. While the motor 530 is driven, when a driving current supplied to the motor 530 being driven is detected and a level of the detected driving current is higher than a predetermined reference current, it may be determined that the vane 400 is positioned at the rearmost portion of the rail assembly 430 (reference position).

The input portion 710 inputs commands for performing the water supply operation, the washing operation, the drainage operation, and the drying operation of the dish washing machine 1 by a manipulation of a user.

Also, the input portion 710 is for inputting operation information such as a washing course, washing water temperature, additional rinsing, etc. selected by the user and may include various buttons arranged on a control panel.

The washing course includes a standard washing course which sequentially performs operations including a water supply operation for supplying washing water, a washing operation for washing dishes by spraying washing water to the dishes after supplying the washing water, a heating operation for heating the washing water at a temperature appropriate for washing and rinsing before spraying the washing water to the dishes, a drainage operation for discharging the washing water outside after washing, a drying operation after finishing washing for drying the dishes for which washing is finished after finishing washing and a manual course in which the user arbitrarily selects each operation to be performed that is appropriate for a situation.

Also, in addition to the buttons, the input portion 710 may include a jog dial to select a washing condition and may separately include a change button capable of adjusting an operation factor and washing time of the selected washing course.

Additionally, the input portion 710 may be formed of a key, a switch, a touch pad, etc. and may include all units which generate predetermined input data by a manipulation operation such as pushing, touching, pressing, rotating, etc.

The controller 720 is a microcomputer which controls overall operations of the dish washing machine 1 such as the water supply operation, the washing operation, the drainage operation, the drying operation, etc. according to the operation information input by the input portion 710 and controls the movement of the vane 400 according to an initial position of the vane 400 detected by the position detector 700.

Also, the controller 720 controls driving of the motor 530 to move the vane 400 to the initial position before the drainage operation.

Also, the controller 720 controls revolutions per minute (RPM) of the circulation pump 51 to remove garbage which remains at the bottom of the washing tub 30 and particularly at the fine filter 120 by strongly spraying washing water with the vane 400 moved to the initial position before the drainage operation.

Also, the controller 720 controls the circulation pump 51 to be driven for a reference time duration, about 3 seconds, for spraying the washing water to remove the garbage which remains at the bottom of the washing tub 30 by counting, at the timer 721 built therein, the driving time of the circulation pump 51 to remove the garbage which remains at the fine filter 120.

For this, the controller 720 stops the motor 530 when the vane 400 moves to approach the bottom plate cover 600 and reaches a position for minimizing a gap between the vane 400 and the nozzle assembly 300, that is, the reference position and allows the washing water deflected by the vane 400 to strike the rear wall 32 of the washing tub 30 by driving the circulation pump 51 at a certain speed (about 2600 RPM) for the reference time duration, about less than 3 seconds.

The washing water which strikes the rear wall 32 of the washing tub 30 forms a fast and strong water current along the bottom plate 35 of the washing tub 30. The fast and strong water current may flow to the fine filter 120 mounted on the bottom of the washing tub 30 and remove the garbage which remains at the fine filter 120.

Also, the controller 720 detects a blockage of the filters 120, 130, and 140 using a variation in power consumption during the driving of the circulation pump 51 and performs a filter blockage clearing algorithm which clears the blockage of the filters 120, 130, and 140 regardless of the washing operation when a blockage of the filters 120, 130, and 140 is detected.

When a blockage of the filters 120, 130, and 140 is detected, the filter blockage clearing algorithm removes the garbage which blocks the filters 120, 130, and 140 using a small amount of water, about 700 to 900 cc, regardless of the washing operation, that is, preliminary washing, main washing, etc.

The circulation pump 51 is driven at a third rotation speed (about 1200 to 1400 RPM) after the small amount of water, about 700 to 900 cc, is supplied to allow the washing water to strongly flow along the bottom plate 35 of the washing tub 30 and to clear the blockage of the filters 120, 130, and 140 using the water current which flows along the bottom plate 35. This will be described in detail with reference to FIGS. 21A to 27B.

700 to 900 cc is a small amount of washing water capable of filling the inside of the sump 100, which is less than ¼ of an amount of water supplied during a normal operation. This is because when the filters 120, 130, and 140 are blocked and the washing water is supplied more than a capacitive amount of the sump 100, since washing water sprayed by the nozzles 330 and 340 does not directly strike the filters 120, 130, and 140 but strikes a water surface, it is difficult to remove garbage which blocks the filters 120, 130, and 140. Accordingly, an amount of water supplied to clear the blockage of the filters 120, 130, and 140 is adjusted to be an amount capable of filling the sump 100.

Also, the third rotation speed (about 1200 to 1400 RPM) is a speed for allowing the washing water sprayed by the nozzles 330 and 340 to face the filters 120, 130, and 140 positioned in the center of the bottom surface of the washing tub 30, which is a less than a half of the rotation speed (about 2600 RPM or more) for allowing the washing water sprayed by the nozzles 330 and 340 to move to an end of the door 11 during the normal operation. When the circulation pump 51 is driven at a first rotation speed (about 2600 RPM) or more in a state the filters 120, 130, and 140 are blocked, since the washing water sprayed by the nozzles 330 and 340 does not directly strike the filters 120 and 140 but strikes the door 11, it is difficult to remove the garbage which blocks the filters 120, 130, and 140.

The memory 730 may store control data for controlling the operation of the dish washing machine 1, reference data used during controlling of the operation of the dish washing machine 1, operation data generated while the dish washing machine 1 performs a certain operation, setting information such as setting data input by the input portion 710 to allow the dish washing machine 1 to perform the certain operation, the number of performing a particular operation by the dish washing machine 1, use information including model information of the dish washing machine 1, and failure information which includes a cause of a malfunction or a malfunction position when the dish washing machine 1 malfunctions.

The memory 730 may include not only a nonvolatile memory (not shown) such as a magnetic disk which permanently stores data, a solid state disk, etc. but also a volatile memory (not shown) which temporarily stores temporary data generated during a process of controlling the operation of the dish washing machine 1 such as a dynamic random access memory (D-RAM), a static random access memory (S-RAM), etc.

The driving portion 740 drives a water supply valve 49, the circulation pump 51, the distribution device 200, the motor 530, etc. related to the operation of the dish washing machine 1 according to a driving control signal of the controller 720.

The water supply valve 49 controls supplying of water (washing water) supplied into the washing tub 30 through the water supply pipe during the water supply operation.

The display portion 750 displays an operation state of the dish washing machine 1 according to a display control signal and additionally displays a manipulation state of the user by recognizing touch information input through a user interface.

Also, in the case of a liquid crystal display (LCD) user interface (UI) capable of displaying a text, the display portion 750 may be configured to display the operation state of the dish washing machine 1 using a text to allow the user to take an appropriate measure.

Also, in the case of a light emitting diode (LED) UI, the display portion 750 may be configured to allow the user to recognize an abnormal state of the dish washing machine 1 by using lighting-up, flickering, and a difference in duration.

The power consumption detector 760 detects a variation in power consumption of the circulation pump 51 during driving of the circulation pump 51 and detects a blockage of the fine filter 120 by sending the detected variation in power consumption to the controller 720.

When an amount of garbage larger than an amount for allowing the fine filter 120 to filter to perform washing is separated from dishes, a phenomenon in which the fine filter 120 is temporarily blocked occurs. Particularly, when large-sized pieces of garbage such as spaghetti, spinach, leftover grains, etc. are collected at the fine filter 120, a temporary blockage of the fine filter 120 may occur. The blockage phenomenon of the fine filter 120 described above generally occurs in a washing operation of preliminary washing or main washing and occurs at the preliminary washing operation at a higher rate.

When the fine filter 120 is blocked, an amount of circulating washing water circulated by the driving of the circulation pump 51 decreases, thereby reducing power consumption of the circulation pump 51. The power consumption detector 760 may be used as a means which detects the blockage of the fine filter 120 by detecting the variation of power consumption of the circulation pump 51.

Hereinafter, the dish washing machine in accordance with one embodiment of the present invention and an operation process and an operation effect of a method controlling the same will be described.

First, a method of removing garbage which remains at the bottom of the washing tub 30 and, particularly, the fine filter 120 by spraying washing water with the vane 400 positioned at a reference position before a drainage operation of the dish washing machine 1 will be described with reference to FIG. 19.

Figure 19:
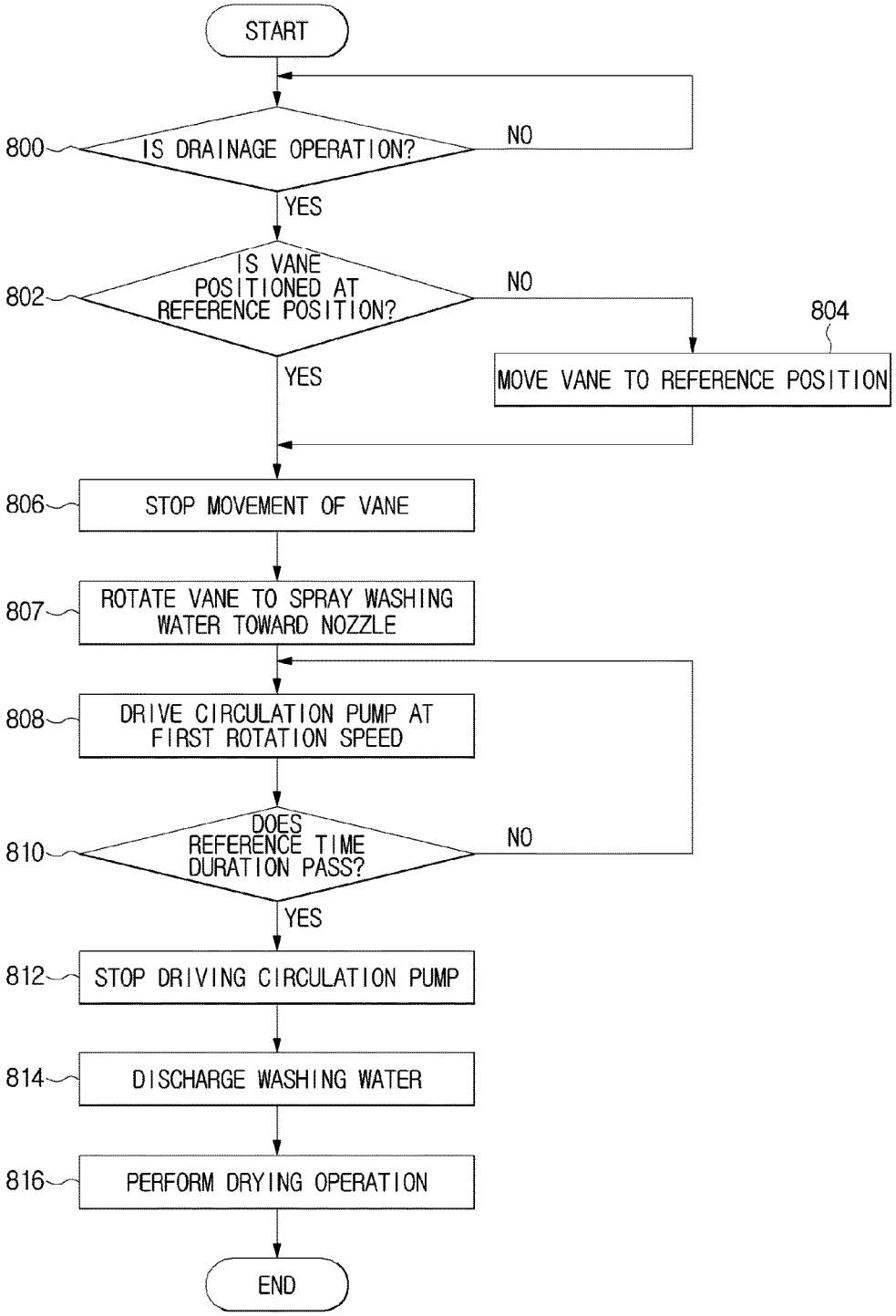
FIG. 19 is a flowchart illustrating operations of a first control algorithm for washing the filters of the dish washing machine in accordance with one embodiment of the present invention.

FIG. 19 is a flowchart illustrating operations of a first control algorithm for washing the filters of the dish washing machine in accordance with one embodiment of the present invention.

In FIG. 19, when a user puts dishes to be washed into the baskets 12*a* and 12*b* in the washing tub 30 and selects a washing course, for example, a standard course, information on the course selected by the user is input to the controller 720 through the input portion 710.

Accordingly, the controller 720 sequentially performs a series of operations including preliminary washing, main washing, preliminary rinsing, and final rinsing, etc. of the dish washing machine 1 according to the course information input by the input portion 710. Here, the controller 720 may allow the user to easily check a washing performing time by displaying a total washing time for performing each of the operations through the display portion 750.

Next, the controller 720 determines whether an operation currently being performed according to the progress of the series of operations is a drainage operation (800).

As a result of the determination in operation 800, when determined to be the drainage operation, the controller 720 determines whether the vane 400 is positioned at a reference position (802). The determination of whether the vane 400 is positioned at the reference position is determining whether the vane 400 is positioned at a second position adjacent to the rearmost portion of the rail assembly 430, that is, the fixed nozzles 330 and 340. That is, when the vane 400 moves to be adjacent to the fixed nozzles 330 and 340, the permanent magnet 702 installed on the bottom surface of the vane holder 490 is moved with the movement of the vane 400, and the position sensor 701 installed on the bottom surface of the bottom plate cover 600 detects a magnetic field generated by the permanent magnet 702 to detect that the vane 400 is positioned at the reference position (a second position adjacent to the fixed nozzles).

A reason for moving the vane 400 to the reference position (the second position) is to minimize gaps between the vane 400 and the fixed nozzles 330 and 340 by allowing the vane 400 to move to be adjacent to the fixed nozzles 330 and 340.

When the vane 400 is positioned at the reference position as determined in operation 802, the controller 720 moves the vane 400 to the reference position by driving the motor 530 using the driving portion 740 (804).

When the vane 400 arrives at the reference position, the controller 720 stops the driving of the motor 530 to stop the movement of the vane 400 (806).

Meanwhile, as the result of the determination in operation 802, when the vane 400 is positioned at the reference position, the controller 720 proceeds with operation 806 and stops the movement of the vane 400.

As described above, when the vane 400 is positioned at the reference position, the rotation held portion 409 of the vane 400 is interrupted by the guide surface 611 of the rotation guide 610 of the bottom plate cover 600, and the vane 400 rotates around the coupling protrusion portion 493 of the vane holder 490.

Accordingly, as shown in FIG. 13, a deflection angle of the vane 400 is bent backward and the vane 400 is allowed to rotate toward the fixed nozzles 330 and 340 to allow a spray direction of washing water sprayed by the fixed nozzles 330 and 340 to face the rear wall 32 of the washing tub 30.

In this state, the controller 720 drives the circulation pump 51 at the first rotation speed (about 2600 RPM) to allow the washing water to be strongly sprayed toward the rear wall 32 of the washing tub 30 (808).

Accordingly, the washing water strongly sprayed toward the rear wall 32 of the washing tub 30 forms a fast and strong water current along the bottom plate 35 of the washing tub 30. The fast and strong water current flows along the bottom of the washing tub 30 and may move the garbage which remains at the fine filter 120 toward the coarse filter 140. The garbage which moves toward the coarse filter 140 may be collected at the garbage collection chamber 111 in the sump 100, and the garbage which remains at the bottom of the washing tub 30, particularly, the fine filter 120 may be removed.

Here, the controller 720 determines whether a reference time duration (a time duration less than about 3 seconds for spraying washing water to remove garbage which remains at the bottom of the washing tub) passes by counting driving time of the circulation pump 51 (810).

When the reference time duration has not passed as determined in operation 810, the controller 720 provides a feedback to the operation 808 and drives the circulation pump 51 at the first rotation speed (about 2600 RPM) until the reference time duration passes.

Meanwhile, when the reference time duration passes as determined in operation 810, the controller 720 stops spraying of the washing water by stopping driving of the circulation pump 51 using the driving portion 740 (812).

Next, the controller 720 discharges the garbage collected at the garbage collection chamber 111 and the washing water to outside of the body 10 by driving the drainage pump 52 using the driving portion 740 (814) and performs a drying operation for drying dishes (816).

Next, a method of removing garbage which remains at the bottom of the washing tub 30 and particularly, the fine filter 120 by spraying washing water regardless of a position of the vane 400 before a drainage operation of the dish washing machine 1 will be described with reference to FIG. 20.

Figure 20:
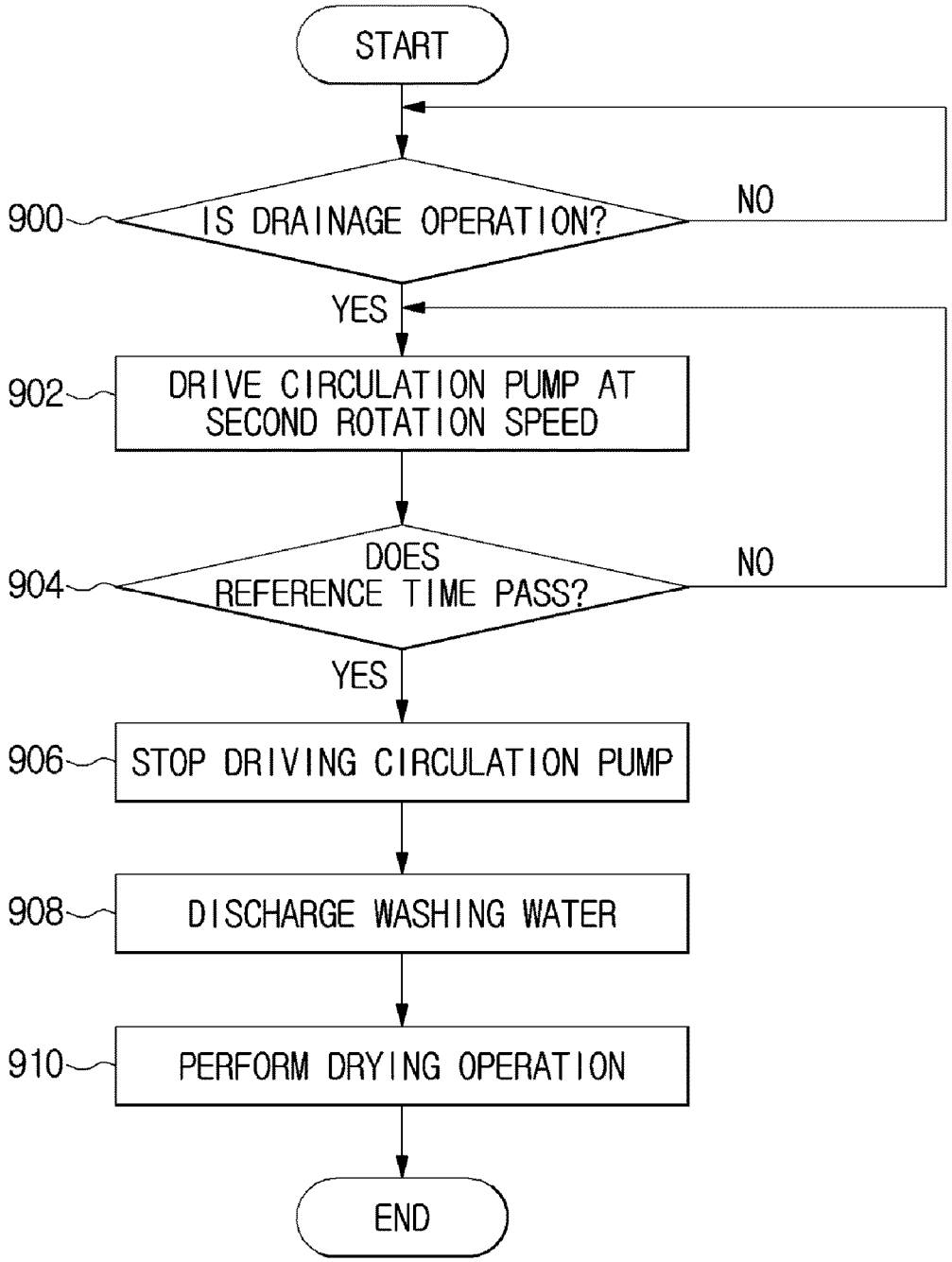
FIG. 20 is a flowchart illustrating operations of a second control algorithm for washing the filters of the dish washing machine in accordance with one embodiment of the present invention.

FIG. 20 is a flowchart illustrating operations of a second control algorithm for washing the filters of the dish washing machine in accordance with one embodiment of the present invention.

In FIG. 20, when a user puts dishes to be washed into the baskets 12*a* and 12*b* in the washing tub 30 and selects a washing course, for example, a standard course, information on the course selected by the user is input to the controller 720 through the input portion 710.

Accordingly, the controller 720 sequentially performs a series of operations including preliminary washing, main washing, preliminary rinsing, and final rinsing, etc. of the dish washing machine 1 according to the course information input by the input portion 710. Here, the controller 720 may allow the user to easily check a washing performing time by displaying a total washing time for performing the respective operations through the display portion 750.

Next, the controller 720 determines whether an operation currently being performed according to a progress of the series of operations is a drainage operation (900).

When it is the drainage operation as determined by operation 900, the controller 720 allows the washing water to be sprayed weakly toward the bottom plate 35 of the washing tub 30 by driving the circulation pump 51 at a second rotation speed (about 1200 RPM) (902). At the second rotation speed, the circulation pump 51 is driven at a speed of about ½ of the first rotation speed. Here, the driving of the circulation pump 51 at the second rotation speed (about 1200 RPM) that is lower than the first rotation speed (about 2600 RPM) prevents washing water sprayed by the nozzles 330 and 340 from reaching the door 11 and causes spraying to the center of the bottom plate 35 of the washing tub 30 at which the filters 120, 130, and 140 are positioned so that washing water flows along the bottom plate 35 to move garbage remaining at the fine filter 120 toward the coarse filter 140. The garbage which moves toward the coarse filter 140 may be collected at the garbage collection chamber 111 in the sump 100, and the garbage which remains at the bottom of the washing tub 30 and, particularly, the fine filter 120 may be removed.

Here, the controller 720 determines whether a reference time duration (a time duration less than about 3 seconds for spraying washing water to remove garbage which remains at the bottom of the washing tub) passes by counting driving time duration of the circulation pump 51 (904).

When the reference time duration has not passed as determined in operation 904, the controller 720 provides a feedback to operation 902 and drives the circulation pump 51 at the second rotation speed (about 1200 RPM) until the reference time duration passes.

Meanwhile, when the reference time duration has passed as determined in operation 904, the controller 720 stops spraying the washing water by stopping driving the circulation pump 51 using the driving portion 740 (906).

Next, the controller 720 discharges the garbage collected at the garbage collection chamber 111 and the washing water to outside of the body 10 by driving the drainage pump 52 using the driving portion 740 (908) and performs a drying operation for drying dishes (910).

In FIGS. 19 and 20, the method of removing the garbage which remains at the fine filter 120 by allowing the fast and strong water current to flow along the bottom plate 35 of the washing tub 30 due to the rotation of the vane 400 or regardless of a position of the vane 400 during the drainage operation has been described. However, hereinafter, a method of removing an excessive amount of garbage which is accumulated at the fine filter 120 at a top end of the sump 100 during the washing operations such as preliminary washing, main washing, etc. and blocks the fine filter 120 will be described.

In the case of the washing operation of the dish washing machine 1 such as the preliminary washing, main washing, etc., the washing operation is performed by repeatedly performing a process of separating a large amount of garbage from dishes using sprayed washing water and collecting the garbage at the filters 120, 130, and 140 at the bottom of the dish washing machine 1.

Here, when an amount of garbage is separated from the dishes that is larger than an amount that the filters 120, 130, and 140 can filter for performing washing, a phenomenon occurs in which the fine filters 120, 130, and 140 are temporarily blocked.

Accordingly, since the washing water does not smoothly pass through the filters 120, 130, and 140, an amount of water stored in the sump 100 is reduced, and an amount of washing water circulated to wash the dishes is reduced, thereby preventing normal washing.

Hereinafter, in the present invention, a method of clearing a filter blockage resulting when a large amount of garbage is separated from the dishes and collected at the filters 120, 130, and 140 and normal washing is prevented due to the blockage phenomenon of the filters 120, 130, and 140 will be described with reference to FIGS. 21A to 24B.

Before describing the embodiment of the present invention, since the blockage of the filters 120, 130, and 140 may occur during a washing operation and a rinsing operation and may occur relatively more frequently during a washing operation of preliminary washing or main washing where garbage is separated from the dishes, a process of detecting the blockage of the filters 120, 130, and 140 during the washing operation of the preliminary washing or the main washing will be described as an example.

First, a method of stopping a washing operation which is being performed, performing a filter blockage clearing algorithm when the filter blockage is detected while the washing operation of the preliminary washing or the main washing is being performed, and performing the stopped washing operation again from the beginning when the filter blockage clearing algorithm is completed will be described with reference to FIGS. 21A, 21B, and 22A to 22K.

Figure 21A:
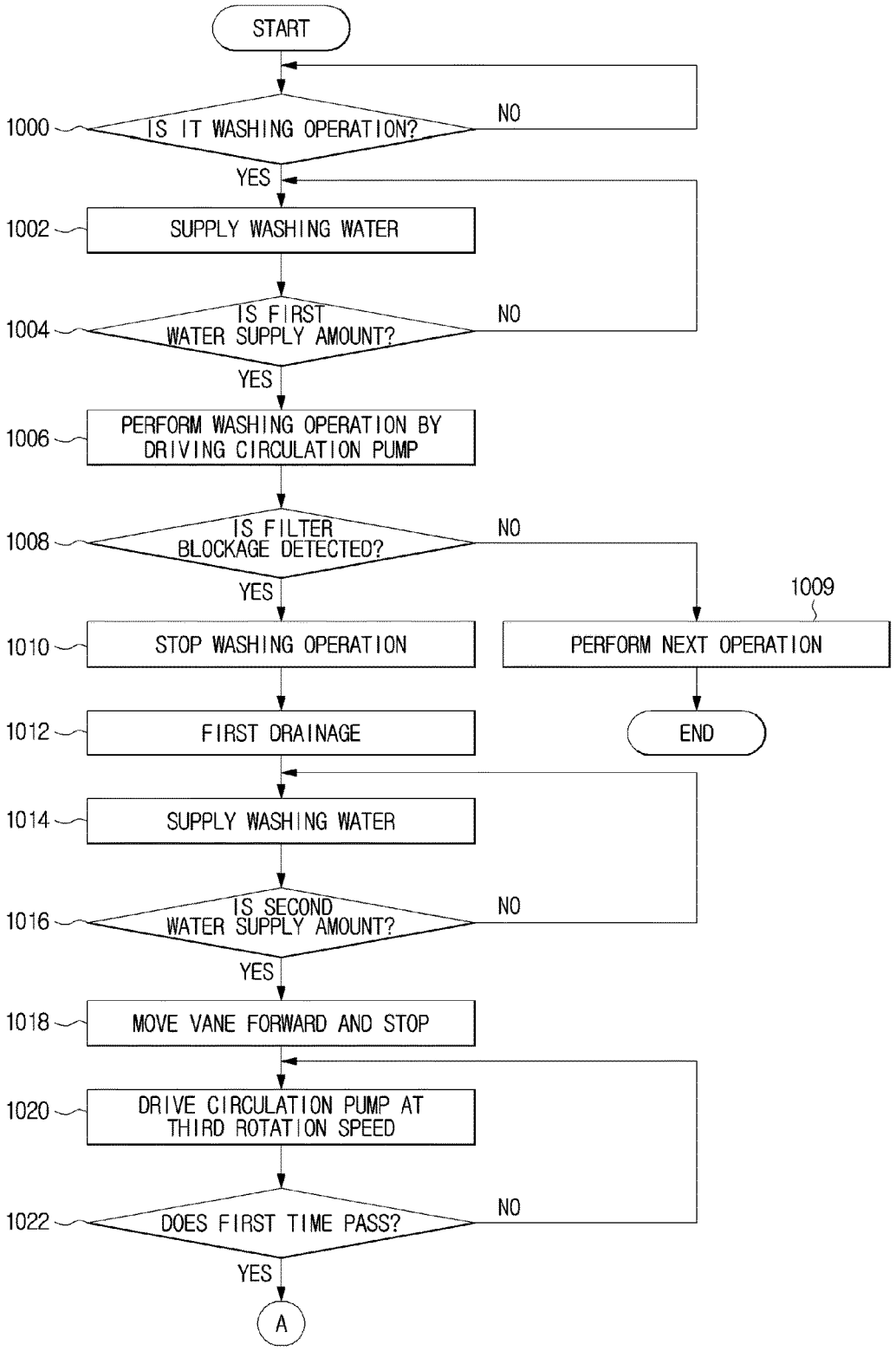
FIGS. 21A and 21B are flowcharts illustrating operations of a first control algorithm for clearing a filter blockage of the dish washing machine in accordance with another embodiment of the present invention.
Figure 21B:
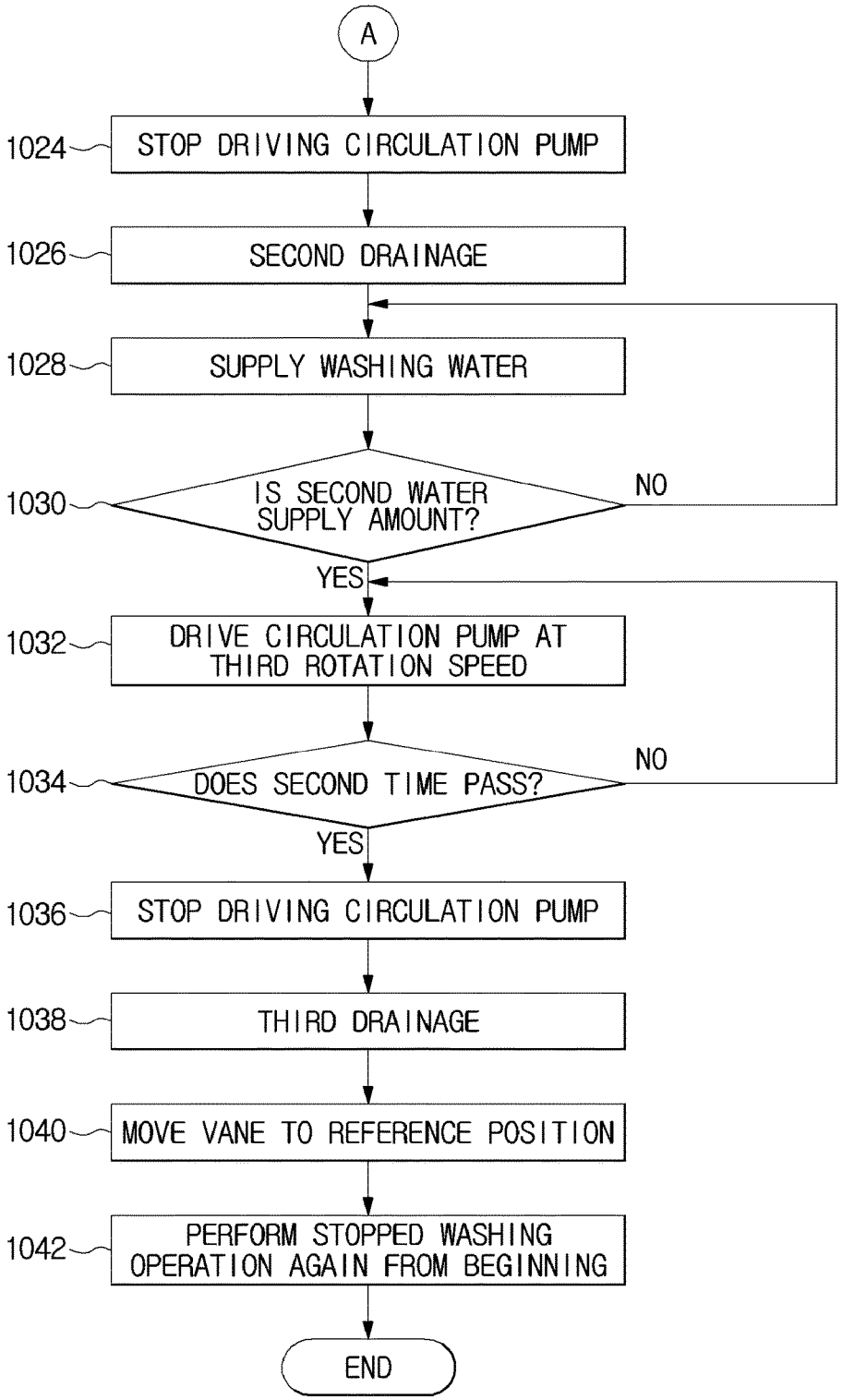

FIGS. 21A and 21B are flowcharts illustrating operations of a first control algorithm for clearing a filter blockage of a dish washing machine in accordance with another embodiment of the present invention. FIGS. 22A to 22K are views illustrating a process of clearing the filter blockage of the dish washing machine in accordance with another embodiment of the present invention.

In FIGS. 21A and 21B, when a user puts dishes to be washed into the baskets 12*a* and 12*b* in the washing tub 30 and selects a washing course, for example, a standard course, information on the course selected by the user is input to the controller 720 through the input portion 710.

Accordingly, the controller 720 sequentially performs a series of operations including preliminary washing, main washing, preliminary rinsing, and final rinsing, etc. of the dish washing machine 1 according to the course information input by the input portion 710. Here, the controller 720 may allow the user to easily check washing performing time by displaying total washing time for performing the respective operations through the display portion 750.

The controller 720 determines whether an operation which is being currently performed according to a progress of the series of operations is a washing operation of the preliminary washing or the main washing (1000).

As a result of the determination in operation 1000, when determined to be the washing operation, the controller 720 drives the water supply valve 49 using the driving portion 740 to supply water (washing water) necessary for the washing operation.

When the water supply valve 49 is driven, as the water supply valve 49 is opened, washing water supplied through an external water supply pipe is supplied to the washing tub 30, and the washing water supplied to the washing tub 30 is collected at the sump 100 provided at the bottom of the washing tub 30 (1002).

When the washing water for the washing operation is supplied, the flowmeter 705 detects a flow amount of the washing water being supplied to the washing tub 30 and determines whether it is a predetermined first water supply amount (a washing water amount necessary for the washing operation, about 3400 to 4000 cc) (1004).

As a result of the determination in operation 1004, when the flow amount of the washing water is not the first water supply amount, the controller 720 continues to supply the washing water until the flow amount of the washing water supplied to the washing tub 30 arrives at the first water supply amount.

Meanwhile, as a result of the determination in operation 1004, when the flow amount of the washing water is the first water supply amount, the controller 720 stops supplying the washing water by stopping driving the water supply valve 49.

When the supplying of the washing water to the first water supply amount is completed, the controller 720 pumps the washing water stored in the sump 100 by driving the circulation pump 51 at a set rotation speed (a rotation speed for obtaining pumping force necessary for the washing operation, about 3000 to 3400 RPM). The washing water pumped by the circulation pump 51 may be distributed to the rotating nozzles 311 and 313, the left fixed nozzle 330, and the right fixed nozzle 340 through the distribution device 200. The washing operation is performed by repeatedly performing a process in which the washing water is sprayed from the nozzles 311, 313, 330, and 340 at a high pressure due to the pumping force of the circulation pump 51 and garbage on dishes is separated from the dishes by the sprayed washing water and collected at the filters 120, 130, and 140 at the bottom of the dish washing machine 1 (1006).

Here, when an amount of garbage is separated from the dishes that is larger than an amount that the filters 120, 130, and 140 can filter for performing washing, a phenomenon occurs in which an excessive amount of garbage is accumulated at the filters 120, 130, and 140, and the filters 120, 130, and 140 are blocked. The blockage phenomenon of the filters 120, 130, and 140 described above generally may occur relatively more frequently during the preliminary washing.

When the filters 120, 130, and 140 are blocked, since the washing water does not smoothly pass through the filters 120, 130, and 140, an amount of washing water stored in the sump 100 is reduced and an amount of washing water circulated for washing the dishes according to driving of the circulation pump 51 decreases, thereby reducing power consumption of the circulation pump 51. During driving of the circulation pump 51, a variation in power consumption of the circulation pump 51 is detected by the power consumption detector 760, and the information thereof is sent to the controller 720.

Accordingly, the controller 720 detects a blockage of the filters 120, 130, and 140 using the variation in power consumption during the driving of the circulation pump 51 (1008).

As a result of the determination in operation 1008, when a blockage of the filters 120, 130, and 140 is not detected, the controller 720 continues to perform the next operation (1009).

Meanwhile, when the blockage of the filters 120, 130, and 140 is detected as the result of the determination in operation 1008, the controller 720 stops the washing operation by stopping driving the circulation pump 51 through the driving portion 740 (1010).

After the washing operation is stopped, the controller 720 performs the filter blockage clearing algorithm for clearing the blockage of the filters 120, 130, and 140.

For performing the filter blockage clearing algorithm, first, the controller 720 performs a first drainage operation of completely discharging garbage and washing water which remain in the sump 100 by driving the drainage pump 52 through the driving portion 740 (1012).

Figure 22A:
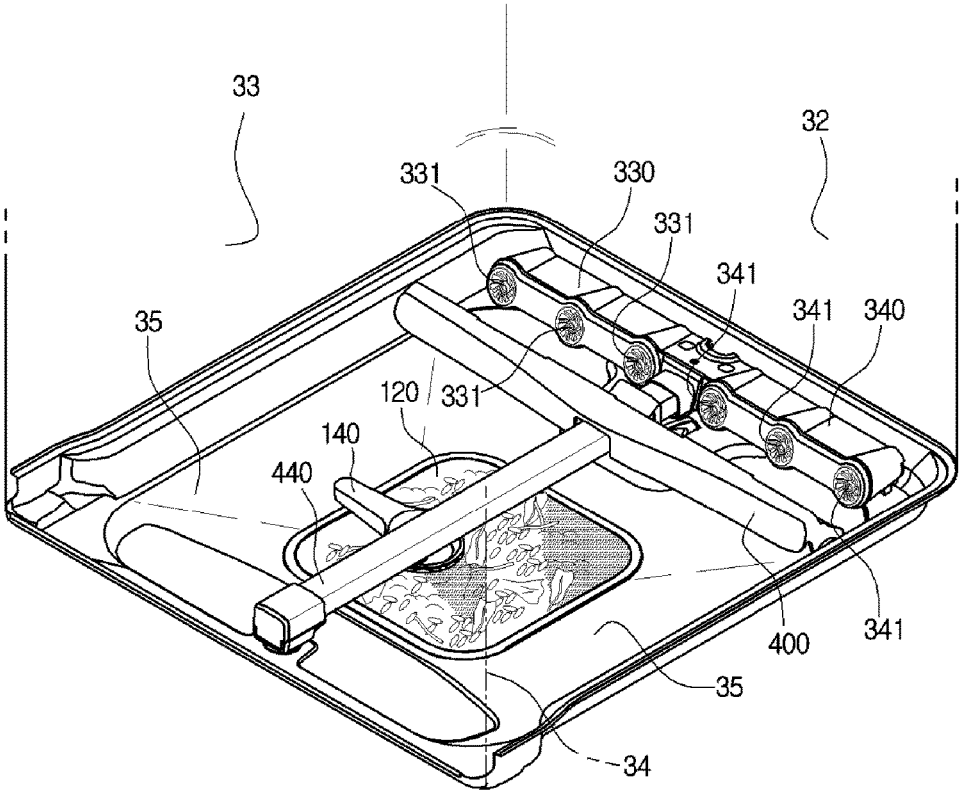
FIGS. 22A to 22K are views illustrating a process of clearing a filter blockage of the dish washing machine in accordance with another embodiment of the present invention.
Figure 22B:
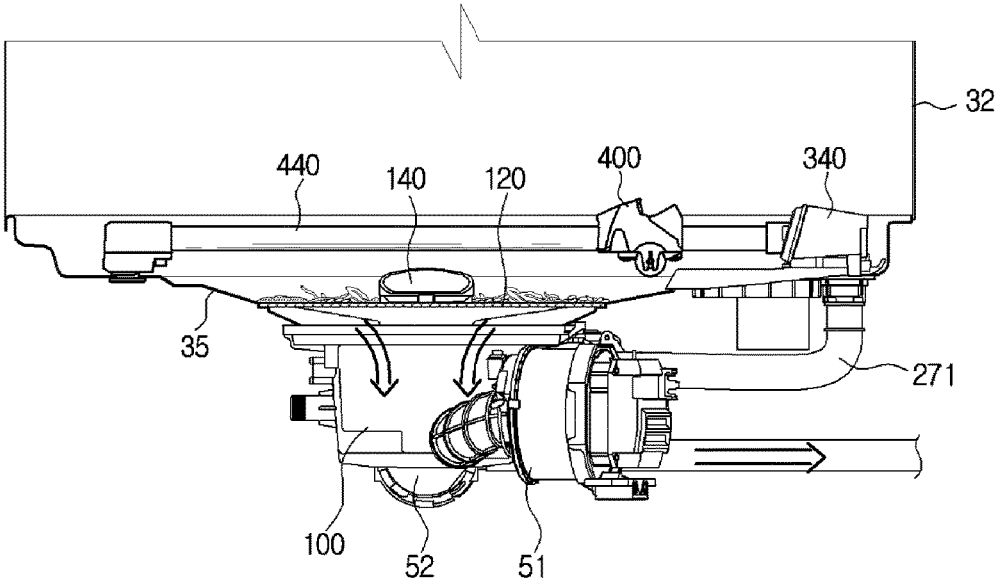

The first drainage operation may provide an effect of preliminarily clearing the blockage of the micro filter 130 through a drainage operation to discharge garbage collected at the garbage collection chamber 111 and the washing water to outside of the body 10 (refer to FIGS. 22A and 22B).

Figure 22C:
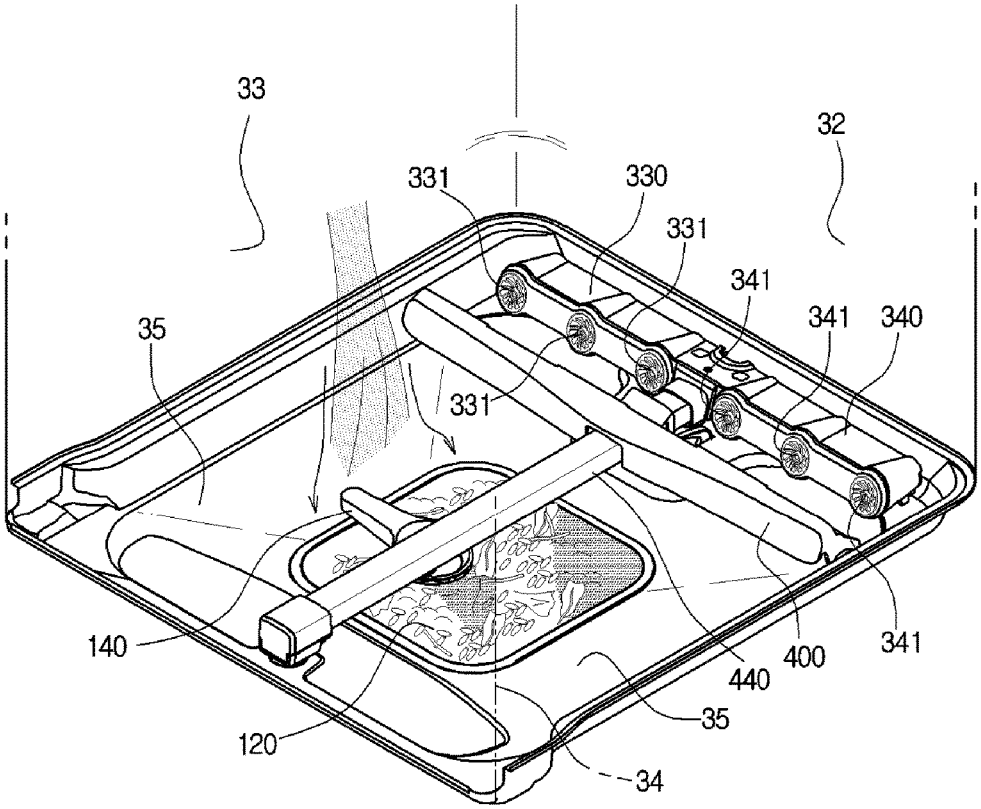

After first drainage, the controller 720 stops driving the drainage pump 52 using the driving portion 740 and supplies washing water capable of clearing the blockage of the filters 120, 130, and 140 to the washing tub 30 by driving the water supply valve 49 (1014, refer to FIG. 22C).

When the washing water is supplied to clear the blockage of the filters 120, 130, and 140, the garbage collected at the filters 120, 130, and 140 is washed little by little by the supplied washing water, and a flow amount of the washing water supplied to the washing tub 30 is detected by the flowmeter 705 to determine whether the flow amount is a predetermined second water supply rate (a small amount of washing water capable of filling the inside of the sump, about 700 to 900 cc) (1016).

As a result of the determination in operation 1016, when the flow amount of the washing water is not the second water supply amount, the controller 720 continues to supply the washing water until the flow amount of the washing water supplied to the washing tub 30 reaches the second water supply amount.

Meanwhile, as a result of the determination in operation 1016, when the flow amount of the washing water is the second water supply amount, the controller 720 stops supplying the washing water by stopping the water supply valve 49.

Figure 22D:
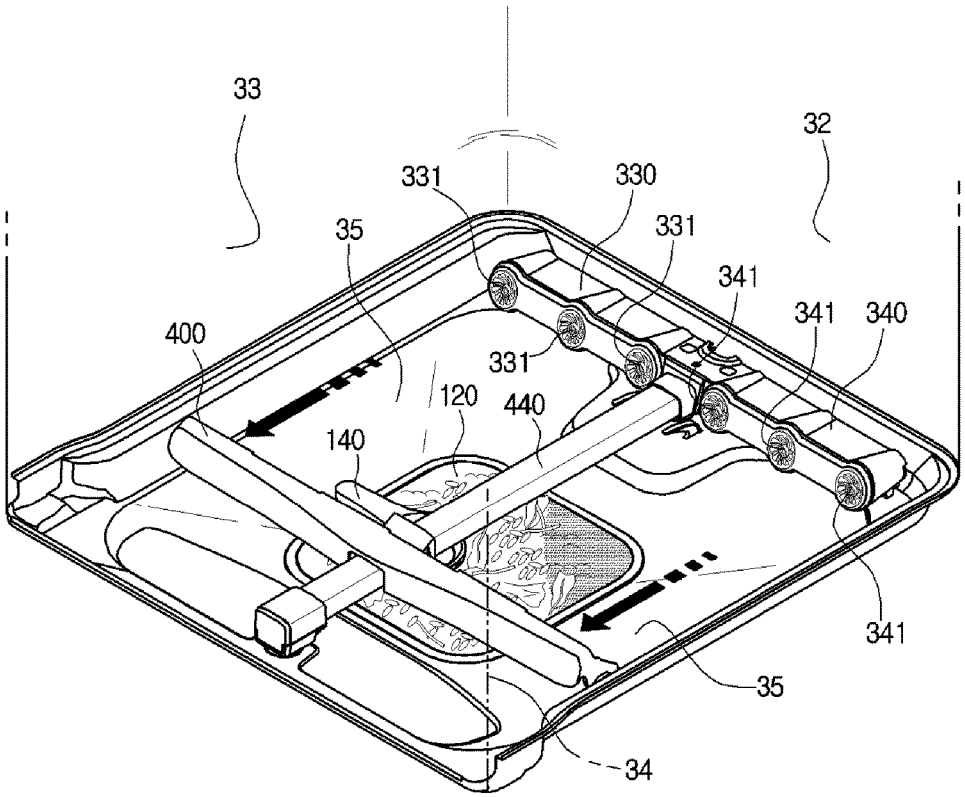

When supplying of the washing water up to the second water supply amount is completed, the controller 720 moves the vane 400 forward from a second position that is a reference position for a certain time duration (about 7 seconds) by driving the motor 530 and then stops the vane 400 (1018, refer to FIG. 22D).

A first position is a position of the vane 400 which is moved forward from the second position for the certain time duration (about 7 seconds), at which the vane 400 approaches the door 11 and gaps between the vane 400 and the fixed nozzles 330 and 340 are maximized.

A reason for moving the vane 400 forward is to allow the washing water to be sprayed toward the filters 120, 130, and 140 without colliding with the vane 400 and having the spray direction changed when the washing water is sprayed from the nozzles 330 and 340. That is, it is for spacing the vane 400 away from the nozzles 330 and 340 to effectively remove garbage on the filters 120, 130, and 140.

Figure 22E:
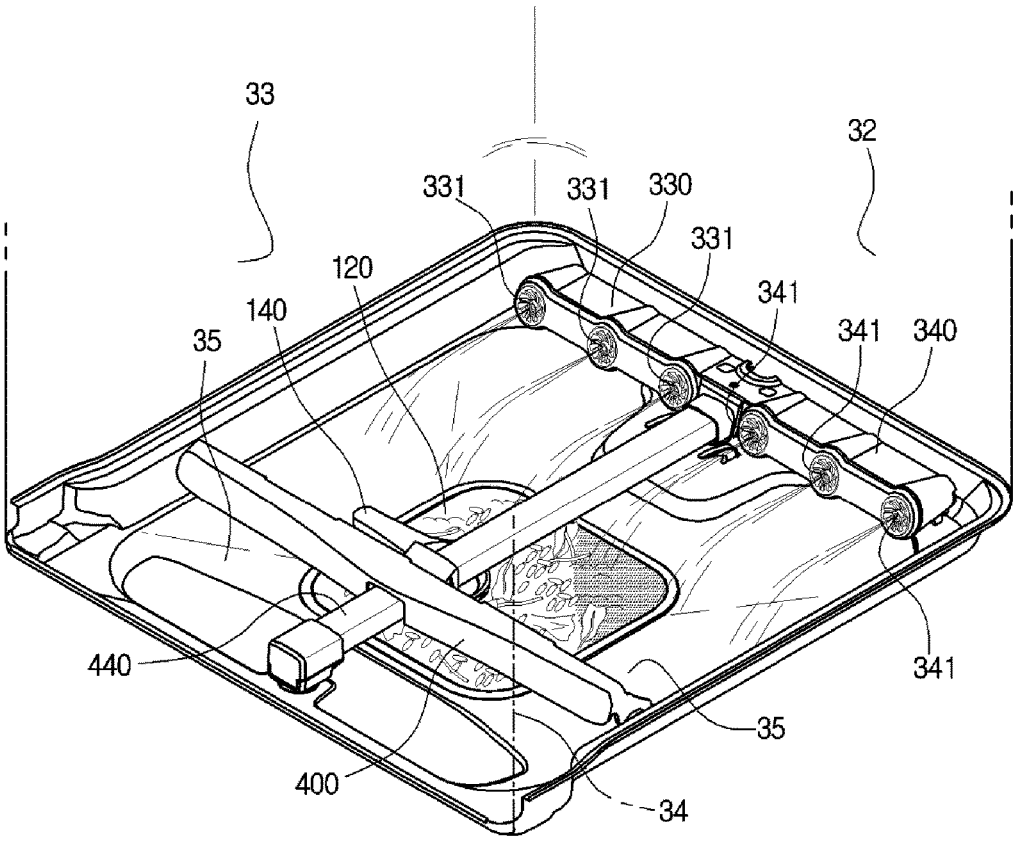
Figure 22F:
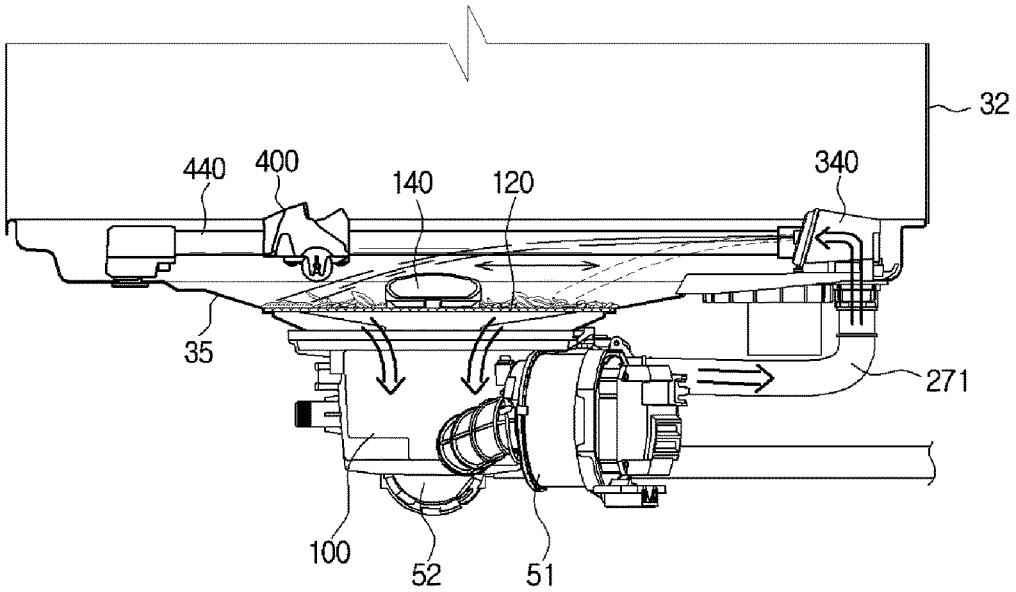

After the forward movement of the vane 400, the controller 720 allows the washing water sprayed from the nozzles 330 and 340 to be sprayed toward the filters 120, 130, and 140 at the top end of the sump 100 by driving the circulation pump 51 at a third rotation speed (about 1200 to 1400 RPM) (1020, refer to FIGS. 22E and 22F). Here, the washing water sprayed from the nozzles 330 and 340 washes the garbage on the filters 120, 130, and 140 while moving to the filters 120, 130, and 140 back and forth.

As shown in FIG. 22C, when the garbage is washed even a little by the supplied washing water, most of the washing water may be gradually collected at the sump 100. Accordingly, the washing water is sprayed far toward the filters 120, 130, and 140 at the beginning of the algorithm. As the garbage is scattered by the sprayed washing water, flow speed of the washing water collected at the sump 100 is reduced, and the washing water is sprayed weakly in front of the filters 120, 130, and 140. As the process described above is repeatedly performed, the washing water may be sprayed far from the front of the filters 120, 130, and 140. That is, as the blockage of the filters 120, 130, and 140 is cleared little by little, amount of the washing water collected at the sump 100 increases, and the intensity with which the washing water is sprayed changes, thereby effectively removing the garbage collected at the filters 120, 130, and 140.

Meanwhile, to allow the washing water sprayed by the nozzles 330 and 340 to be sprayed toward the filters 120, 130, and 140 at the top end of the sump 100, six spray holes 331 and 341 provided at the nozzles 330 and 340 are configured to spray the washing water at the same time, and a part of the spray holes 331 and 341 separately spray the washing water. When the washing water is separately sprayed, the washing water from the spray holes 331 and 341 adjacent to the filters 120, 130, and 140 among the six spray holes 331 and 341 are configured to spray. Also, the garbage scattered to edges by the washing water sprayed by the leftmost and rightmost spray holes among the six spray holes 331 and 341 is collected at the filters 120, 130, and 140.

Meanwhile, in the embodiment of the present invention, the method of spraying the washing water from the nozzles 330 and 340 to effectively spray the washing water at the top end of the filters 120, 130, and 140 has been described. However, the present invention is not limited thereto, and the same object and effect as those of the present invention may certainly be achieved using a method of effectively spraying washing water toward top ends of the filters 120, 130, and 140 by spraying the washing water using several nozzles on one side of the washing tub 30 or configuring an additional nozzle which sprays the washing water from two or more sides or a point where the two or more sides meet.

Here, the controller 720 determines whether a first time duration (a time duration for moving garbage accumulated on top ends of the filters to the garbage collecting chamber by spraying washing water, about 30 seconds) passes by counting driving time of the circulation pump 51 (1022).

When the first time duration does not pass as a result of the determination in operation 1022, the controller 720 provides a feedback to operation 1020 and drives the circulation pump 51 at the third rotation speed (about 1200 to 1400 RPM) until the first time duration passes.

Meanwhile, when the first time duration passes as a result of the determination in operation 1022, the controller 720 stops spraying the washing water by stopping driving the circulation pump 51 using the driving portion 740 (1024). By an operation of spraying the washing water as described above, a first filter washing operation is performed in which a part of the garbage accumulated at the top ends of the filters 120, 130, and 140 moves to the garbage collection chamber 111 and the blockage of the filters 120, 130, and 140 is able to be cleared to a certain degree.

Next, the controller 720 performs a second drainage operation to discharge the garbage and the washing water which remain in the sump 100 for a certain time duration (about 30 seconds) by driving the drainage pump 52 using the driving portion 740 (1026).

Figure 22G:
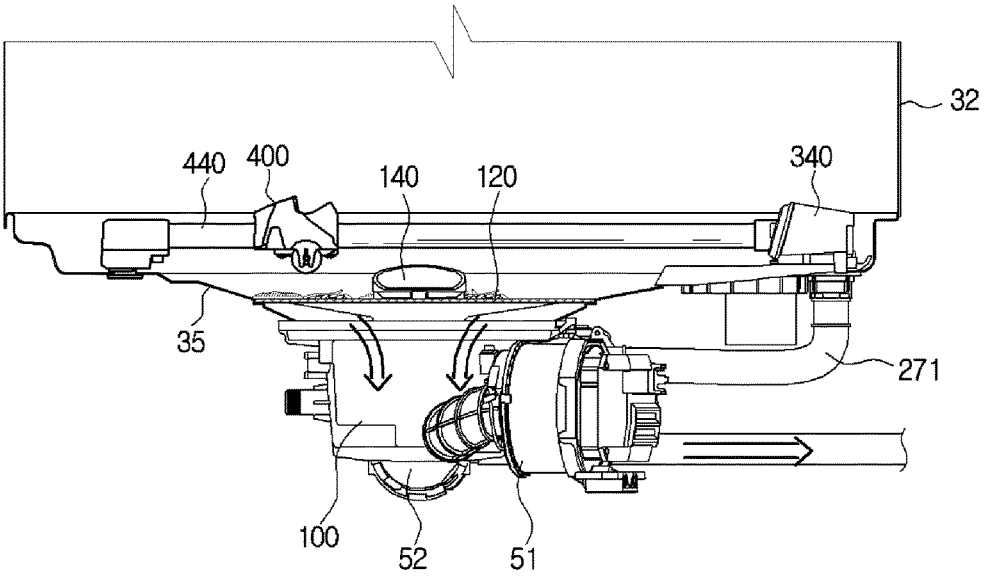

The second drainage operation may provide an effect of secondarily clearing the blockage of the micro filter 130 by a drainage operation to discharge garbage collected at the garbage collection chamber 111 and the washing water to outside of the body 10 (refer to FIG. 22G).

Figure 22H:
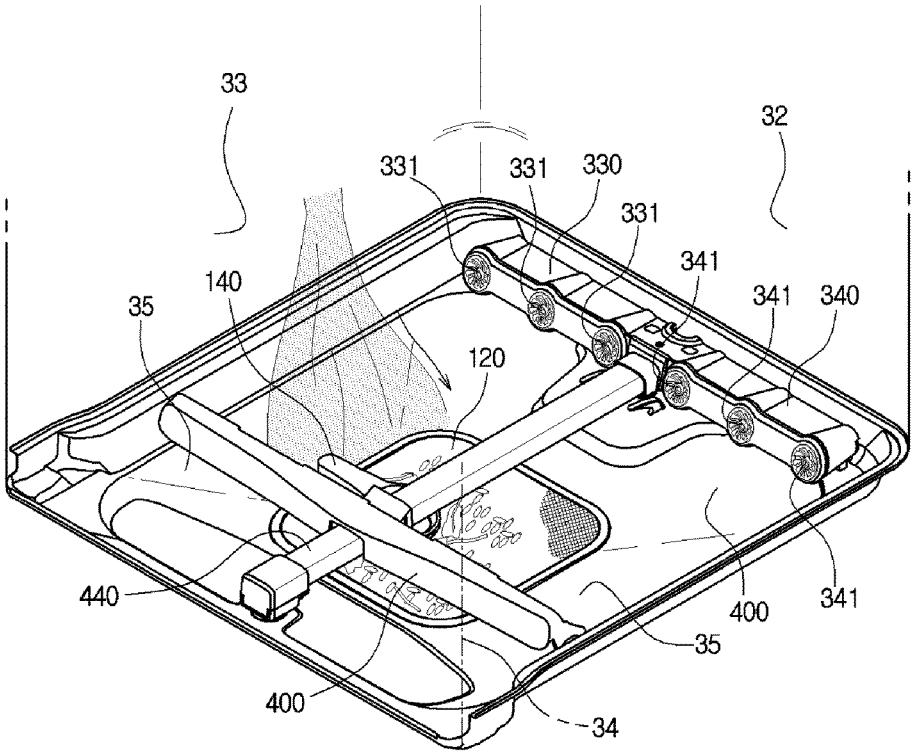
Figure 22I:
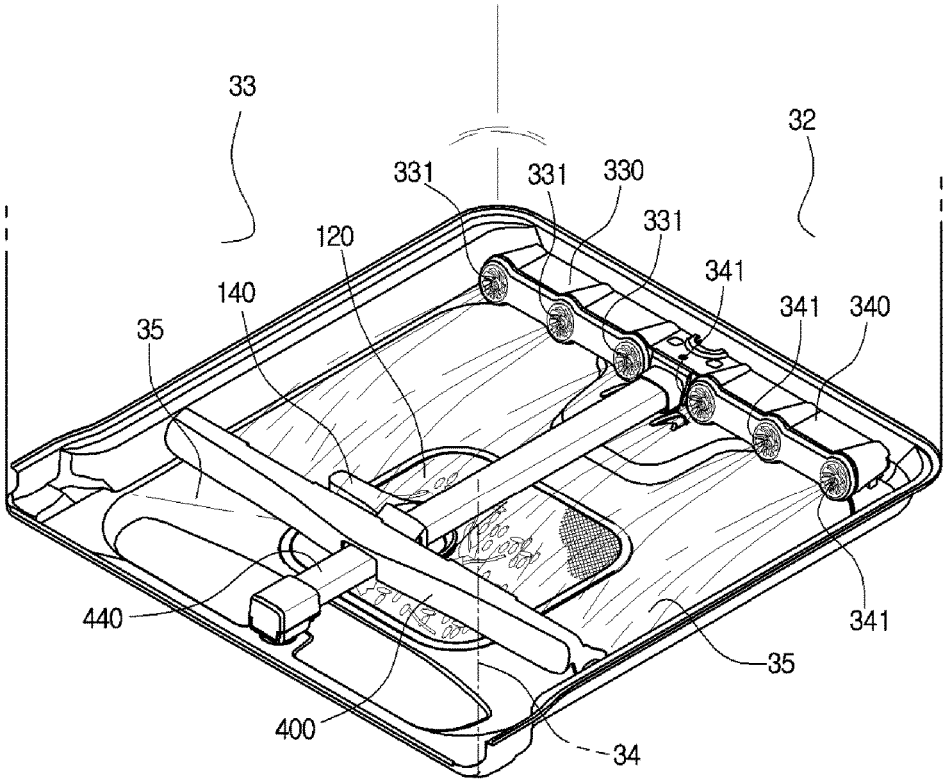

After second drainage, the controller 720 stops driving the drainage pump 52 using the driving portion 740 and supplies washing water for clearing the blockage of the filters 120, 130, and 140 to the washing tub 30 by operating the water supply valve 49 (1028, refer to FIG. 22H).

A flow amount of the washing water supplied to the washing tub 30 is detected by the flowmeter 705 when the washing water for clearing the blockage of the filters 120, 130, and 140 is supplied, and whether the flow amount is the second water supply amount is determined (1030).

As a result of the determination in operation 1030, when the flow amount of the washing water is not the second water supply amount, the controller 720 continues to supply the washing water until the flow amount of the washing water supplied to the washing tub 30 reaches the second water supply amount.

Meanwhile, as a result of the determination in operation 1030, when the flow amount of the washing water is the second water supply amount, the controller 720 stops supplying the washing water by stopping the water supply valve 49.

Figure 22J:
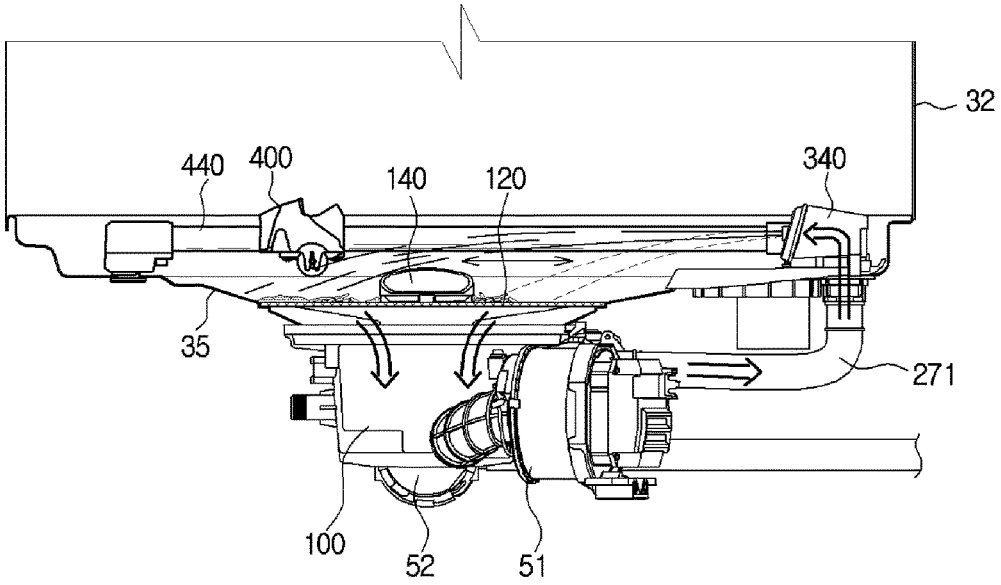

When supplying the washing water to the second water supply amount is completed, the controller 720 allows the washing water sprayed from the nozzles 330 and 340 to be sprayed toward the filters 120, 130, and 140 at the top end of the sump 100 by driving the circulation pump 51 at the third rotation speed (about 1200 to 1400 RPM) (1032, refer to FIGS. 221 to 22J).

Here, the controller 720 determines whether a second time duration (a time duration for clearing the blockage of the filters by directly spraying the washing water sprayed from the nozzles to the top ends of the filters, about 90 seconds) passes by counting the driving time of the circulation pump 51 (1034).

When the second time duration has not passed as determined in operation 1034, the controller 720 provides a feedback to operation 1032 and drives the circulation pump 51 at the third rotation speed (about 1200 to 1400 RPM) until the second time duration passes.

Meanwhile, when the second time duration passes as determined in operation 1034, the controller 720 stops spraying of the washing water by stopping driving the circulation pump 51 using the driving portion 740 (1036). A second filter washing operation is performed in which a considerable amount of the garbage accumulated on the top end of the fine filter 120 moves to the coarse filter 140 and the blockage at the top end of the fine filter 120 is able to be cleared through an operation of directly spraying the washing water described above.

The controller 720 performs a third drainage operation of completely discharging the garbage and washing water which remain in the sump 100 by driving the drainage pump 52 through the driving portion 740 (1038).

Figure 22K:
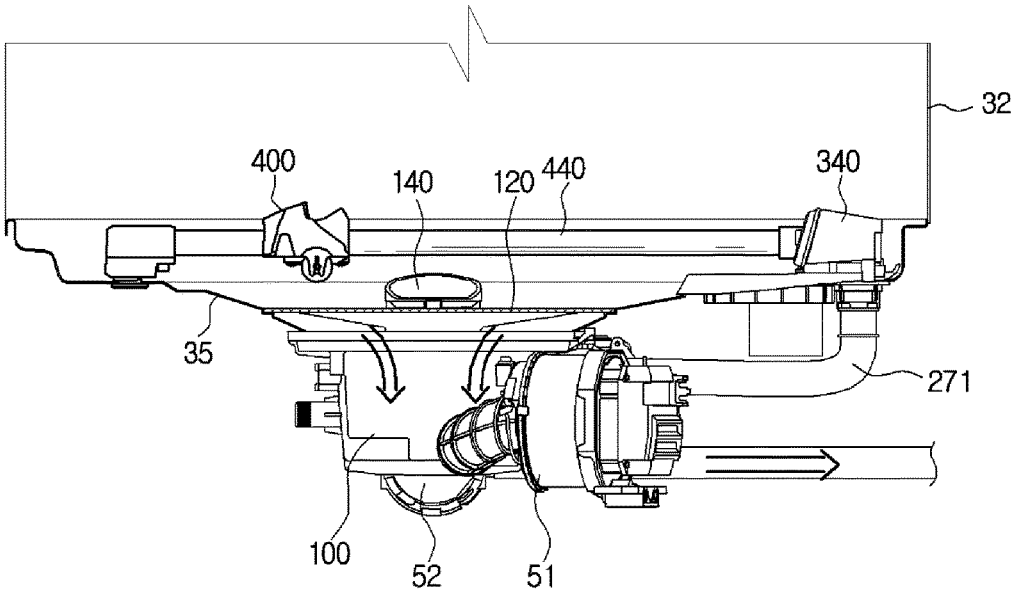

The third drainage operation may provide an effect of clearing for the third time the blockage of the micro filter 130 through a drainage operation to discharge the garbage collected at the garbage collection chamber 111 and the washing water to outside of the body 10 (refer to FIG. 22K).

When the third drainage is finished, the filter blockage clearing algorithm is completed and the controller 720 moves the vane 400 to a reference position by driving the motor 530 using the driving portion 740 (1040) and then performs a washing operation stopped during operation 1010 from the beginning (1042). When the washing operation is performed again from the beginning, the next normal washing operation may be performed without a blockage of the filters 120, 130, and 140 through the filter blockage clearing algorithm of operations 1012 to 1038.

The total time progressed for the filter blockage clearing algorithm described above is about 3 minutes to 3 minutes and 30 seconds.

Meanwhile, in the embodiment of the present invention, performing the filter blockage clearing algorithm shown in FIGS. 21A and 21B when a filter blockage is detected during performing a washing operation of preliminary washing or main washing has been described as an example. However, the present invention is not limited thereto. It is certainly possible to clear the blockage of the filters 120, 130, and 140 by concurrently performing the algorithm (refer to FIG. 19) of striking the rear wall of the washing tub 30 by rotating the vane 400.

Also, in FIGS. 21A and 21B, a method of stopping the washing operation currently being performed to perform the filter blockage clearing algorithm when the blockage of the filters is detected during performing the washing operation of the preliminary washing or the main washing and performing the stopped washing operation again from the beginning when the filter blockage clearing algorithm is completed has been described. However, the present invention is not limited thereto. Even stopping the washing operation currently being performed and performing the filter blockage clearing algorithm when the blockage of the filters is detected during performing the washing operation of the preliminary washing or the main washing and skipping the stopped washing operation and performing the next operation when the filter blockage clearing algorithm is completed may achieve the same objectives and effects as those of the present invention.

In addition, a method is available for stopping a washing operation currently being performed and performing a filter blockage clearing algorithm when a filter blockage is detected during performing a washing operation of main washing and, when the filter blockage clearing algorithm is completed, subsequently performing the remaining portion of the corresponding washing operation from the time point when washing operation was stopped. In this case, the controller 720 counts time for performing the washing operation and stores a point in time of detecting the blockage of the filters 120, 130, and 140, that is, a point in time when the washing operation is stopped. After the filter blockage clearing algorithm is performed, the remaining portion of the washing operation is performed from the point in time when the washing operation was stopped.

FIGS. 22A to 22K are views illustrating a process of clearing a filter blockage of a dish washing machine in accordance with another embodiment of the present invention.

As shown in FIGS. 22A to 22K, it is apparent that an excessive amount of garbage accumulated on the filters 120, 130, and 140 is removed by intensively spraying the washing water sprayed by the nozzles 330 and 340 on the filters 120, 130, and 140 at the top end of the sump 100 using a small amount of washing water (about 700 to 900 cc) and a low rotation speed (about 1200 to 1400 RPM) of the circulation pump 51.

Meanwhile, in FIG. 21A, it has been described as an example that the same amount of the washing water is supplied for each of a first filter washing operation and a second filter washing operation. However, the present invention is not limited thereto, and the same objectives and effects as those of the present invention may be achieved by differentiating the amounts of the washing water supplied for the first filter washing operation and the second filter washing operation. This will be described with reference to FIGS. 23A and 23B.

First, a method of stopping a washing operation currently being performed and performing a filter blockage clearing algorithm when a filter blockage is detected during performing a washing operation of the preliminary washing or the main washing and performing the stopped washing operation again from the beginning when the filter blockage clearing algorithm is completed will be described with reference to FIGS. 23A and 23B.

Figure 23A:
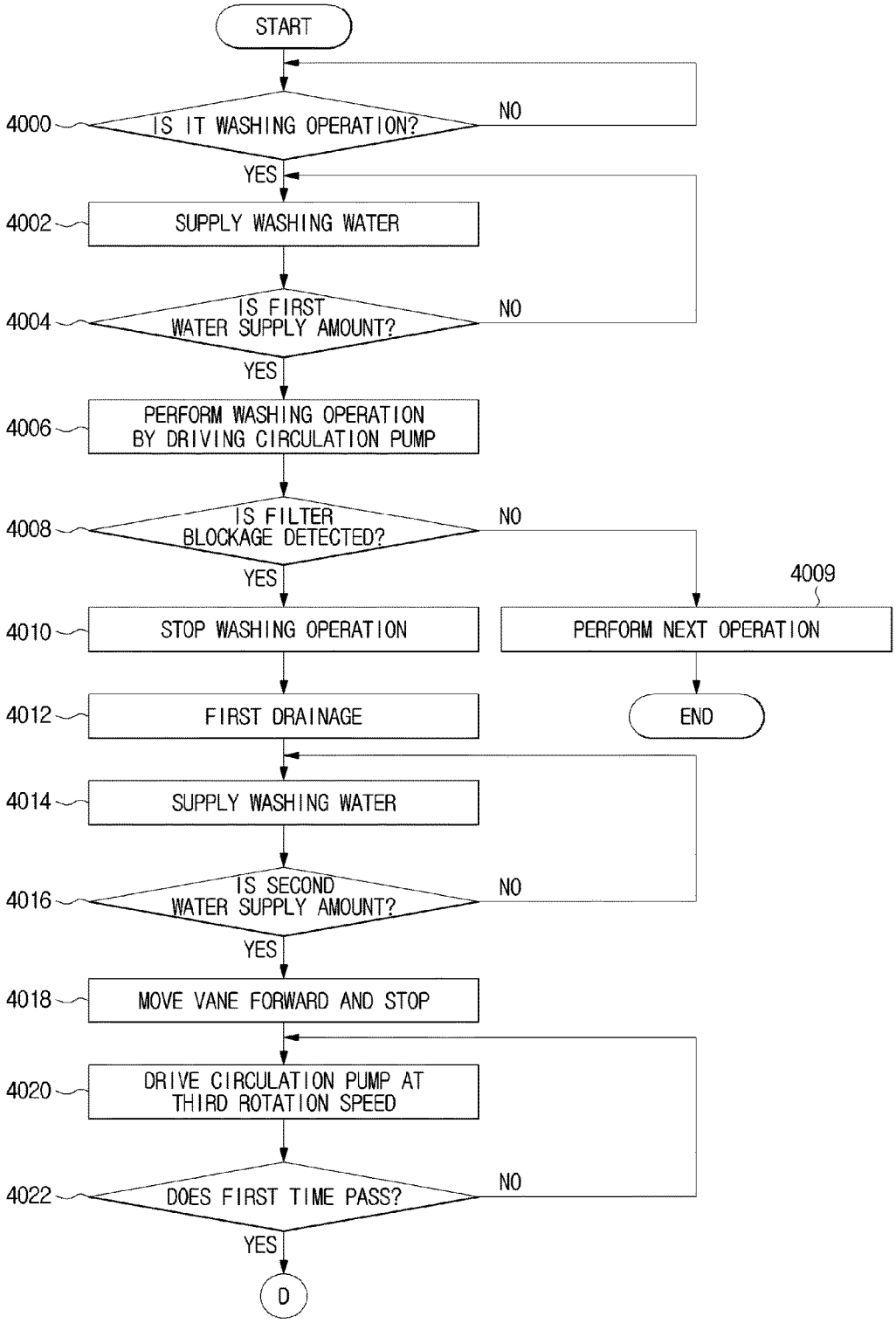
FIGS. 23A and 23B are flowcharts illustrating operations of a second control algorithm for clearing a filter blockage of the dish washing machine in accordance with another embodiment of the present invention.
Figure 23B:
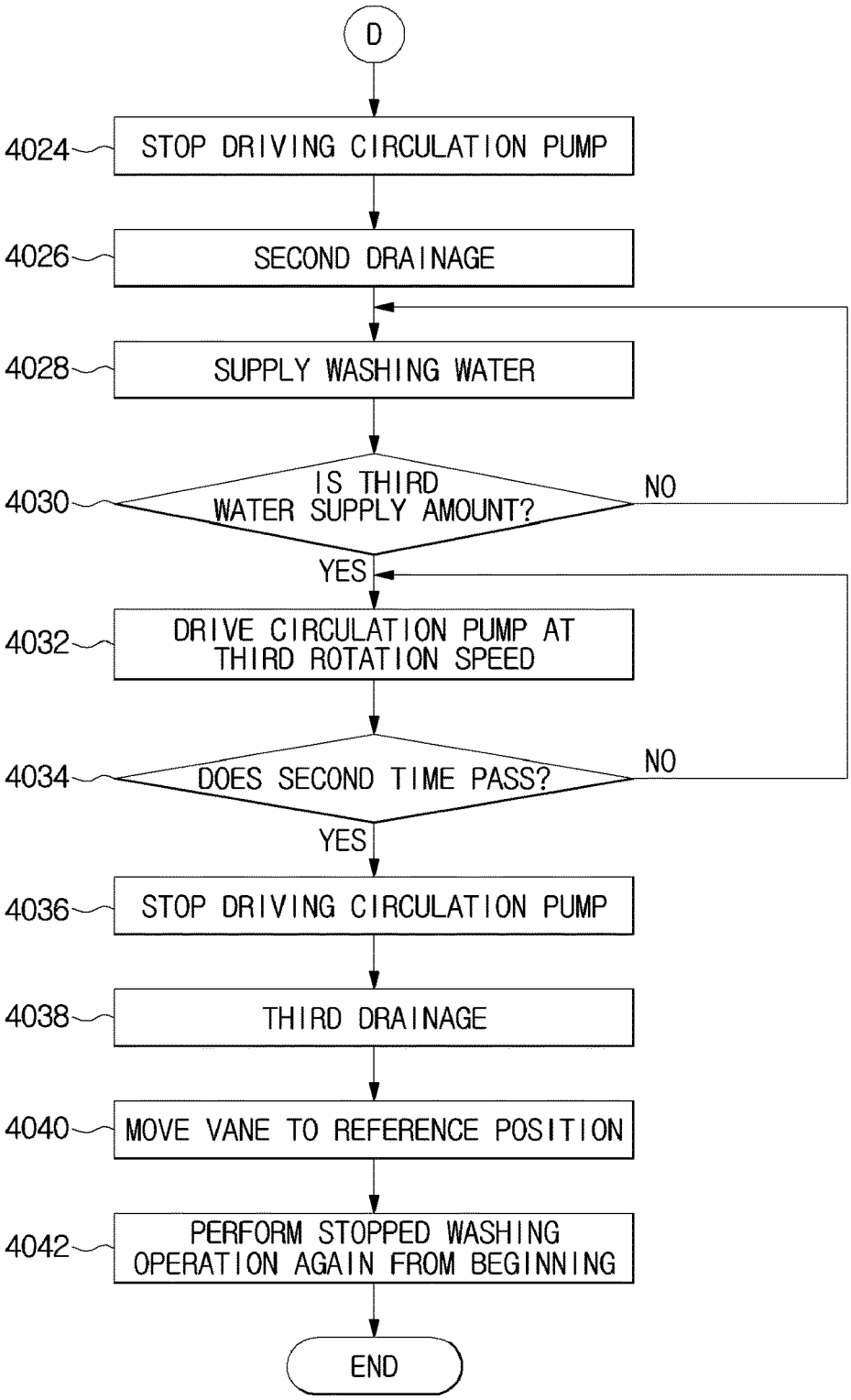

FIGS. 23A and 23B are flowcharts illustrating operations of a second control algorithm for clearing a filter blockage of the dish washing machine in accordance with another embodiment of the present invention. A repetitive description with respect to overlapping descriptions in FIGS. 21A and 21B will be omitted.

In FIGS. 23A and 23B, a user puts dishes to be washed in the baskets 12*a* and 12*b* into the washing tub 30 and selects a washing course (for example, a standard course), the controller 720 starts sequentially performing a series of operations including preliminary washing, main washing, preliminary rinsing, and final rinsing of the dish washing machine 1 according to information on the selected course.

Subsequently, the controller 720 determines whether an operation being currently performed according to a progress of the series of operations is a washing operation of the preliminary washing or the main washing (4000).

When the operation is the washing operation as determined in operation 4000, the controller 720 supplies washing water necessary for the washing operation to the washing tub 30 through the water supply valve 49 and the washing water supplied to the washing tub 30 is collected at the sump 100 provided at the bottom of the washing tub 30 (4002).

A flow amount of the washing water supplied into the washing tub 30 is detected by the flowmeter 705 during supplying of the washing water for the washing operation, and whether the flow amount is the first water supply amount is determined (4004).

As determined in operation 4004, when the flow amount of the washing water is not the first water supply amount, the controller 720 continues to supply the washing water until the flow amount of the washing water supplied to the washing tub 30 reaches the first water supply amount.

When supplying the washing water up to the first water supply amount is completed, the controller 720 pumps the washing water stored in the sump 100 by driving the circulation pump 51 at a set rotation speed (about 3000 to 3400 RPM). The washing operation is performed in which the washing water is sprayed from the nozzles 311, 313, 330, and 340 at a high pressure due to the pumping force of the circulation pump 51 and garbage on dishes is separated from the dishes by the sprayed washing water and collected at the filters 120, 130, and 140 at the top end of the sump 100 (4006).

Here, when an amount of garbage is separated from the dishes that is larger than an amount that the filters 120, 130, and 140 can filter to perform washing, an excessive amount of garbage is accumulated at the filters 120, 130, and 140, and the filters 120, 130, and 140 are blocked.

When the filters 120, 130, and 140 are blocked, since the washing water does not smoothly pass through the filters 120, 130, and 140, an amount of washing water stored in the sump 100 is reduced and an amount of washing water circulated for washing the dishes according to driving of the circulation pump 51 decreases, thereby reducing power consumption of the circulation pump 51. A variation in power consumption of the circulation pump 51 described above is detected by the power consumption detector 760, and the information thereof is sent to the controller 720.

Accordingly, the controller 720 detects a blockage of the filters 120, 130, and 140 using the variation in power consumption during driving of the circulation pump 51 (4008).

As determined in operation 4008, when a blockage of the filters 120, 130, and 140 is not detected, the controller 720 continues to perform a next operation (4009).

Meanwhile, when the blockage of the filters 120, 130, and 140 is detected as a result of the determination in operation 4008, the controller 720 stops the washing operation by stopping driving the circulation pump 51 through the driving portion 740 (4010).

After the washing operation is stopped, the controller 720 performs the filter blockage clearing algorithm for clearing the blockage of the filters 120, 130, and 140.

For performing the filter blockage clearing algorithm, the controller 720 performs a first drainage operation of completely discharging garbage and washing water which remain in the sump 100 by driving the drainage pump 52 through the driving portion 740 (4012).

The first drainage operation may provide an effect of preliminarily clearing the blockage of the micro filter 130 through the drainage operation to discharge the garbage collected at the garbage collection chamber 111 and the washing water to outside of the body 10 (refer to FIGS. 22A and 22B).

After the first drainage, the controller 720 stops driving the drainage pump 52 using the driving portion 740 and supplies washing water for clearing the blockage of the filters 120, 130, and 140 to the washing tub 30 by operating the water supply valve 49 (4014, refer to FIG. 22C).

A flow amount of the washing water supplied into the washing tub 30 is detected by the flowmeter 705 when the washing water for clearing the blockage of the filters 120, 130, and 140 is supplied, and whether the flow amount is a second water supply amount is determined (a small amount of the washing water capable of filling the inside of the sump, about 700 to 900 cc) (4016).

As determined in operation 4016, when the flow amount of the washing water is not the second water supply amount, the controller 720 continues to supply the washing water until the flow amount of the washing water supplied to the washing tub 30 reaches the second water supply amount.

When supplying of the washing water to the second water supply amount is completed, the controller 720 moves the vane 400 forward from a reference position for a certain time duration (about 7 seconds) by driving the motor 530 using the driving portion 740 and then stops the vane 400 (4018, refer to FIG. 22D).

After the forward movement of the vane 400, the controller 720 allows the washing water sprayed from the nozzles 330 and 340 to be sprayed toward the filters 120, 130, and 140 at the top end of the sump 100 by driving the circulation pump 51 at a third rotation speed (about 1200 to 1400 RPM) (4020, refer to FIGS. 22E and 22F).

Here, the controller 720 determines whether a first time duration (a time for moving garbage accumulated on top ends of the filters to the garbage collecting chamber by spraying washing water, about 30 seconds) passes by counting driving time of the circulation pump 51 (4022).

When the first time duration has not passed as determined in operation 4022, the controller 720 provides a feedback to operation 4020 and drives the circulation pump 51 at the third rotation speed (about 1200 to 1400 RPM) until the first time duration passes.

Meanwhile, when the first time duration passes as determined in operation 4022, the controller 720 stops spraying the washing water by stopping driving the circulation pump 51 using the driving portion 740 (4024). A first filter washing operation in which a part of the garbage accumulated on the top ends of the filters 120, 130, and 140 moves to the garbage collection chamber 111 and the blockage of the filters 120, 130, and 140 is able to be cleared to a certain degree is performed through an operation of spraying the washing water described above.

Subsequently, the controller 720 performs a second drainage operation to discharge the garbage and the washing water which remain in the sump 100 for a certain time duration (about 30 seconds) by driving the drainage pump 52 using the driving portion 740 (4026).

The second drainage operation may provide an effect of clearing for the second time the blockage of the micro filter 130 through a drainage operation to discharge garbage collected at the garbage collection chamber 111 and the washing water to outside of the body 10 (refer to FIG. 22G).

After second drainage, the controller 720 stops driving the drainage pump 52 using the driving portion 740 and supplies washing water for clearing the blockage of the filters 120, 130, and 140 to the washing tub 30 by driving the water supply valve 49 (4028, refer to FIG. 22H).

A flow amount of the washing water supplied to the washing tub 30 is detected by the flowmeter 705 when the washing water for clearing the blockage of the filters 120, 130, and 140 is supplied, and whether the flow amount is a third water supply amount is determined (a small amount of the washing water capable of filling the inside of the sump, about 700 cc) (4030). The third water supply amount uses a washing water amount smaller than the second water supply amount. However, depending on a structure or a design option of the dish washing machine 1, the third water supply amount may use an amount of washing water larger than that of the second water supply amount.

As determined in operation 4030, when the flow amount of the washing water is not the third water supply amount, the controller 720 continuously supplies the washing water until the flow amount of the washing water supplied to the washing tub 30 arrives at the third water supply amount.

Meanwhile, as determined in operation 4030, when the flow amount of the washing water is the third water supply amount, the controller 720 stops supplying the washing water by stopping the water supply valve 49.

When supplying the washing water to the third water supply amount is completed, the controller 720 allows the washing water sprayed from the nozzles 330 and 340 to be sprayed toward the filters 120, 130, and 140 at the top end of the sump 100 by driving the circulation pump 51 at the third rotation speed (about 1200 to 1400 RPM) (4032, refer to FIGS. 221 to 22J).

Here, the controller 720 determines whether a second time duration (a time duration for clearing the blockage of the filters by directly spraying the washing water sprayed from the nozzles to the top ends of the filters, about 90 seconds) passes by counting the driving time of the circulation pump 51 (4034).

When the second time duration has not passed as determined in operation 4034, the controller 720 provides a feedback to operation 4032 and drives the circulation pump 51 at the third rotation speed (about 1200 to 1400 RPM) until the second time duration passes.

Meanwhile, when the second time duration passes as determined in operation 4034, the controller 720 stops spraying the washing water by stopping driving the circulation pump 51 using the driving portion 740 (4036). A second filter washing operation is performed in which a considerable amount of the garbage accumulated on the top end of the fine filter 120 moves to the coarse filter 140 and the blockage at the top ends of the filters 120, 130, and 140 is able to be cleared through an operation of directly spraying the washing water described above.

The controller 720 performs a third drainage operation of completely discharging the garbage and washing water which remain in the sump 100 by driving the drainage pump 52 through the driving portion 740 (4038).

The third drainage operation may provide an effect of clearing for the third time the blockage of the micro filter 130 through a drainage operation to discharge the garbage collected at the garbage collection chamber 111 and the washing water to outside of the body 10 (refer to FIG. 22K).

When the third drainage is finished, the filter blockage clearing algorithm is completed and the controller 720 moves the vane 400 to the reference position by driving the motor 530 using the driving portion 740 (4040) and then performs the washing operation stopped in operation 4010 from the beginning (4042). When the washing operation is performed again from the beginning, the next normal washing operation may be performed without a filter blockage due to the filter blockage clearing algorithm of operations 4012 to 4038.

Also, in FIGS. 23A and 23B, it has been described as an example that the circulation pump is driven at the same rotation speed while a different amount of the washing water is supplied for each of a first filter washing operation and a second filter washing operation. However, the present invention is not limited thereto, and the same objectives and effects as those of the present invention may be achieved by changing the rotation speed of the circulation pump while the amounts of the washing water supplied for the first filter washing operation and the second filter washing operation are differentiated. This will be described with reference to FIGS. 24A and 24B.

First, a method of stopping a washing operation currently being performed and performing a filter blockage clearing algorithm when a filter blockage is detected while the washing operation of preliminary washing or the main washing is performed and performing the stopped washing operation again from the beginning when the filter blockage clearing algorithm is completed will be described with reference to FIGS. 24A and 24B.

Figure 24A:
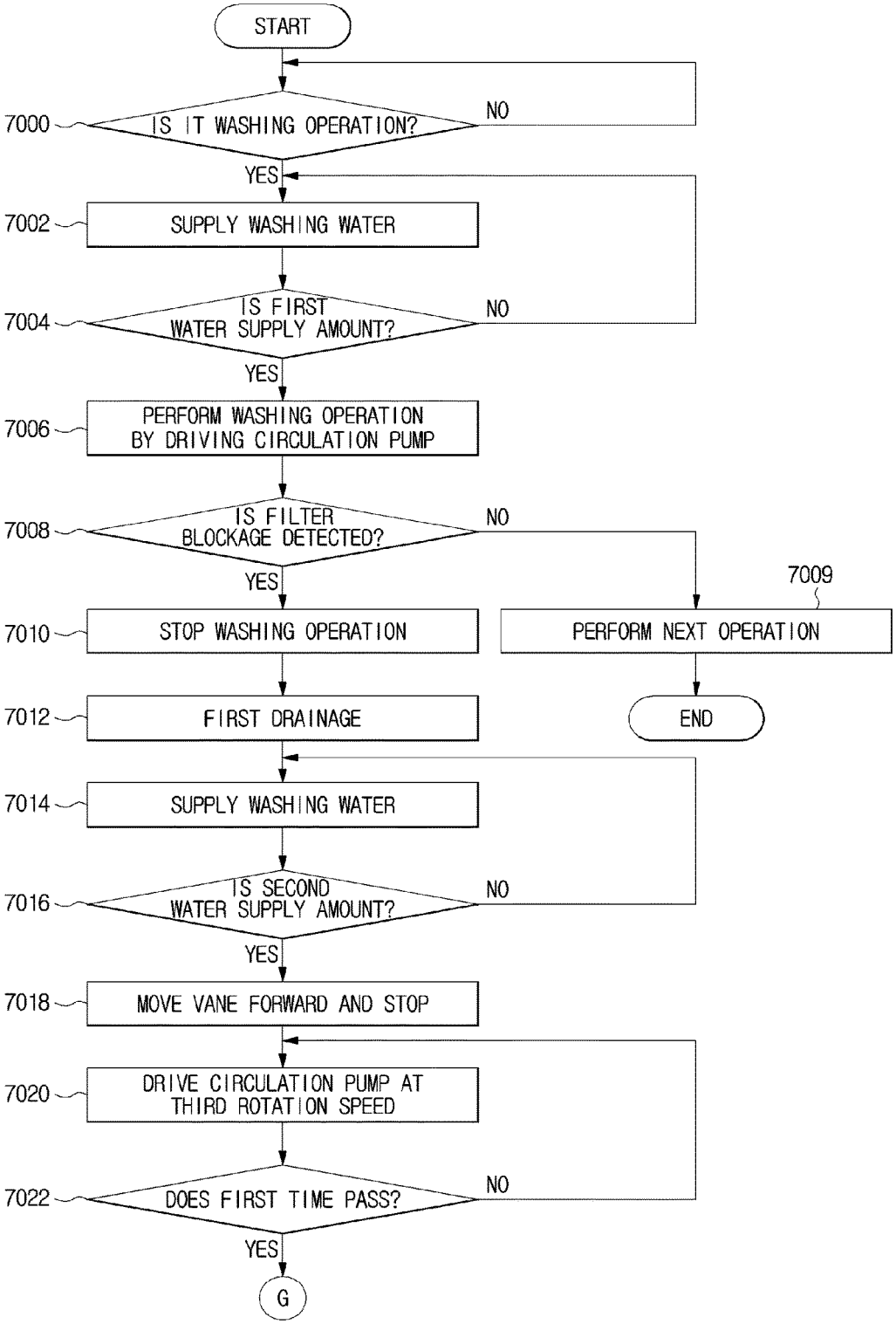
FIGS. 24A and 24B are flowcharts illustrating operations of a third control algorithm for clearing the filter blockage of the dish washing machine in accordance with another embodiment of the present invention.
Figure 24B:
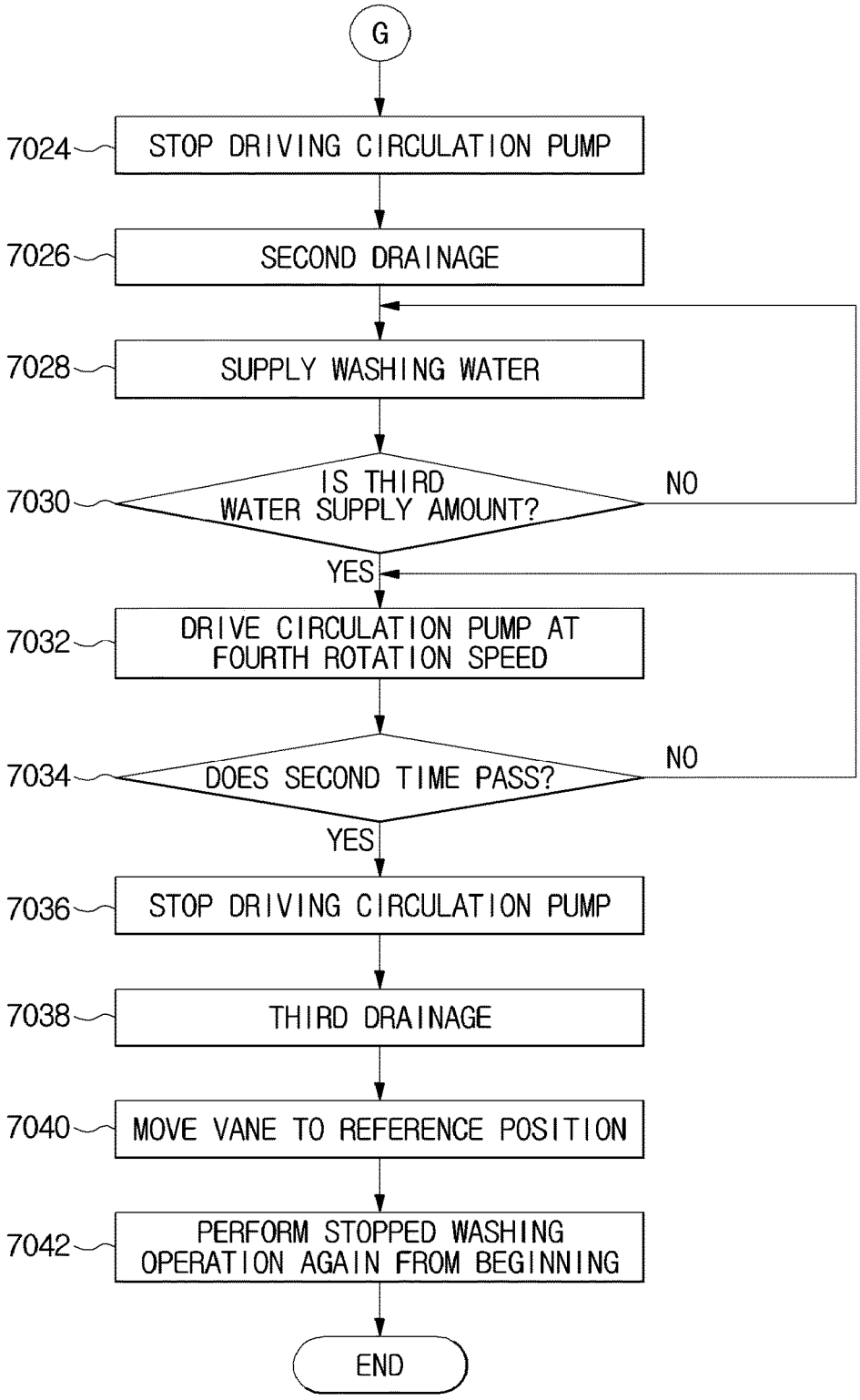

FIGS. 24A and 24B are flowcharts illustrating operations of a third control algorithm for clearing a filter blockage of the dish washing machine in accordance with another embodiment of the present invention. A repetitive description with respect to overlapping descriptions in FIGS. 21A and 21B will be omitted.

In FIGS. 24A and 24B, a user puts dishes to be washed in the baskets 12*a* and 12*b* in the washing tub 30 and selects a washing course (for example, a standard course), the controller 720 starts sequentially performing a series of operations including preliminary washing, main washing, preliminary rinsing, and final rinsing of the dish washing machine 1 according to information on the selected course.

Subsequently, the controller 720 determines whether an operation which is being currently performed according to a progress of the series of operations is a washing operation of the preliminary washing or the main washing (7000).

When the operation is the washing operation as determined in operation 7000, the controller 720 supplies washing water necessary for the washing operation into the washing tub 30 through the water supply valve 49 and the washing water supplied to the washing tub 30 is collected at the sump 100 provided at the bottom of the washing tub 30 (7002).

A flow amount of the washing water supplied into the washing tub 30 is detected by the flowmeter 705 when the washing water for the washing operation is supplied, and whether the flow amount is the first water supply amount is determined (7004).

As determined in operation 7004, when the flow amount of the washing water is not the first water supply amount, the controller 720 continues to supply the washing water until the flow amount of the washing water supplied to the washing tub 30 reaches the first water supply amount.

When supplying the washing water to the first water supply amount is completed, the controller 720 pumps the washing water stored in the sump 100 by driving the circulation pump 51 at a set rotation speed (about 3000 to 3400 RPM). The washing operation is performed in which the washing water is sprayed from the nozzles 311, 313, 330, and 340 at a high pressure due to the pumping force of the circulation pump 51 and garbage on dishes is separated from the dishes by the sprayed washing water and collected at the filters 120, 130, and 140 at the top end of the sump 100 (7006).

Here, when a larger amount of garbage than an amount for allowing the filters 120, 130, and 140 to filter to perform washing is separated from the dishes, an excessive amount of garbage is accumulated at the filters 120, 130, and 140 and the filters 120, 130, and 140 are blocked.

When the filters 120, 130, and 140 are blocked, since the washing water does not smoothly pass through the filters 120, 130, and 140, an amount of washing water stored in the sump 100 is reduced and a circulation amount of washing water circulated for washing the dishes according to driving of the circulation pump 51 decreases, thereby reducing power consumption of the circulation pump 51. A variation in power consumption of the circulation pump 51 described above is detected by the power consumption detector 760, and the information thereof sent to the controller 720.

Accordingly, the controller 720 detects a blockage of the filters 120, 130, and 140 using the variation in power consumption during driving of the circulation pump 51 (7008).

As a result of the determination in operation 7008, when a blockage of the filters 120, 130, and 140 is not detected, the controller 720 continues to perform the next operation (7009).

Meanwhile, when a blockage of the filters 120, 130, and 140 is detected as a result of the determination in operation 7008, the controller 720 stops the washing operation by stopping the driving of the circulation pump 51 through the driving portion 740 (7010).

After the washing operation is stopped, the controller 720 performs the filter blockage clearing algorithm for clearing the blockage of the filters 120, 130, and 140.

For performing the filter blockage clearing algorithm, the controller 720 performs a first drainage operation of completely discharging garbage and washing water which remain in the sump 100 by driving the drainage pump 52 through the driving portion 740 (7012).

The first drainage operation may provide the effect of preliminarily clearing the blockage of the micro filter 130 through the drainage operation to discharge the garbage collected at the garbage collection chamber 111 and the washing water to outside of the body 10 (refer to FIGS. 22A and 22B).

After the first drainage, the controller 720 stops driving the drainage pump 52 using the driving portion 740 and supplies washing water for clearing the blockage of the filters 120, 130, and 140 to the washing tub 30 by operating the water supply valve 49 (7014, refer to FIG. 22C).

A flow amount of the washing water supplied to the washing tub 30 is detected by the flowmeter 705 when the washing water for clearing the blockage of the filters 120, 130, and 140 is supplied, and whether the flow amount is a second water supply amount is determined (a small amount of the washing water capable of filling the inside of the sump, about 700 to 900 cc) (7016).

As determined in operation 7016, when the flow amount of the washing water is not the second water supply amount, the controller 720 continues to supply the washing water until the flow amount of the washing water supplied to the washing tub 30 reaches the second water supply amount.

When supplying the washing water to the second water supply amount is completed, the controller 720 moves the vane 400 forward from a reference position for a certain time duration (about 7 seconds) by driving the motor 530 using the driving portion 740 and then stops the vane 400 (7018, refer to FIG. 22D).

After the forward movement of the vane 400, the controller 720 allows the washing water sprayed from the nozzles 330 and 340 to be sprayed toward the filters 120, 130, and 140 at the top end of the sump 100 by driving the circulation pump 51 at a third rotation speed (about 1200 to 1400 RPM) (7020).

Here, the controller 720 determines whether a first time duration (a time duration for moving garbage accumulated on top ends of the filters to the garbage collecting chamber by spraying washing water, about 30 seconds) passes by counting driving time of the circulation pump 51 (7022).

When the first time duration has not pass as determined in operation 7022, the controller 720 provides a feedback to operation 7020 and drives the circulation pump 51 at the third rotation speed (about 1200 to 1400 RPM) until the first time duration passes.

Meanwhile, when the first time duration passes as determined in operation 7022, the controller 720 stops spraying the washing water by stopping driving of the circulation pump 51 using the driving portion 740 (7024). A first filter washing operation in which a part of the garbage accumulated on the top ends of the filters 120, 130, and 140 moves to the garbage collection chamber 111 and the blockage of the filters 120, 130, and 140 is able to be cleared to a certain degree is performed through an operation of spraying the washing water described above.

Subsequently, the controller 720 performs a second drainage operation to discharge the garbage and the washing water which remain in the sump 100 for a certain time duration (about 30 seconds) by driving the drainage pump 52 using the driving portion 740 (7026).

The second drainage operation may provide an effect of clearing for the second time the blockage of the micro filter 130 through a drainage operation to discharge garbage collected at the garbage collection chamber 111 and the washing water to outside of the body 10 (refer to FIG. 22G).

After the second drainage, the controller 720 stops driving the drainage pump 52 using the driving portion 740 and supplies washing water for clearing the blockage of the filters 120, 130, and 140 to the washing tub 30 by driving the water supply valve 49 (7028, refer to FIG. 22H).

A flow amount of the washing water supplied into the washing tub 30 is detected by the flowmeter 705 when the washing water for clearing the blockage of the filters 120, 130, and 140 is supplied, and whether the flow amount is a third water supply amount is determined (a small amount of the washing water capable of filling the inside of the sump, about 700 cc) (7030).

As determined in operation 7030, when the flow amount of the washing water is not the third water supply amount, the controller 720 continues to supply the washing water until the flow amount of the washing water supplied to the washing tub 30 reaches the third water supply amount.

When supplying the washing water to the third water supply amount is completed, the controller 720 allows the washing water sprayed from the nozzles 330 and 340 to be sprayed toward the filters 120, 130, and 140 at the top end of the sump 100 by driving the circulation pump 51 at a fourth rotation speed (about 1000 to 1100 RPM) (7032, refer to FIGS. 221 to 22J). When the third water supply amount is less than the second water supply amount, the fourth rotation speed is provided lower than the third rotation speed. Meanwhile, the fourth rotation speed is provided to be higher than the third rotation speed to change a rotation speed of the circulation pump 51 according to an amount of water supply when the third water supply amount is greater than the second amount of water supply.

Here, the controller 720 determines whether a second time duration (a time duration for clearing the blockage of the filters by directly spraying the washing water sprayed from the nozzles to the top ends of the filters, about 90 seconds) passes by counting the driving time of the circulation pump 51 (7034).

When the second time has not pass as determined in operation 7034, the controller 720 provides a feedback to operation 7032 and drives the circulation pump 51 at the fourth rotation speed (about 1000 to 1100 RPM) until the second time duration passes.

Meanwhile, when the second time duration passes as determined in operation 7034, the controller 720 stops spraying of the washing water by stopping driving the circulation pump 51 using the driving portion 740 (7036). A second filter washing operation is performed in which a considerable amount of the garbage accumulated on the top end of the fine filter 120 moves to the coarse filter 140 and the blockage at the top ends of the filters 120, 130, and 140 is able to be cleared through an operation of directly spraying the washing water described above.

The controller 720 performs a third drainage operation of completely discharging the garbage and washing water which remain in the sump 100 by driving the drainage pump 52 through the driving portion 740 (7038).

The third drainage operation may provide an effect of clearing for the third time the blockage of the micro filter 130 through a drainage operation to discharge the garbage collected at the garbage collection chamber 111 and the washing water to outside of the body 10 (refer to FIG. 22K).

When the third drainage is finished, the filter blockage clearing algorithm is completed, and the controller 720 moves the vane 400 to the reference position by driving the motor 530 using the driving portion 740 (7040) and then performs the washing operation stopped in operation 7010 from the beginning (7040). When the washing operation is performed again from the beginning, the next normal washing operation may be performed without a blockage of the filters 120, 130, and 140 through the filter blockage clearing algorithm of operations 7012 to 7038.

Meanwhile, in the embodiment of the present invention, an example has been described for controlling the rotation speed of the circulation pump 51 to be identical or changed while adjusting amounts of washing water supplied for the first filter washing operation and the second filter washing operation to be identical or different. However, the present invention is not limited thereto, and the same objective and effects as those of the present invention may be achieved by controlling driving time durations of the circulation pump 51 driven for the first filter washing operation and the second filter washing operation to be different.

When an excessive amount of garbage is accumulated on the fine filter 120 during the washing operation, an amount of circulating washing water decreases, thereby reducing power consumption of the circulation pump 51. In FIG. 21A to FIG. 24B, a method of detecting whether the fine filter 120 is blocked using a variation in power consumption of the circulation pump 51 described above and clearing a blockage of the fine filter 120 will be described.

However, bubbles may be generated during spraying of washing water due to an external cause such as garbage, a detergent, washing water, etc. during a washing operation. Particularly, a large amount of bubbles is generated due to eggshells. When bubbles are generated during the washing operation, a problem occurs in a process in which washing water flows into the circulation pump 51 and an amount of circulating washing water decreases and power consumption of the circulation pump 51 is reduced.

Accordingly, when the power consumption of the circulation pump 51 is reduced during the washing operation, it is necessary to appropriately respond by determining whether the power consumption is reduced due to the generation of bubbles or the filter blockage.

For this, in the present invention, an algorithm is performed for determining whether the power consumption of the circulation pump 51 is reduced during the washing operation due to the generation of bubbles or the filter blockage. This will be described with reference to FIGS. 25A and 25B.

Figure 25A:
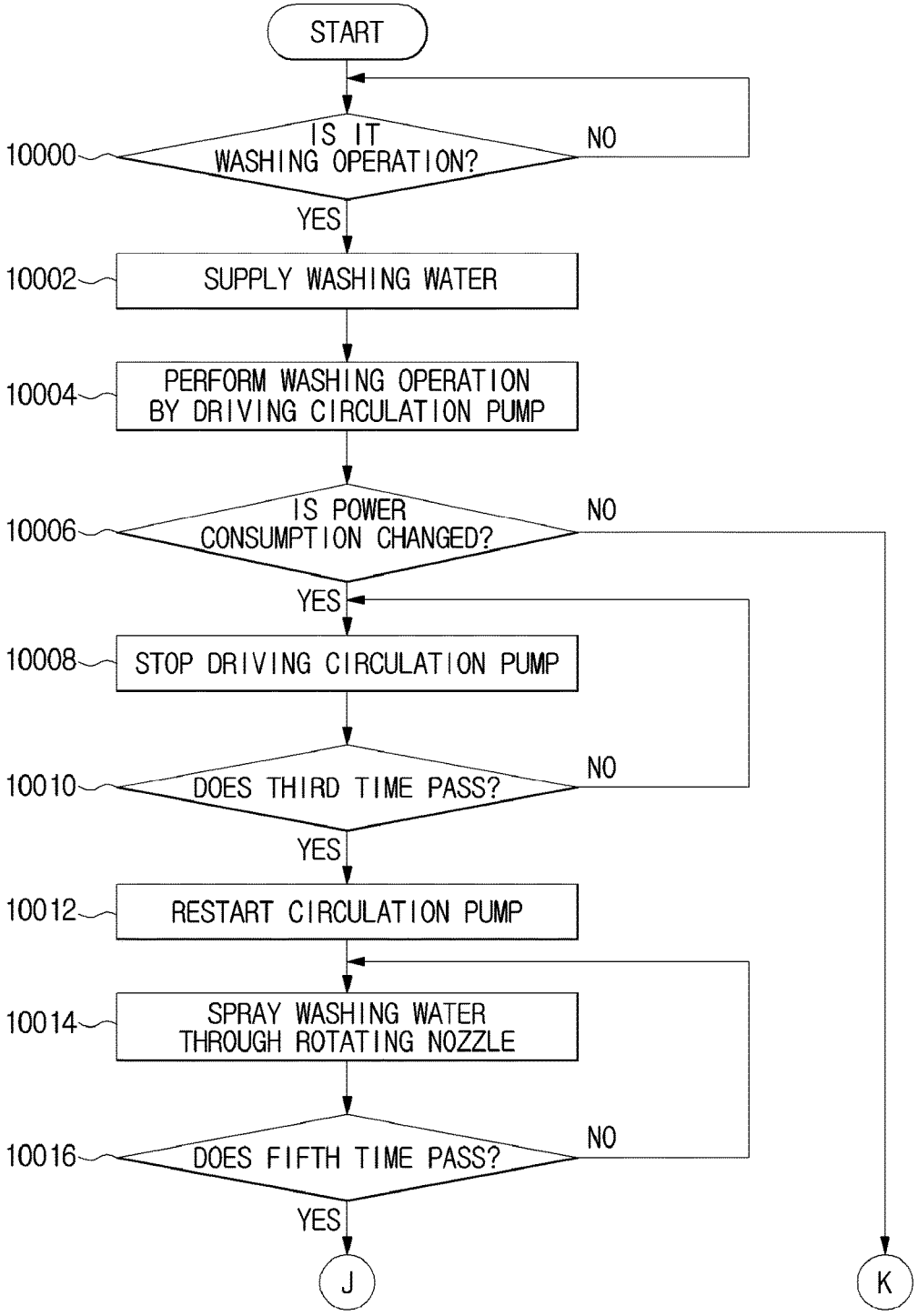
FIGS. 25A and 25B are flowcharts illustrating operations of a control algorithm for sensing bubbles in the dish washing machine in accordance with still another embodiment of the present invention.
Figure 25B:
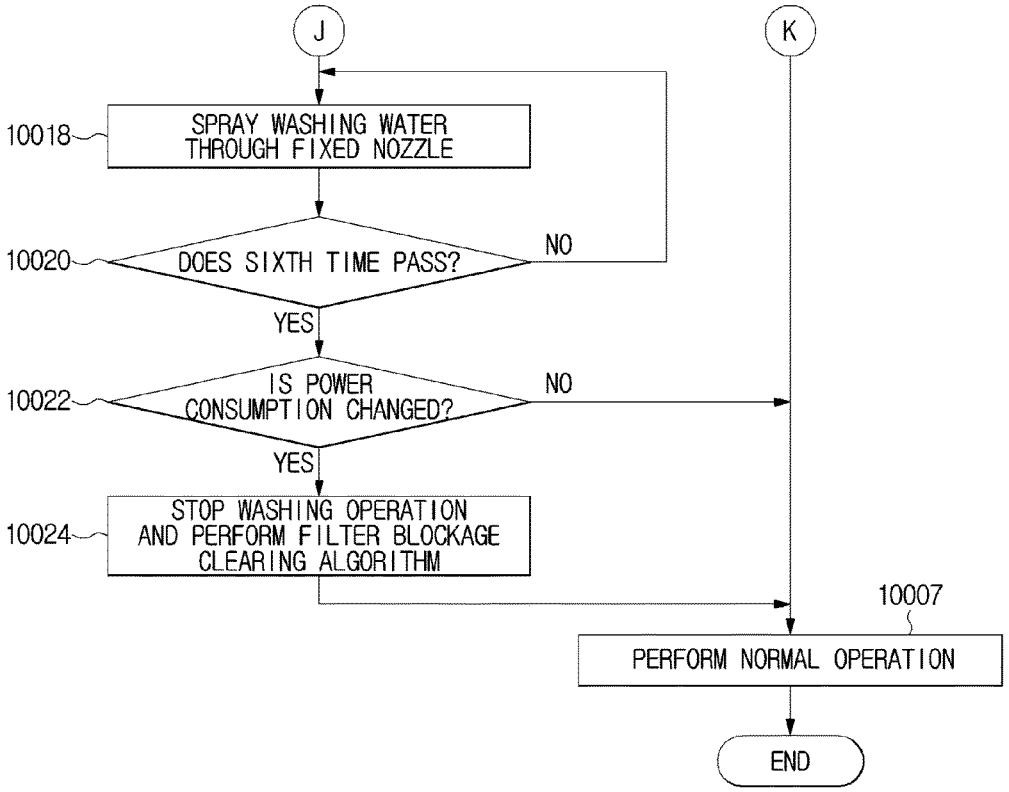

FIGS. 25A and 25B are flowcharts illustrating operations of a control algorithm for sensing bubbles in the dish washing machine in accordance with another embodiment of the present invention. A repetitive description with respect to overlapping descriptions in FIGS. 21A and 21B will be omitted.

In FIGS. 25A and 25B, a user puts dishes to be washed in the baskets 12*a* and 12*b* in the washing tub 30 and selects a washing course (for example, a standard course), the controller 720 starts sequentially performing a series of operations including preliminary washing, main washing, preliminary rinsing, and final rinsing of the dish washing machine 1 according to information on the selected course.

Subsequently, the controller 720 determines whether an operation currently being performed according to a progress of the series of operations is a washing operation of the preliminary washing or the main washing (10000).

When the operation is the washing operation as determined in operation 10000, the controller 720 supplies washing water necessary for the washing operation into the washing tub 30 through the water supply valve 49, and the washing water supplied to the washing tub 30 is collected at the sump 100 provided at the bottom of the washing tub 30 (10002).

When an amount of the washing water necessary for the washing operation is supplied, the controller 720 pumps the washing water stored in the sump 100 by driving the circulation pump 51 at a set rotation speed (about 3000 to 3400 RPM). The washing operation is performed in which the washing water is sprayed from the nozzles 311, 313, 330, and 340 at a high pressure due to the pumping force of the circulation pump 51 and garbage on dishes is separated from the dishes by the sprayed washing water and collected at the fine filter 120 at the top end of the sump 100 (10004).

Here, when an amount of garbage is separated from dishes that is larger than an amount capable of being filtered by the fine filter 120 and washed or a large amount of bubbles are generated due to a particular piece of garbage (for example, an eggshell) or a detergent, an amount of circulating washing water decreases and power consumption of the circulation pump 51 is reduced. A variation in power consumption of the circulation pump 51 described above is detected by the power consumption detector 760, and information thereof is sent to the controller 720.

Accordingly, the controller 720 determines whether the power consumption is reduced using the variation in power consumption during driving of the circulation pump 51 (10006).

When the power consumption is not changed as determined in operation 10006, the controller 720 continues to perform the next normal operation (10007).

Meanwhile, when the power consumption is changed as determined in operation 10006, the controller 720 stops driving the circulation pump 51 using the driving portion 740 to determine whether the variation in power consumption is caused by the generation of bubbles or the filter blockage (10008).

Subsequently, the controller 720 counts stopped time duration of the circulation pump 51 and determines whether a third time duration (a time duration necessary for removing bubbles, about 3 minutes) has passed (10010).

When the third time duration has not passed as determined in operation 10010, the controller 720 provides a feedback to operation 10008 and stops the circulation pump 51 until the third time duration passes. When the variation in power consumption is caused by the generation of bubbles, bubbles is preliminarily removed by stopping driving the circulation pump 51 for a certain time duration.

Meanwhile, when the third time duration has passes as determined in operation 10010, the controller 720 slow-starts the circulation pump 51 using the driving portion 740. Slow-starting is slowly driving the circulation pump 51 from 1600 RPM to 3000 RPM. A reason for slow-starting the circulation pump 51 is to prevent bubbles preliminarily removed by stopping the circulation pump 51 from suddenly being generated again.

The controller 720 determines whether a fourth time (about 1 minute) has passed by counting a time duration of slow-starting the circulation pump 51, and when the fourth time duration does not pass, the controller 720 starts the circulation pump 51 until the fourth time duration passes.

Meanwhile, when the fourth time duration passes, the controller 720 circulates the washing water by restarting the circulation pump 51 at a set rotation speed (about 3000 to 3400 RPM) using the driving portion 740 (10012).

Also, the controller 720 controls washing water supplied from the distribution device 200 to be sprayed through the upper rotating nozzle 311 and the intermediate rotating nozzle 313 (10014).

The controller 720 counts time for spraying the washing water through the upper rotating nozzle 311 and the intermediate rotating nozzle 313 and determines whether a fifth time duration (a time duration necessary for washing out bubbles, about 2 minutes) passes (10016).

When the fifth time duration does not pass as determined in operation 10016, the controller 720 provides a feedback to operation 10014 and controls the washing water to be sprayed through the upper rotating nozzle 311 and the intermediate rotating nozzle 313 until the fifth time duration passes. This is to wash down bubbles at the top of the washing tub 30 by spraying the washing water downward from the nozzles 311 and 313 positioned at the top of the washing tub 30.

Meanwhile, when the fifth time duration passes as determined in operation 10020, the controller 720 controls the washing water supplied from the distribution device 200 to be sprayed through the lower fixed nozzles 330 and 340 (10018).

The controller 720 counts time for spraying the washing water through the fixed nozzles 330 and 340 and determines whether a sixth time duration (a time duration necessary for washing out bubbles, about 2 minutes) passes (10020). Meanwhile, the sixth time duration may be set to be different from the fifth time duration.

When the sixth time duration has not pass as determined in operation 10020, the controller 720 provides a feedback to operation 10018 and controls the washing water to be sprayed through the fixed nozzles 330 and 340 until the sixth time duration passes. This is to wash out bubbles at the bottom of the washing tub 30 by spraying the washing water from the nozzles 330 and 340 positioned at the bottom of the washing tub 30 toward the front of the washing tub 30.

Meanwhile, in the embodiment of the present invention, an example has been described in which bubbles in the washing tub 30 are washed out by sequentially performing operations of restarting the circulation pump 51 after the third time duration passes, spraying washing water through the rotating nozzles 311 and 313, and spraying washing water through the fixed nozzles 330 and 340. However, the present invention is not limited thereto, and it may be configured to wash out bubbles in the washing tub 30 by restarting the circulation pump 51 after the third time duration passes and spraying washing water through the rotating nozzles 311 and 313.

In addition, the present invention may be configured to wash out bubbles in the washing tub 30 by restarting the circulation pump 51 after the third time duration passes and spraying washing water through the fixed nozzles 330 and 340.

Also, the present invention may be configured to sequentially perform operations of restarting the circulation pump 51, spraying washing water through the rotating nozzles 311 and 313, and spraying washing water through the fixed nozzles 330 and 340 or may be configured to independently perform each of the operations or perform each of the operations in parallel.

Meanwhile, when the sixth time duration passes as determined in operation 10020, the controller 720 determines whether power consumption is reduced using a variation in power consumption to finally determine whether it is the generation of bubbles or a filter blockage (10022).

When the power consumption is not changed as determined in operation 10022, the controller 720 determines that the variation in power consumption is caused by the generation of bubbles and proceeds to operation 10007 to continue performing the next normal operation.

Meanwhile, when the power consumption is changed as determined in operation 10022, the controller 720 determines that the variation in power consumption is caused by a filter blockage and stops the washing operation by stopping driving the circulation pump 51 using the driving portion 740. Also, after performing the filter blockage clearing algorithm for clearing the blockage of the fine filter 120, operation 10007 is performed, and the performance of the next normal operation is continued.

As described above, in accordance with another embodiment of the present invention, whether the variation in power consumption is caused by the generation of bubbles or the filter blockage is determined. When determined as caused by the generation of bubbles, performance of the normal operation after removing bubbles is continued. When determined as caused by a filter blockage, filter blockage clearing algorithm is performed and then a normal operation.

Although a few embodiments of the present disclosure have been shown and described, it would be appreciated by those skilled in the art that changes may be made in these embodiments without departing from the principles and spirit of the present disclosure, the scope of which is defined in the claims and their equivalents.

The invention claimed is:

1. A method of controlling a dish washing machine which comprises a nozzle which sprays washing water, a pump which supplies the washing water to the nozzle, a vane which redirects the washing water sprayed from the nozzle to a dish, and a filter which filters garbage in the washing water, the method comprising:

identifying whether the vane arrives located at a position adjacent to the nozzle in response to a drainage operation;

rotating the vane approaching the position adjacent to the nozzle;

stopping a movement of the vane based on whether the vane arrives at the position adjacent to the nozzle; and spraying the washing water from the nozzle by driving of the pump, where the washing water sprayed from the nozzle is redirected to a rear wall by the rotated vane and strikes the rear wall.

2. The method of claim 1, wherein the garbage which remains at the filter is removed by the washing water having struck the rear wall.

3. The method of claim 1, further comprising moving the vane to the position adjacent to the nozzle based on the vane does not arriving at the position adjacent to the nozzle.

4. The method of claim 1, wherein the driving of the pump comprises adjusting an amount of the washing water sprayed from the nozzle by controlling a rotation speed of the pump.

5. The method of claim 1, wherein the driving of the pump comprises adjusting an amount of the washing water sprayed from the nozzle by controlling a driving time of the pump.

6. The method of claim 1, further comprising identifying a blockage of the filter based on a variation in power consumption of the pump and a reduction in the power consumption of the pump.

7. The method of claim 1, wherein the garbage which blocks the filter is removed by controlling a water supply amount of the washing water and a rotation speed of the pump.

8. The method of claim 7, wherein the controlling of the water supply amount of the washing water comprises supplying a water supply amount of the washing water for washing the filter that is less than a water supply amount of the washing water for a washing operation.

9. The method of claim 7, wherein the controlling of the rotation speed of the pump comprises controlling a rotation speed of the pump driven for washing the filter to be lower than a rotation speed of the pump driven for a washing operation.

* * * * *